United States Patent [19]

Kuus

[11] 4,345,648

[45] Aug. 24, 1982

[54] INFLATABLE PACKER SYSTEM

[75] Inventor: Felix Kuus, Huntington Beach, Calif.

[73] Assignee: BJ-Hughes, Inc., Long Beach, Calif.

[21] Appl. No.: 120,418

[22] Filed: Feb. 11, 1980

[51] Int. Cl.[3] ..... E21B 33/127

[52] U.S. Cl. ..... 166/106; 166/187

[58] Field of Search ..... 166/315, 187, 106, 325; 137/116

[56] References Cited

U.S. PATENT DOCUMENTS

| | | | |
|---|---|---|---|
| 3,083,774 | 4/1963 | Peters et al. | 166/187 |
| 3,427,651 | 2/1969 | Bielstein et al. | 166/187 |
| 3,439,740 | 4/1969 | Conouer | 166/187 |
| 3,818,922 | 6/1974 | Malone | 166/187 |
| 3,908,769 | 9/1975 | Schuyf et al. | 166/187 |
| 3,926,254 | 12/1975 | Evans et al. | 166/106 |
| 4,082,298 | 4/1978 | Sanford | 166/187 |
| 4,246,964 | 1/1981 | Brandell | 166/106 |
| 4,246,964 | 1/1981 | Brandell | 166/187 |

*Primary Examiner*—James A. Leppink

*Attorney, Agent, or Firm*—Robert A. Felsman

[57] ABSTRACT

An inflatable packer system for use in a well testing or treating tool which is attached to a drill string. The inflatable packer system comprises a pump subassembly operated by rotation of the drill string, a check/relief valve subassembly, valve subassembly, packer deflate subassembly, at least one inflatable packer, at least one flow subassembly, at least one recorder subassembly, and a drag spring unit. The packer system may also incorporate a straddle by-pass extension assembly for additional spacing between packers in a two packer straddle test. The inflatable packer system is used to isolate any desired zone or zones in a well bore so that multiple tests involving inflation and deflation of the packer(s) without removing the tool from the well may be performed.

63 Claims, 55 Drawing Figures

298
302
304
306
260
G
F
300
305
250
288
290
256
252
258
270
282
268
278
280
104
266
274
276
242
293
264
194
254
284
286
294
296
320
321
319
323
318
308
310
312
307
314
316

536
540
552
506
508
504
526
501
528
516
502
522
520
512
486
464
482
468
488
466
464

526
518
516
501
502
528
522
520
512
510
506
504
508
514
464
486

458
428
452
449
442
430
454
444
450
432
436
420

486
526
484
530
532
468
490
482
488
478
494
492
464
428
480
474
458

554
552
546
524
504
550
540
508
506
526
522
520
512
528
501
502

INFLATABLE PACKER SYSTEM

RELATED APPLICATIONS

U.S. patent application Ser. No. 124,664, filed Feb. 26, 1980, Valve Retrieval Mechanism for an Inflatable Packer System by Phillip A. Mandersheid;

U.S. patent application Ser. No. 121,960, filed Feb. 15, 1980, Packer Deflate Subassembly for an Inflatable Packer System by Randy S. Baker, et al.;

U.S. patent application Ser. No. 120,585, filed Feb. 11, 1980, Check/Relief Valve for an Inflatable Packer System by Randy S. Baker, et al.;

U.S. patent application Ser. No. 120,180, filed Feb. 11, 1980, Valve for an Inflatable Packer System by Felix Kuus, et al.; and U.S. patent application Ser. No. 124,401, filed Feb. 25, 1980, Swivel Assembly for an Inflatable Packer System by Randy S. Baker, et al.,

BACKGROUND OF THE INVENTION

1. Field of the Invention

The present invention relates to an inflatable packer system used in a drill stem or formation testing tool. The testing tool is used to evaluate the producing potential or productivity of an oil or gas bearing zone prior to completing a well.

As drilling of a borehole proceeds, there may be indications, such as those obtained from studying the core, which suggest the desirability of testing a certain formation or formations for producing potential.

For the test, a testing tool is attached to the drill string and lowered into the uncased well bore to a zone to be tested. A packer or packers is/are used to isolate the zone to be tested. If the zone is close to the bottom of the well, a single packer may be used. If the zone to be tested is a considerable distance off the bottom, or if there are multiple zones, the zone can be straddled by two packers.

It is advantageous to have a tool that can be set at any depth in the well so that all zones can be tested on the same trip into the well. Therefore, the packer system should be designed so that the packer or packers can be inflated and deflated repeatedly.

2. Description of the Prior Art

Various drill stem testers have been provided with inflatable packer elements for sealing off a zone in an uncased hole. Some systems for inflating the packer elements are listed as follows:

a. Drill pipe rotation actuates a piston pump which displaces fluid into the packing elements;

b. Drill pipe reciprocation actuates a piston pump which displaces fluid into the packing elements;

c. Drill pipe set-down movement moves a piston which displaces fluid into the packing elements;

d. Either drill pipe rotation or weight setdown opens a valve allowing compressed gas from a tank to move a piston to displace fluid into the packing elements; and e. A differential piston, with its larger area against annulus pressure, displaces fluid into the packing elements when a valve is opened by weight setdown.

A tool for well bore testing widely used in the industry is disclosed in U.S. Pat. No. 3,439,740 granted to George E. Conover. The Conover tool is representative of class (a) packer inflation systems (see above) wherein drill pipe rotation actuates a piston pump which displaces fluid into the packing elements.

The Conover tool has a plurality of parts which cooperate together to perform four basic operations; packer inflation by drill string rotation; flow testing by applying weight set-down on the drill string; shut-in pressure testing by upward pull on the drill string; and packer deflation by the simultaneous application of downward and rotational forces on the drill string to actuate a clutch which allows a mandrel to move downwardly which, in turn, moves a sleeve valve downwardly, thereby allowing the packers to deflate. When the packers are reset, initial rotation of the pump causes hydraulic fluid to force the sleeve valve upwardly whereupon further pumping will inflate the packers again.

Packer inflation is achieved by rotating the drill string, thus activating a cam-actuated piston pump. A drag spring at the lower end of the tool engages the bore of the well to prevent the housing of the tool from rotating with the pump cam. Drilling fluid is pumped into the packers, thereby inflating them. Seals and check valves in the pump prevent packer deflation if the pump stops pumping before weight set-down.

While the packers are inflating, the zone being isolated is vented to the well annulus above the upper packer to allow pressure buildup in the zone, due to packer inflation, to be relieved.

Flow testing is accomplished by weight set-down on the drill string, which is transmitted to the tool. A piston moves downwardly, sealing off the packers and opening a passageway from the isolated zone to the drill string. This allows flow from the isolated zone to the surface.

A shut-in pressure test is done by applying an upward pull to the drill string, moving the piston upwardly and thus closing the path to the surface. The zone then is put in communication with the well annulus above upper packer through a check valve.

Packer deflation is accomplished by simultaneously applying a downward force and rotating to the drill string. This actuates a clutch which allows a mandrel to move downwardly, carrying a sleeve valve along with it. The sleeve valve allows connection of the packer interiors with the well bore, thereby allowing the packers to deflate.

When the tool is reset for another test and the drill stem rotated, initial pumping pumps the sleeve valve upwardly along the mandrel until it resumes its original position. Further pumping then inflates the packers again.

However, the Conover tool has various shortcomings, one of which is the lack of a straight line concentric flow path through the tool without deviations or restrictions. Therefore, there is no possibility of running special tools into the packer section after they are set.

Also, the tool is mechanically complex due to the functional cooperation required for flow and shut-in testing as well as inflation and deflation of the packers. The manner in which deflation of the packers is accomplished requires a complicated clutch and valving arrangement. It also requires a simultaneous application of weight and rotation to the drill string.

Additionally, there is no provision in the Conover tool for deflating the packers in case of a deflation system malfunction. Therefore, if the packers are set and cannot be deflated, the entire tool must remain in the well until removed by some means, not disclosed.

Further, the check and relief valves to prevent packer deflation on loss of pressure in the pump and over inflation of the packers respectively, are integral with the pump. This necessarily means that the valves are small and susceptible to early failure due to the abrasive qualities of the drilling fluid being used to inflate the packers.

In addition, the drag springs on the bow spring section of the Conover tool are pushed into and out of the well. This feature subjects the springs to buckling and breaking.

Other drag springs are shown in the prior art which are intended to be pulled, whether running in or out of a well. One example is represented by U.S. Pat. Nos. 4,042,022 and 4,077,470 to Wills, et al., and Dane, respectively. Both patents relate to drag spring assemblies wherein bow springs are fixed at either end to collars which are free to move longitudinally on a casing. Longitudinal movement of the collars is limited by a single stop collar fixed to the casing between the collars.

Another type of drag spring is set forth in U.S. Pat. No. 2,248,160 to Crawford. The centering unit of the patent uses bow springs, the top and bottom ends of which are retained by collars which are fixed against longitudinal movement. The collars are longitudinally slotted and the top and bottom ends of individual bow springs may move independently in their respective slots. The longitudinal movement of an individual bow spring end is limited. Whether the bow springs are pulled when running in or pulling out would depend on the hole diameter.

An additional type is shown in U.S. Pat. No. 3,200,884 to Solum, et al. There, the centralizer uses bow springs which are connected, at either end, to end collars. The end collars are, in turn, slidably attached to stop collars which are fixed to the casing. There is a limited amount of movement between a respective end collar and stop collar.

SUMMARY OF THE INVENTION

The present invention comprises an inflatable packer system intended for use in a well testing or treating tool which is attached to a drill string. The tool is lowered into an uncased well and the packer system is used to isolate a zone in the well.

The presently preferred embodiment of the inflatable packer system may include a rotary pump subassembly, a check/relief valve subassembly, packer deflate subassembly, at least one inflatable packer element, at least one flow subassembly to allow fluid from the isolated zone to flow into the hollow interior of the tool, at least one recorder subassembly for housing a recorder for recording the phenomena occurring in the isolated zone during flow and shut-in testing, a straddle by-pass extension, if needed, in case a zone is being straddled by two packers and additional spacing between packers is required, and a drag spring unit which engages the well wall and prevents the system from turning as the drill string is rotated during pumping.

The rotary pump is actuated by rotating the drill string clockwise to pump drilling mud to the packer(s). A check/relief valve is provided separate from the pump to guard against packer deflation, in case of a loss of pump pressure, and over-inflation and rupture of the packer(s), respectively. The valve subassembly incorporates a shifting sleeve which is pumped down or open upon initial operation of the pump. Pumping down the shifting sleeve opens a passageway between the pump outlet and the packer(s) to allow inflation thereof.

For the purposes of the following discussion, the term "isolated zone" shall mean the zone to be tested, i.e., between two packers or between a single packer and the bottom of the well. The term "well annulus" shall mean that portion of the well outside, and usually above, the isolated zone, and about the tool and the drill string.

When the packer system is inflated, weight is setdown on the drill string to collapse the inner portion of the valve with respect to the outer portion of the valve. Initial movement of the inner portion of the valve isolates and seals off the inflated packer(s). Further movement vents the isolated zone to the well annulus and vents inflation fluid from the pump to the well annulus. Finally, the vent to the annulus from the isolated zone is closed and the well is ready for flow and shut-in testing.

Packer deflation is accomplished by lifting the drill string to stretch the valve to its original elongated position. Initial lifting of the inner portion of the valve opens the vent to the annulus from the isolated zone to equalize the pressure in the zone with that in the well annulus to prevent damage to the packer(s). Further lifting causes the shifting sleeve to be picked up or retrieved and opens a passageway to the well annulus from the interior of the packer(s) for deflation thereof.

The packer deflate subassembly is incorporated into the inflatable packer system as a fail safe in case of a possible deflating malfunction in the valve subassembly.

The entire tool, of which the inflatable packer system is a portion, would include an hydraulic main valve for controlling the on-off for the flow and shut-in testing in the isolated zone. The hydraulic main valve is used to control the flow and shut-in testing of the zone undergoing test.

DESCRIPTION OF THE PREFERRED EMBODIMENT

Figure 1A:
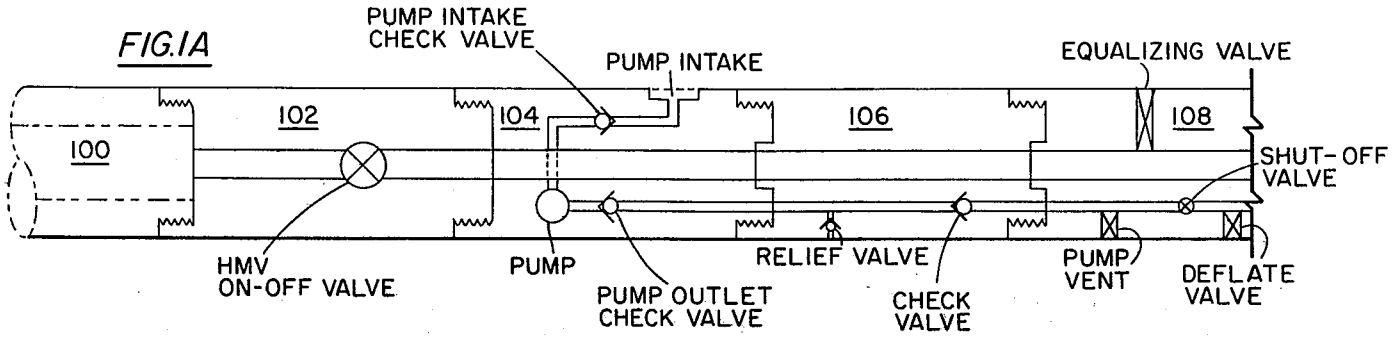
FIGS. 1A–1C comprise a simplified schematic diagram of the inflatable packer system coupled to a hydraulic main valve and drill string.
Figure 1C:
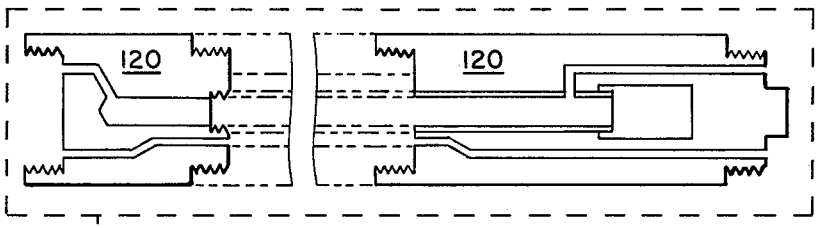
Figure 1C:
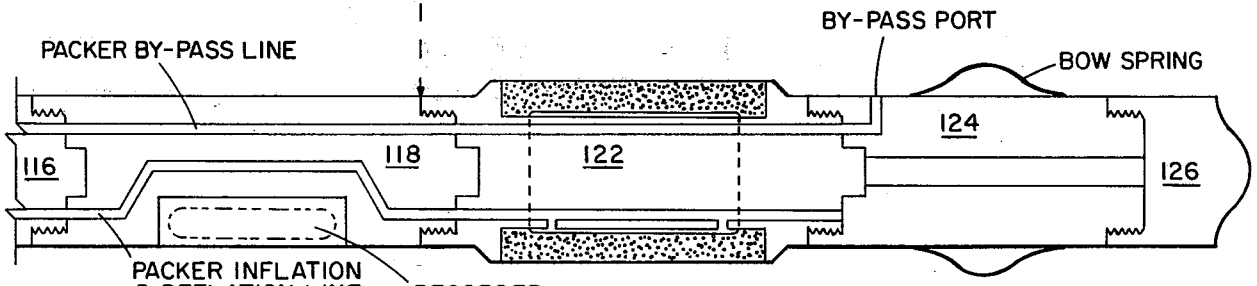
Figure 1B:
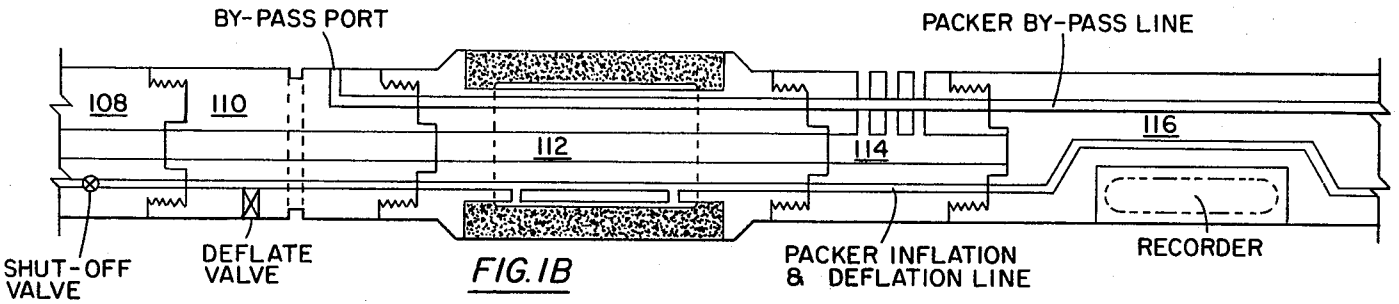

A preferred embodiment of a complete well testing tool is shown schematically in FIGS. 1A–1C. For the purposes of discussion, left in the drawings will be considered up and right, down, as though the tool were in place in a well bore. The tool is shown attached to a section of drill string 100 which is suspended from equipment at the surface of the well.

The drill string 100 may be attached to the upper end of an hydraulic main valve 102 which is essentially an on-off valve for controlling flow and shut-in testing of the well zone of interest. The on-off is actuated by up-down movement of the drill string in such a way that weight remains on the tool below the hydraulic main valve.

Next in line may be a pump subassembly 104 which includes a rotary swashplate pump, a pump intake which allows drilling mud to enter the pump, and a pump intake check valve and an outlet check valve in each of the pump piston inlets and outlets, respectively.

Below the pump subassembly 104 may be a check-/relief valve subassembly 106. The check valve in the subassembly prevents downline packer deflation in case of a loss of pressure in the pump once the packer inflation cycle begins. The relief valve prevents overinflation of the packer(s) by opening when a predetermined pressure differential between inflation pressure and well annulus pressure is reached.

Connected to the check/relief valve subassembly 106 may be a valve subassembly 108 which incorporates a pump vent for venting pump inflation fluid to the well annulus after weight has been set down and the packer(s) sealed off by the shut-off valves. Also included is an equalizing valve which is opened after initial weight set-down to vent any pressure buildup in the test zone caused by the plunger effect of collapsing the hydraulic main valve 102 and valve subassembly 108 to the well annulus above the packer(s).

Valve assembly 108 may be connected, in turn, to packer deflate subassembly 110 (FIG. 1B) which includes a by-pass port and a deflate vent which can be opened in case the deflate valving in the valve subassembly fails to function. Opening of the deflate valve in the packer deflate subassembly is accomplished by pulling up on the drill string against the inflated packer(s) until a relieved portion shears in the packer deflate subassembly. This allows relative movement in the packer deflate subassembly, thereby opening the deflate vent.

Next in line may be a packer 112 and at least one flow subassembly 114. In the case of a zone close to the bottom of a well, only one packer might be needed. However, if the zone is some distance from the bottom of the well or if there are multiple zones, two packers can be used to straddle the zone of interest. Flow subassembly 114 allows fluid from the zone to flow into the interior of the tool. There might be more than one flow subassembly also, if needed.

Recorders 116 and 118 (FIG. 1C) may follow flow subassembly 114 and each may contain a recorder for recording phenomena in the zone during flow and shut-in. Two recorder subassemblies are preferred in order to preclude having to pull the tool out of the well in case the malfunction of a single recorder.

Connected to the bottom of recorder subassembly 118 may be a straddle by-pass extension assembly 120, if desired. This assembly provides for proper spacing between two packers so that the zone of interest will be completely straddled. If the zone is short enough, the straddle bypass extension assembly 120 would not have to be used.

Lower packer 122, in the case of a two packer straddle test, may be connected between the straddle by-pass extension assembly 120 and drag spring unit 124 which terminates in bull nose 126. Drag spring unit 124 may incorporate bow springs which engage the well wall to 31 prevent rotation of the entire tool when the drill string is rotated to actuate the pump in pump subassembly 104. A unique feature of the drag spring unit 124 is that the bow springs are always being pulled, whether running into or out of the well.

The bypass ports in the deflate subassembly 110 and drag spring unit 124 and interconnecting packer bypass line prevent a pressure differential buildup across the packers 112 and 122 during and after their inflation.

Pump Assembly 104

The pump assembly 104 will be described in detail first, with the hydraulic main valve 102 last, in that the hydraulic main valve is not considered part of the inflatable packer system per se, but rather, as part of the overall testing tool. The hydraulic main valve is an on/off valve which is used once the inflatable packer system is set, i.e., the packer(s) inflated.

The pump assembly 104 is shown in detail in partial cross-section in FIGS. 2A–2E and preferably comprises a hollow drive coupling 130 internally threaded as at 132 at the upper end thereof. The drive coupling 130 is threaded to the bottom portion of the hydraulic main valve 102 when a well testing tool is made up.

The outer diameter of the drive coupling 130 is reduced partway along its length to provide a reduced portion 134 and shoulder 136. The long leg of an L-shaped upper bearing 138 surrounds a portion of the reduced portion 134 and the short leg of L-shaped bearing 138 bears against shoulder 136. The long leg of bearing 138 is also externally threaded as at 140.

A cylindrical floating piston housing 142 having an inner diameter greater than the outer diameter of the reduced portion 134 of drive coupling 130 is internally threaded as at 144 at the upper end thereof. Floating piston housing 142 is connected to upper bearing 138 by means of external threads 140 on upper bearing 138 engaging internal threads 144 on floating piston 142.

The difference between the internal diameter of floating piston housing 142 and the outer diameter of reduced portion 134 provides a volume 146 which may be partially occupied by a floating piston 148. Communication from the volume 146 to the exterior of the assembly is provided by a vent 150 located near the upper end of volume 146. O-rings 152 and 154 carried by floating piston 148 bear against the inner diameter of floating piston housing 142 to provide a seal therebetween. O-ring 156 carried by floating piston 148 bears against the outer diameter of reduced portion 134 to also provide a seal therebetween.

The outer diameter of floating piston housing 142 may be reduced in diameter to provide a shoulder 158 and also externally threaded as at 160 approximately midway along its length.

A hollow clutch body 162 may surround floating piston housing 142 and the upper end thereof may abut shoulder 158. The clutch body 162 is preferably, internally threaded as at 164 to threadedly engage external threads 160 on the floating piston housing 142. An internally unthreaded upper portion of clutch body 162 overlies an unthreaded section of the reduced portion of floating piston housing 142 and an O-ring 166 carried by floating piston housing 142 may provide a seal therebetween.

The external diameter of drive coupling 130 may be further reduced to provide an unthreaded section 168 and threaded section 170. A drive bearing 172, e.g., Torrington NTHA 4066, may surround the unthreaded section 168 between the drive coupling 130 and clutch body 162. An internally threaded locking nut 174 may engage threaded section 170 to hold drive bearing 172 in place. A locking plate 176 is preferably secured to the lower end of locking nut 174 by means of six screws, one of which is shown at 178. The locking plate 176 may engage a recess 180 in the external diameter of drive coupling 130 to prevent disengagement of the locking nut from drive coupling 130.

A one-way clutch 182, e.g., Borg-Warner 139130, has an outer clutch sleeve 184 fixed against rotation with respect to clutch body 162 by means of a key 186. An inner clutch sleeve 188 is fixed against rotation with respect to drive coupling 130 by means of another key 190.

The lower end of drive coupling 130 may be internally threaded as at 192 to threadedly engage the externally threaded upper end of hollow shaft 194. A conventional O-ring (not labeled) carried by shaft 194 below the externally threaded upper end may provide a seal between the shaft 194 and drive coupling 130.

Keyed to the shaft 194, below the O-ring, by means such as a Woodruff key 200 may be a plain thrust bearing 202. Bearing 202 is preferably held in position between the lower end of drive coupling 130 and an externally protruding collar 204 on shaft 194.

A rod-end ball joint 206, e.g., Baker SPF-4 may be pinned to plain thrust bearing 202 by means of a dowel pin 208. The lower end of rod end ball joint 206 may be internally threaded as at 210 and connected to a drive rod 212 having an externally threaded reduced upper end. A lock nut 214 threaded on the upper end of drive rod 212 prevents disengagement of the rod end ball joint 206 and drive rod 212.

The lower end of drive rod 212 may be connected to a wobble plate 216 by means of a dowel pin 218. The external diameter of the wobble plate 216 is reduced as at 220 providing a downwardly facing shoulder at 222. An L-shaped thrust bearing collar 224, having its short leg bearing against reduced portion 222 of wobble plate 216, may be held in position by means of a race retainer 226 which, in turn, may be fixed to the lower end of wobble plate 216 by means of four button screws, two of which are indicated at 228.

A thrust bearing 230 may be carried by the short leg of L-shaped thrust bearing collar 224 and sandwiched between a thrust race 232, e.g., Torrington TRA 4458 and a thrust bearing race 234. The upper end of thrust bearing race 234 bears against shoulder 222 and the lower face of thrust race 232 bears against the upper face of the long leg of L-shaped thrust bearing collar 224.

The lower end of clutch body 162 preferably terminates in an 28 internally threaded portion 236 and below that, an unthreaded portion 238. The threaded portion 236 may engage externally threaded upper end 240 of a cylinder 31 block 242 while unthreaded portion 238 overlies an unthreaded external upper length 244 on cylinder block 242. A conventional O-ring carried by cylinder block 242 may be used to provide a seal between unthreaded portions 238 and 244 on clutch body 162 and cylinder block 242 respectively.

Cylinder block 242 is preferably bored to provide eight cavities, two of which are indicated at 248. Cylinder liners 250 (FIG. 2C) are placed in the lower half of each of the cavities 248 and are held in place by cylinder block plugs 252 which are threaded into the cylinder block wall. The plugs 252 extend through the cylinder block wall and engage a slot 254 milled in the outer surface of each of the cylinder liners 250. The portion of the plug 252 extending through the cylinder block wall is grooved to accommodate an O-ring 256 which provides a seal between the plug 252 and the hole through the cylinder block wall.

Each of the cylinder liners 250 is designed to provide a cylinder 258 and fluid passageway 260 in the upper and lower ends thereof, respectively.

Figure 2G:
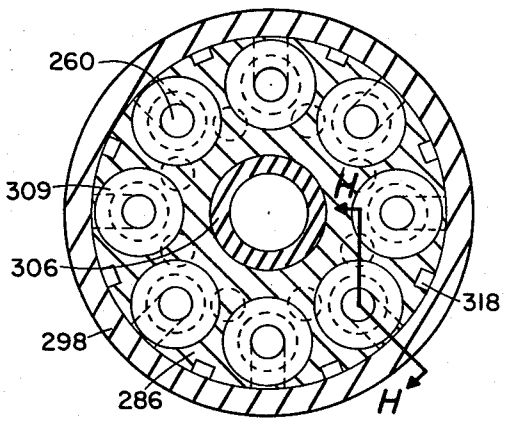
FIG. 2G is a cross section-taken at G—G in FIG. 2C looking downwardly in the pump assembly.
Figure 2F:
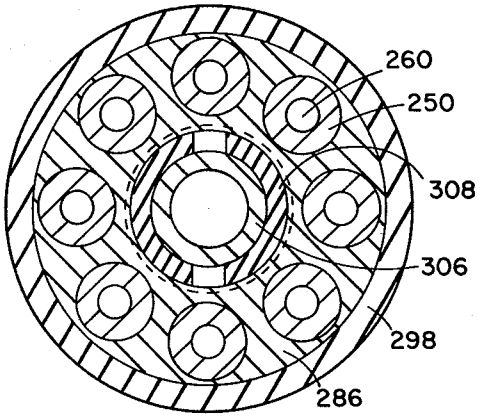
FIG. 2F is a cross-section taken at F—F in FIG. 2C looking upwardly in the pump assembly.
Figure 2A:
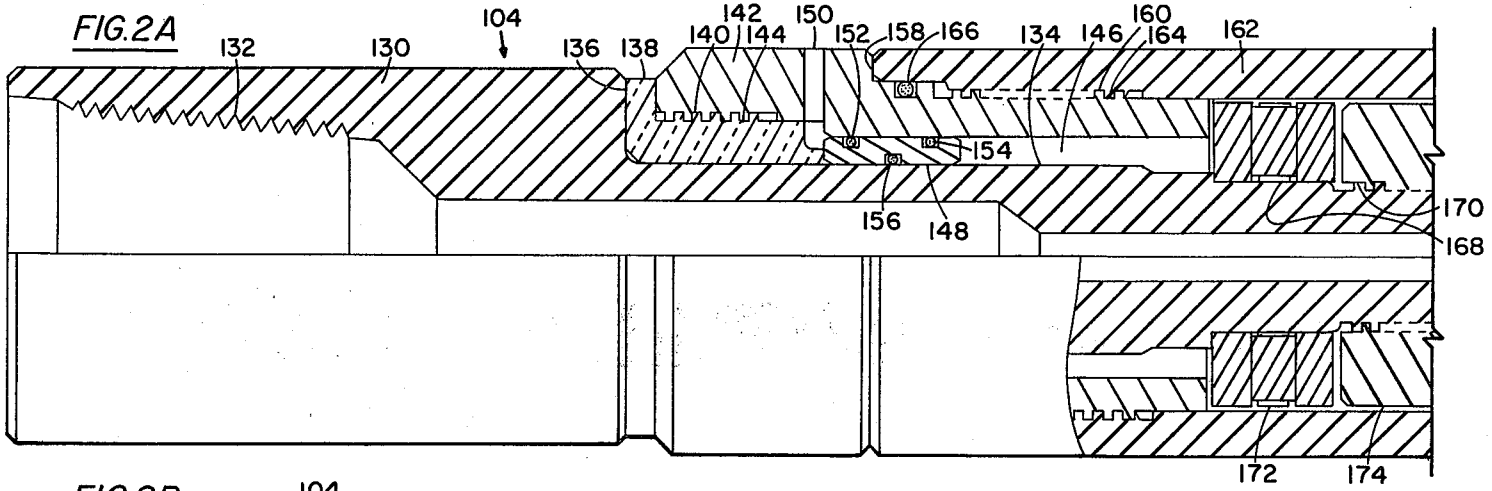
FIGS. 2A–2E illustrate the pump assembly in detail in partial cross-section.
Figure 2B:
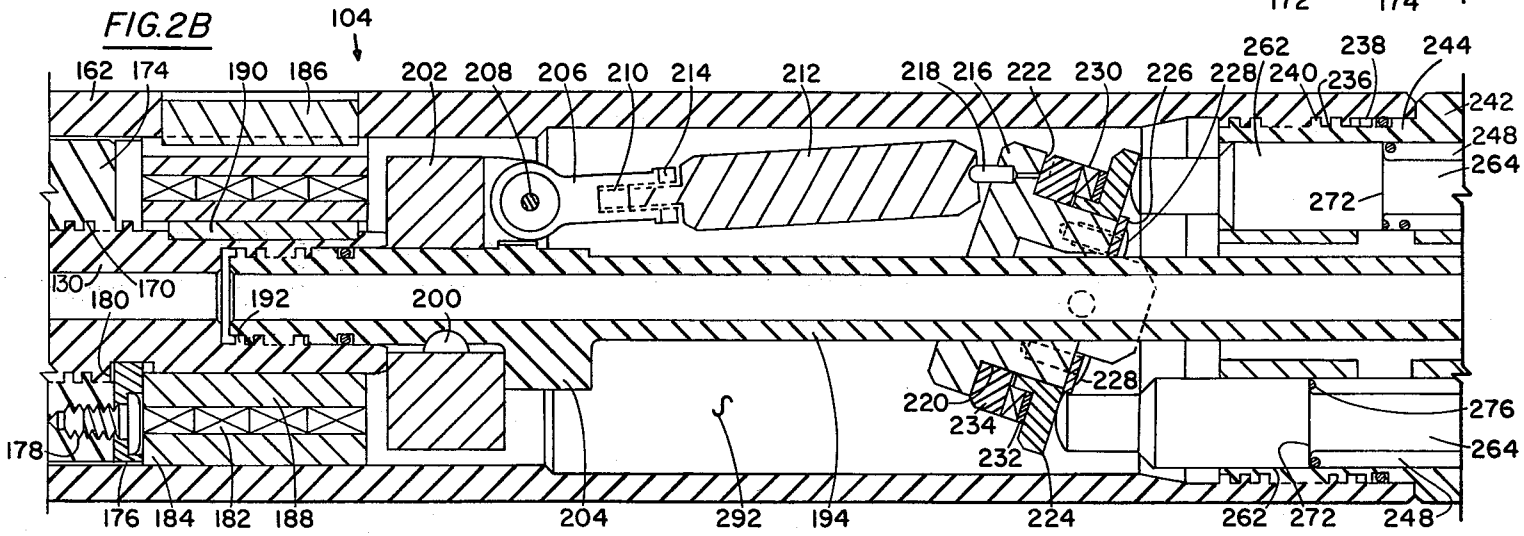
Figures 2C, 2D:
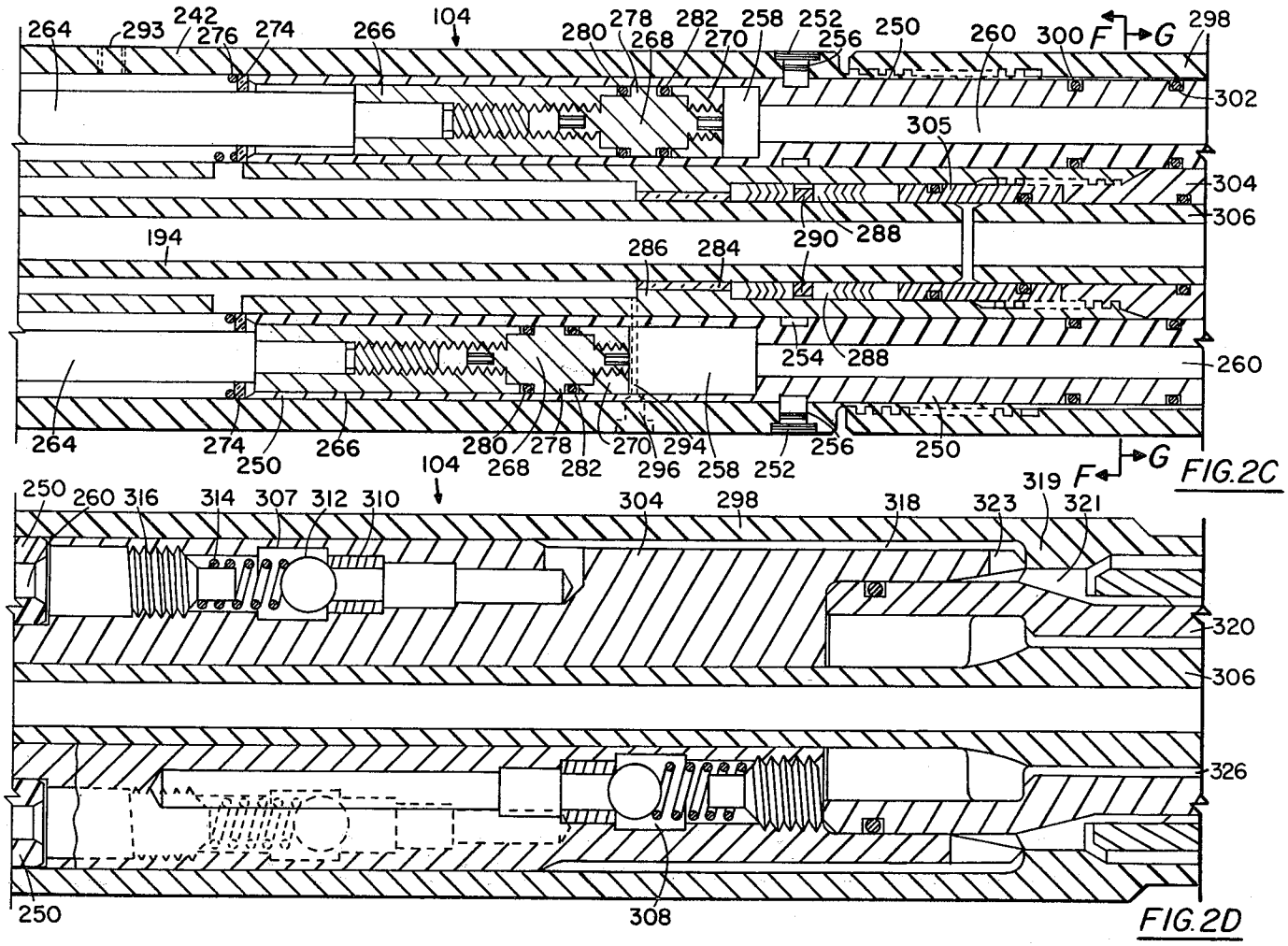
Figure 2E:
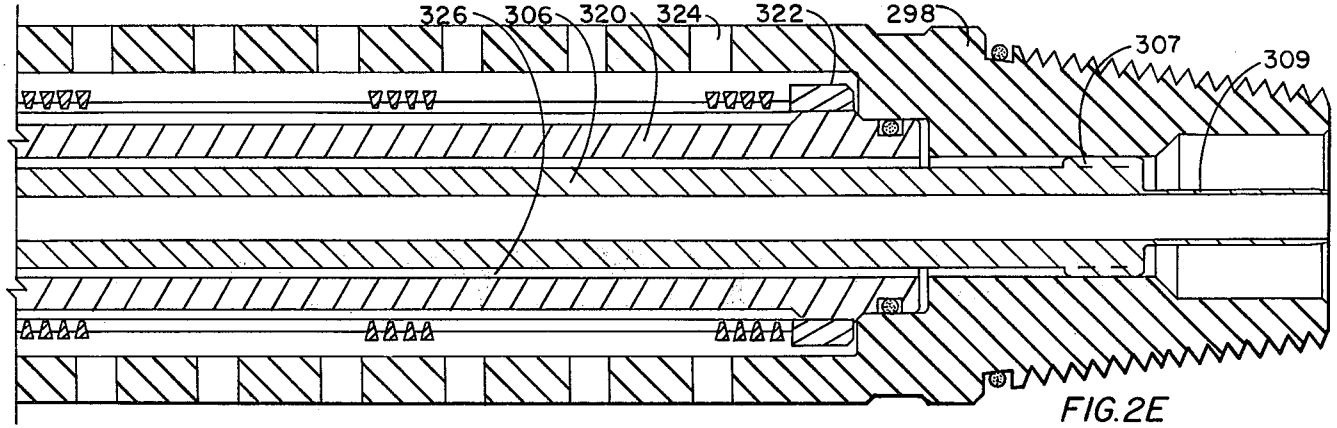

A piston assembly is provided in each of the cavities 248 and may comprise a crosshead 262 (FIG. 2B), connecting rod 264, upper piston body 266 (FIG. 2C), middle piston body 268, and piston cap 270 (FIG. 2C). The upper end of crosshead 262 engages the lower face of the thrust bearing collar 224 and is driven downwardly thereby. Connecting rod 264 has a lesser diameter than crosshead 262 so that a shoulder 272 is formed at the juncture thereof.

A bronze washer 274 may be positioned against the upper end of each cylinder liner 250. A piston return spring 276 may surround each connecting rod 264 and the ends thereof bear against the washer 274 and shoulder 272 so that each of the piston assemblies will be returned upwardly after being driven downwardly by the wobble plate 216.

Upper piston body 266 may be hollow and internally threaded so that it may be screwed onto the externally threaded lower end of connecting rod 264. Middle piston body 268 may be externally threaded at the upper and lower ends thereof and the upper end screwed into the lower end of upper piston body 266. The middle piston body 268 is preferably shaped to provide a radially extending collar 278 which bears against the internal diameter of the cylinder liner 250. Finally, piston cap 270 is internally threaded so that it may be screwed onto the lower end of middle piston body 268.

When assembled, an O-ring 280 is placed between the bottom end of upper piston body 266 and collar 278 and a Polypak seal 282, for example, is placed between collar 278 and the upper end of piston end cap 270.

The lower end of shaft 194 (FIG. 2C) may be supported in a bearing sleeve 284 which, in turn, may be supported by a collar 286 on the internal diameter of cylinder block 242. Below the bearing sleeve 284 and providing a seal between the shaft 194 and the cylinder block 242 may be a set of V-packing 288 separated by a packing spacer 290.

Pump lubrication may be provided by means of motor lubricating oil in crankcase 292 (FIG. 2B) which fills the interior of the pump from the bearing sleeve 284 (FIG. 2C) to the floating piston 148 (FIG. 2A). The motor oil can be poured into the pump crankcase 292 through filler holes 293. Air may be bled off through vent 294 which may be capped by a Bowen plug 296 using a conventional O-ring seal.

A bottom sub 298, having an internally threaded upper end, may be screwed onto the externally threaded lower end of cylinder block 242. A portion of the bottom sub 298 overlies each cylinder liner 250. O-ring seals 300 and 302 surround the lower end of each cylinder liner 250 to provide a seal between each cylinder liner 250 and cylinder block 242 and bottom sub 298, respectively.

A cross-section taken at F—F in FIG. 2C looking upwardly is shown in FIG. 2F while a cross-section taken at the same location looking downwardly is shown in FIG. 2G. The cross-sections show the arrangement of the cylinders in greater detail.

A hollow valve block 304 having an externally threaded upper end may be positioned within the upper end of bottom sub 298 and threads onto the internally threaded lower end of cylinder block 242. Running through the central passageway of the valve block 304 is a cylindrical bottom stinger 306 which may extend to the bottom end of the bottom sub 298. The stinger 306 may be centered within bottom sub 298 at the lower end thereof by means of a spider 307 on the external diameter of the stinger 306. The spider 307 is preferably grooved to provide for inflation fluid flow. The external diameter of stinger 306 is reduced as at 309 to fit within the next lower module in the test spring.

A packing nut 305 may be screwed onto the internally threaded lower end of cylinder block 242 to hold V-packing 288 in position. The packing nut 305 spans the lower end of shaft 194 and the upper end of bottom stinger 306. Conventional O-ring seals carried by the packing nut 305 may be used to provide a seal between packing nut 305 and the upper end of bottom stinger 306. Another conventional O-ring seal may be employed between bottom stinger 306 and valve block 304.

Figure 2H:
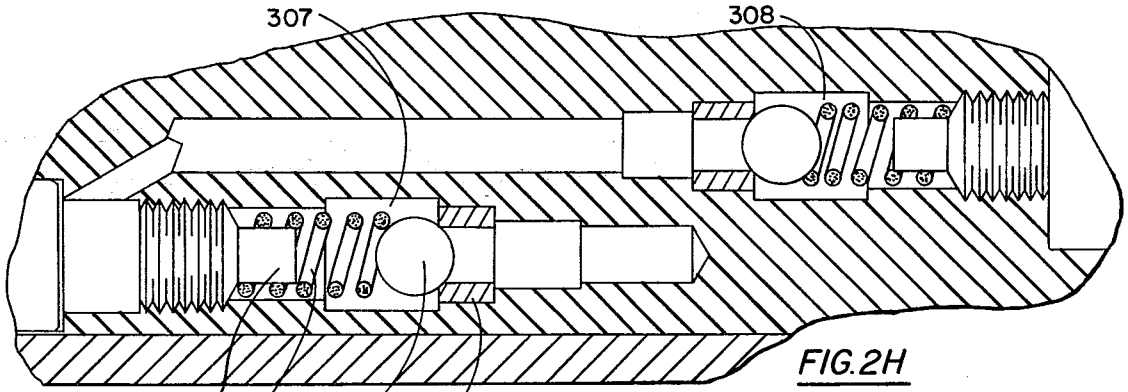
FIG. 2H is an enlarged view of valves 307 and 308 in FIG. 2D.

Valve block 304 is preferably chambered to receive eight inlet check valves and eight outlet check valves (FIG. 2D), one each of which is generally indicated at 307 and 308, respectively. Each check valve comprises a valve seat 310, ball 312, check valve spring 314, and valve stem 316. The arrangement of adjacent inlet and outlet check valves is shown in greater detail in FIG. 2H which is a cross-section taken at H—H in FIG. 2G.

The outer diameter of the lower half of the valve block 304 may be reduced to provide an inlet passageway 318 between the valve block 304 and the inner diameter of bottom sub 298. The lower end of valve block 304 is bored out to provide an enlarged portion which receives the upper end of a screen holder 320. A conventional O-ring (FIG. 2D) carried by the screen holder 230 may provide a seal between valve block 304 and screen holder 320. The bottom end of screen holder 320 (FIG. 2E) fits within bottom sub 298 and a conventional O-ring carried by the screen holder 320 may provide a seal therebetween.

The bottom end of valve block 304 preferably bears against an inwardly projecting collar 319 on bottom sub 298 which is relieved as at 321 to provide for fluid flow. The bottom end of valve block 304 may also be ported as at 323 to allow input fluid flow.

Bottom sub 298 and screen holder 320 may be configured so that there is a space therebetween and a screen 322, carried by screen holder 320, may fit into the space.

Bottom sub 298 may be perforated as at 324 so that drilling mud from the well annulus can be used by the pump as the inflation fluid for the packer elements.

The space between the inner diameter of screen holder 320 and the outer diameter of bottom stinger 306 provides an outlet passageway 326 from the pump for the packer inflation fluid.

Pump Operation

In this preferred embodiment, pump 104 is readied for operation by upending it and filling crankcase 292 through filler holes 293. During filling, vent 294 is unplugged to allow air to bleed off. Upon filling, the filler holes are plugged and the plug 296 installed to cap the air vent 294. Floating piston 148, one face of which is in fluid communication with the well annulus and the other face of which is in fluid contact with oil in the crankcase 292, maintains the oil under hydrostatic pressure. As oil is depleted, piston 148 moves downwardly within volume 146 to maintain the pressure. Therefore, there is no pressure differential between the interior of the pump and the well annulus.

The tool shown in FIGS. 1A–1C is then made up and lowered into a well bore. The drag springs on drag spring unit 124 engage the well wall to prevent rotation of the tool.

Right-hand rotation of the drill string causes rotation of drive coupling 130 and shaft 194 with respect to floating piston housing 142, clutch body 162, cylinder block 242, and bottom sub 298, through one-way clutch 182.

Plain thrust bearing 202 is keyed to shaft 194 by means of key 200 and rotates therewith. The wobble plate 216 rotates with the plain thrust bearing 202 due to the connection therewith through dowel pin 208, rod and ball joint 206, drive rod 212, and dowel pin 218. Wobble plate 216 carries thrust bearing 230, the lower face of which bears against the upper end of the eight crossheads 262. As the wobble plate 216 rotates about the axis of the pump, each of the crossheads in turn will be driven downwardly and returned upwardly by individual springs 276.

The piston assemblies, comprising upper piston body 266, middle piston body 268, and piston cap 270, move up and down with the crossheads 262 due to the connection therewith through connecting rods 264. As a piston assembly is returned upwardly by a spring 276, well drilling mud enters a cylinder 258 through ports 324 in bottom sub 298, screen 322, a fluid passage comprising 318, 321, 323, and inlet check valve 307. The pressure differential between the well annulus and cylinder 258 will unseat spring loaded ball 312 from valve seat 310 until the related piston assembly reaches the top of its stroke.

As the piston assembly moves downwardly, the inlet check valve closes and the outlet check valve 308 associated therewith opens due to the pressure differential between cylinder 258 and a packer element such as 112 or 122 in FIG. 1B or 1C, respectively.

The pump will continue to move inflation fluid through passageway 326 until a predetermined pressure differential is reached between the well annulus and packer inflation pressure. At this time, the relief valve in the relief/check valve 106 of FIG. 1A will vent inflation fluid to the well annulus.

Check/Relief Valve 106

Figure 3A:
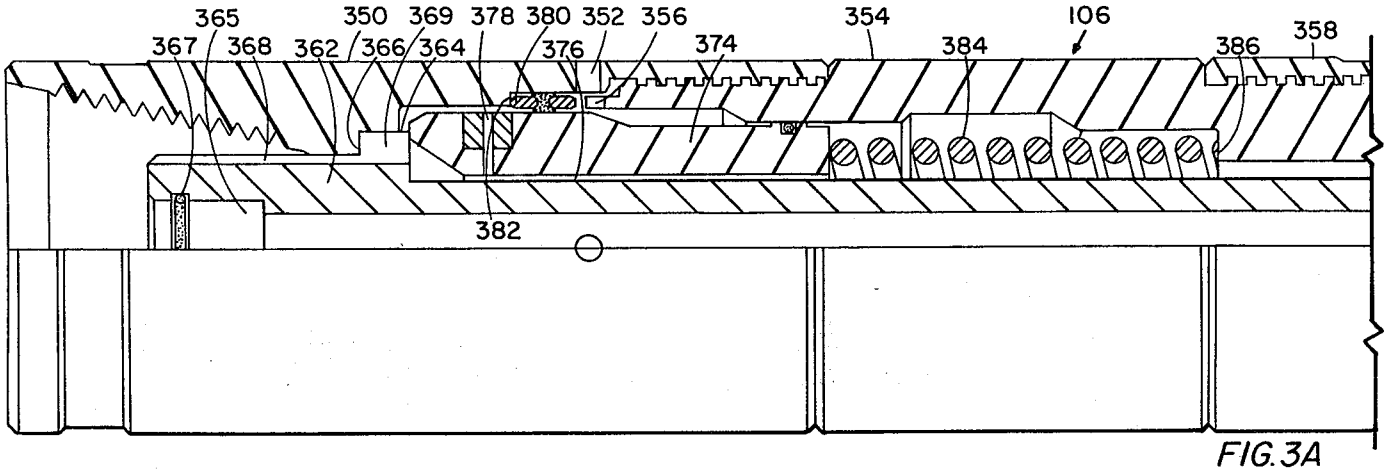
FIGS. 3A and 3B illustrate the check/relief valve in detail in partial cross-section.
Figure 3B:
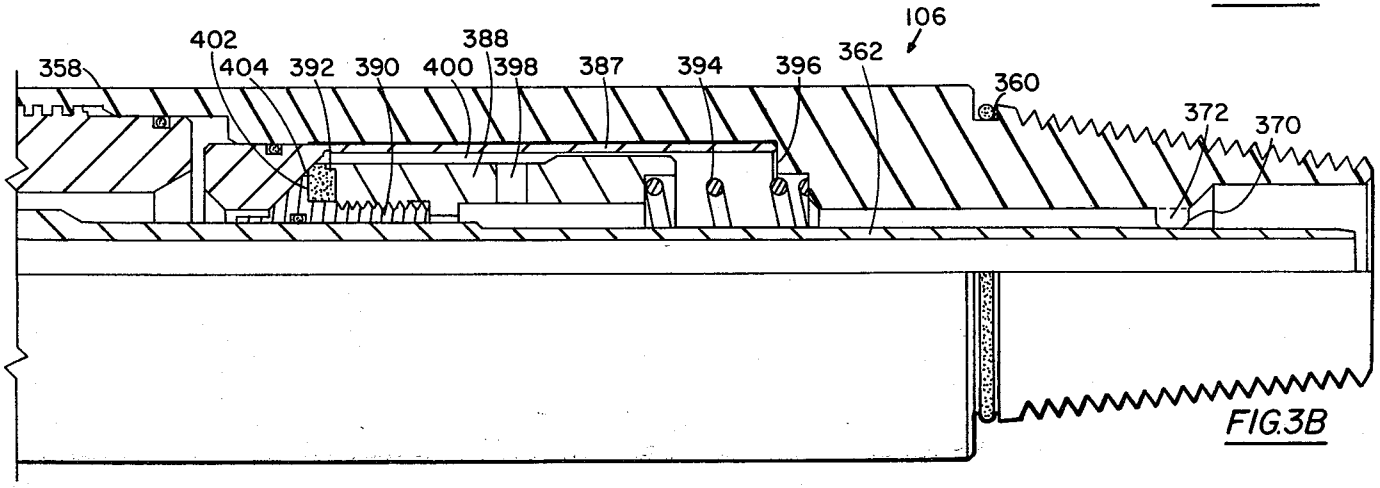

A presently preferred embodiment for a check/relief valve 106 is shown in partial cross-section, in FIGS. 3A and 3B.

A cylindrical top sub 350, internally threaded at the upper end thereof, has a relief vent 352 through the wall near the bottom end thereof. The top sub 350 is internally threaded at the lower end and a cylindrical middle sub 354, externally threaded at the upper end thereof, is attached thereto. The uppermost end of the middle sub 354 underlies the relief vent 352 and is relieved as at 356 in that area.

The lower end of middle sub 354 is externally threaded and the upper internally threaded end of check valve body 358 may be attached thereto. The lower end of the check valve body 358 may be tapered and externally threaded and thus adapted to fit into the next lower module, valve 108, when the testing tool is made up. A conventional O-ring may surround the lower end of the check valve body 358 at the juncture of the threaded portion and the main body, as at 360, to provide a seal between the check valve body 358 and the valve 108 when the testing tool is used.

A cylindrical stinger 362 may be positioned internally of and extend nearly the length of top sub 350, entirely through middle sub 354, and nearly the length of check valve body 358. The stinger 362 may be centered within the top sub 350 by means such as a radially extending collar 364, the upper face of which bears against a shoulder 366 formed on the internal diameter of top sub 350.

The upper end of the stinger 362 and collar 364 are channeled as at 368 and 369, respectively, to provide for inflation fluid flow. The interior of the upper end of stinger 362 may be enlarged as at 365 and a conventional O-ring carried in groove 367.

The lower end of stinger 362 may be centered within check valve body 358 by means such as a spider 370 on the internal diameter of the check valve body 358. The spider 370 may be grooved, as at 372, to also allow flow of inflation fluid.

A cylindrical relief valve piston 374 is preferably positioned between top sub 350 and stinger 362. The upper end of the relief valve piston 374 bears against the lower face of collar 364 on stinger 362. The relief valve piston 374 is internally grooved as at 376 to provide a fluid passageway between the external diameter of stinger 362 and the relief valve piston 374. A relief port 378 extends through the wall of relief valve piston 374 in fluid communication with grooved portion 376. The lower end of piston 374 preferably underlies the upper end of middle sub 354 and a conventional O-ring carried by the relief valve piston 374 may provide a seal therebetween.

A valve seal 380 may extend around the circumference of relief valve piston 374 between relief vent 352 and relief port 378. The valve seal 380 is held in position between the upper end of middle sub 354 and a downwardly facing shoulder 382 on the internal diameter of top sub 350.

The upper end of relief valve piston 374 may be held against the lower face of shoulder 366 by means such as a relief valve spring 384 which surrounds stinger 362. The upper end of relief valve spring 384 may abut the lower end of relief valve piston 374, while the lower end of the spring 384 may abut an upwardly facing internal shoulder 386 on middle sub 354.

A check valve assembly, preferably comprising a check valve seat 387, check valve poppet 388, check valve nut 390, check valve seal 392, and check valve spring 394, may be positioned internally of check valve body 358 and around stinger 362. The outer diameter of the upper end of check valve seat 387 bears against the inner diameter of check valve body 358 and a conventional O-ring carried by check valve seat 386 may provide a seal therebetween. The lower end of check valve seat 386 may bear against an upwardly facing shoulder 396 on the interior diameter of check valve body 358.

Check valve poppet 388 may be positioned within check valve seat 387 and be internally threaded at the upper end thereof. The wall of check valve poppet 388 may be ported, as at 398, to allow fluid flow between a space 400—formed by the radial difference between the interior diameter of check valve seat 387 and the outer diameter of check valve poppet 388—and the interior of check valve poppet 388.

The check valve nut 390 may be externally threaded near its lower end and threaded into the upper end of check valve poppet 388. The internal diameter of check valve nut 390 preferably rides on the external diameter of stinger 362 and a conventional O-ring carried by check valve nut 390 provides a seal therebetween.

Check valve seal 392 may thus be held in position between the upper end of check valve poppet 388 and a downwardly facing shoulder 402 formed on the external diameter of check valve nut 390. The upper, tapered face of check valve seal 392 thus bears against a matching, tapered face 404 on the internal diameter of check valve seat 387.

Operation of Check/Relief Valve 106

When the entire tool of this preferred embodiment is made up, bottom sub 298 of pump 104 is threaded into top sub 350 of check/relief valve 106. Reduced portion 309 of bottom stinger 306 of the pump 104 fits within the enlarged diameter 365 at the upper end of stinger 362.

Fluid passageway 326 of the pump 104 is then in fluid communication with channels 368 and 369 in check-/relief valve 106. During inflation, inflation fluid flows through a fluid passageway comprising 368, 369, 376, and the space partially occupied by relief valve spring 384 until it abuts the check valve seal 392. Due to the pressure differential across the check valve seal 392, check valve poppet 388 pops open against check valve spring 394 and the inflation fluid continues flowing through a fluid passageway comprising 400, 398, and 372.

Should inflation fluid pressure be reduced or lost above check valve seal 392, check valve spring 394 forces check valve poppet 388 upwardly, seating check valve seal 392 against sealing surface 404. Thus, deflation of partially or fully inflated packer elements would be prevented.

The relief valve portion of the check/relief valve 106 prevents packer element overinflation by venting inflation fluid to the well annulus when a predetermined pressure differential between pump pressure and well annulus pressure is reached. The force required to compress relief valve spring 384 determines the pressure differential and can be chosen dependent on a required or desired operating condition.

the fluid in one opening while venting air from space 469 through the other.

A cylindrical seal retainer 472 (FIGS. 4C and 4D), externally threaded near the upper end thereof and surrounding time-delay piston 464, may be threaded into the bottom end of time-delay cylinder 458. The upper end of seal retainer 472 may underlie a lower length of time-delay cylinder 458 and an O-ring carried by seal retainer 472 may provide a seal therebetween. Two conventional O-rings carried by seal retainer 472 near the upper end thereof may provide a seal between seal retainer 472 and time-delay piston 464.

An equalizing housing 474, externally threaded near the upper end and externally and internally threaded near the bottom end thereof, may be threaded into the lower end of time-delay cylinder 458. An O-ring carried by the equalizing housing 474 maintains a seal between time-delay cylinder 458 and equalizing housing 474.

An upwardly facing, inwardly depending shoulder 476 may be formed on the inner diameter of equalizing housing 474, about midway of its length and below radially extending relief vents, as at 478, drilled through the wall of time-delay piston 464.

Sealing between equalizing housing 474 and time-delay piston 464 just below relief vents 478 may be accomplished by a seal 480. Seal 480 is maintained in position longitudinally between the bottom end of seal retainer 472 and shoulder 476 on equalizing housing 474.

A cone and seal spacer 482, externally threaded approximately midway along its length, threads into the bottom end of the equalizing housing 474 and surrounds time-delay piston 464. Sealing between the cone and seal spacer 482 and the lower length of time delay piston 464 may be provided by a conventional O-ring carried by the cone and seal spacer 482. Another conventional O-ring carried by equalizing housing 474 may provide a seal against cone and seal spacer 482.

The bottom half of the cone and seal spacer 482 overlies openings 468 in time-delay piston 464 and a primary bump 484 on a retrieving sleeve 486. Ports, as at 488, may be drilled through the wall of the cone and seal spacer 482 in fluid communication with openings 468 in the lower length of time-delay piston 464. The lower end of the cone and seal spacer 482 is preferably tapered from the outer diameter to approximately the inner diameter thereof to provide a lifting ramp 490.

Equalizing ports, as at 492 (FIG. 4D), may be drilled through the wall of equalizing housing 474 near the lower end thereof. Sealing between the equalizing housing 474 and time-delay piston 464 below the holes 492 may be accomplished by means of a seal 494. Seal 494 is restrained longitudinally between the upper end of cone and seal spacer 482 and a downwardly facing shoulder 496 on the inner diameter of equalizing housing 474 below equalizing ports 492.

Retrieving sleeve 496 preferably surrounds the lower end of time-delay piston 464 and the upper end thereof bears against a downwardly facing shoulder 498 formed on the outer diameter of the time-delay piston 464. A radially extending secondary bump 500 also extends around the outer periphery of retrieving sleeve 486 below the primary bump 484 and spaced therefrom in the manner shown.

A cylindrical sleeve housing 501 (FIGS. 4D and 4E), internally threaded near both ends, threadedly engages the bottom end of equalizing housing 474. A conventional O-ring carried by equalizing housing 474 may provide a seal between the sleeve housing 501 and equalizing housing 474 above the common threaded portion. Deflate ports 502 may also be drilled through the wall of sleeve housing 501 approximately midway along the length thereof.

Figure 4A:
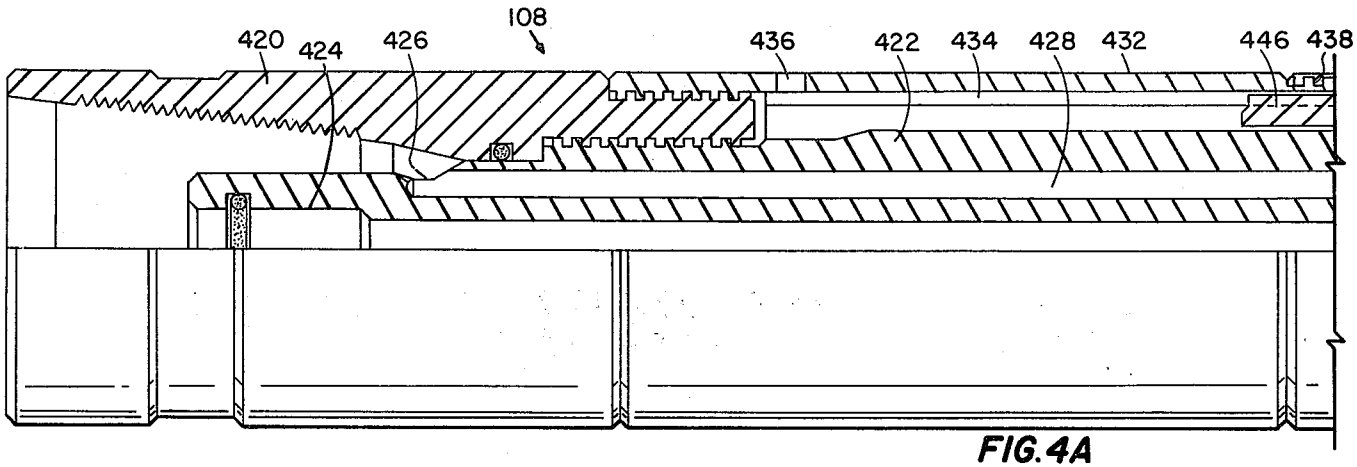
FIGS. 4A–4F illustrate the valve assembly in detail in partial cross-section.

A cylindrical lower mandrel 504 (FIGS. 4E and 4F), externally threaded near both ends, threadedly engages the externally threaded lower end of time-delay piston 464. The lowermost unthreaded length of time-delay piston 464 preferably overlies an unthreaded length of lower mandrel 504. A conventional O-ring carried by lower mandrel 504 may provide a seal between the common lengths of time-delay piston 464 and lower mandrel 504.

A cylindrical lower connector 506, internally threaded at its lower end and surrounding lower mandrel 504, threadedly engages the lower end of lower mandrel 504. The inner diameter of the lower connector 506 bears against the outer diameter of the lower mandrel 504 at the upper and lower ends. A passageway 508 is provided between the common lengths of the inner diameter of lower connector 506 and outer diameter of lower mandrel 504, for example, by reducing the outer diameter of lower mandrel 504 between the ends thereof. Conventional O-rings carried by lower mandrel 504 provide seals between the upper and lower ends of the lower mandrel 504 and lower connector 506.

Surrounding the outer periphery of lower connector at its upper end, in descending order, are a seal 510, a seal spacer 512, a connector split ring 514, and another seal 516. The outer diameter of the lower connector 506 may be reduced along the length underlying seal 510, seal spacer 512, and seal 516 and grooved to accommodate the connector split ring 514. Connector split ring 514 may protrude above the outer diameter of lower connector 506 and fit into an internally enlarged lower end of seal spacer 512.

The reduction in the outer diameter of the upper length of lower connector 506 also provides an upwardly facing shoulder 518. Seal 516 is restrained longitudinally between the lower end of seal spacer 512 and shoulder 518. Seal 510 is restrained longitudinally between the lower end of retrieving sleeve 486 and the upper end of seal spacer 512, which in turn bears against connector split ring 514.

Concentrically aligned deflate ports as at 520 and 522 in FIG. 4E, may be drilled through the walls of lower connector 506 and seal spacer 512 respectively, above connector split ring 514 and below seal 510. In addition, inflation fluid ports, as at 524 (FIG. 4F), may be drilled through the wall of lower connector 506 near the lower end thereof in fluid communication with passageway 508.

A cylindrical shifting sleeve 526 (FIG. 4E) preferably surrounds the upper length of lower connector 506 and overlies seal 510, seal spacer 512, and seal 516. The internal diameter of the shifting sleeve 526, from seal 516 downwardly, rides on the external diameter of the lower connector 506 and is adapted to move axially with respect thereto. The internal diameter of the shifting sleeve 526 may be radiused where it overlies seals 510 and 516 as shown in more detail in FIG. 4G. Other deflate ports as at 528 may be drilled through the wall of shifting sleeve 526 in line with deflate ports 502, 522, and 520 in the walls of the sleeve housing 501, seal spacer 512, and lower connector 506, respectively.

The outer diameter of shifting sleeve 526, toward its upper end, bears against the inner diameter of sleeve When pump pressure builds up beyond the predetermined pressure differential, inflation fluid acting on the upper face of relief valve piston 374 moves relief valve piston 374 downwardly. When relief port 378 passes under valve seal 380, inflation fluid is vented to the well annulus through relief vent 352.

Valve Assembly 108

A presently preferred embodiment of valve assembly 108 is shown in FIGS. 4A–4F in the elongated or stretched configuration before pump rotation is started.

In this preferred embodiment the valve assembly 108 includes a cylindrical top sub 420 which is internally threaded near the upper end and internally and externally threaded near the lower end.

The lower end of top sub 420 is threaded onto a longitudinally extending cylindrical upper connector 422 which is externally threaded near the top end thereof with an unthreaded portion extending therebeyond. A conventional O-ring carried by the top sub 420 provides a seal between the unthreaded portion of the upper connector 422 and the top sub 420. The interior diameter of the upper end of upper connector 422 is preferably enlarged as at 424 to receive the lower end of stinger 362 in the check/relief valve 106 shown in FIG. 3B. A conventional O-ring carried by the upper connector 422 may provide a seal between the upper connector 422 and the stinger 362 when the testing tool is made up.

Upper connector 422 is grooved around the exterior periphery toward the upper end as at 426. Passageways 428 running parallel to the center line in the wall of the upper connector 422 extend from the lower face thereof to the groove 426. Pressure relief vents as at 430 (FIG. 4B) extend from the outer surface of upper connector 422 to passageway 428. Upper connector 422 may also be externally threaded near its bottom end as seen in FIG. 4C.

A cylindrical spline sleeve 432, internally threaded at the upper end thereof, threadedly engages the lower end of top sub 420. Internally extending splines, as at 434, run the length of spline sleeve 432 from the threaded portion at the upper end to the lower end thereof. The spline sleeve 432 is also externally threaded at the lower end. In addition, pressure relief ports as at 436 are drilled through the wall toward the upper end thereof.

An upper ring retainer 438, internally threaded at the upper end thereof, may be threaded onto the lower end of spline sleeve 432. The lower end of upper ring retainer 438 preferably terminates in an inwardly depending collar 440. When upper ring retainer 438 is threaded onto spline sleeve 432, a release ring 442 may be clamped between the lower end of spline sleeve 432 and the upper face of collar 440.

A cylindrical torque sleeve 444 may surround a portion of the length of upper connector 422 and be internally threaded near the lower end thereof. Externally, longitudinally extending splines 446 at the upper end of torque sleeve 444 may interact with splines 434 on the interior of spline sleeve 432. Conventional O-rings carried by the torque sleeve 444 preferably provide a seal above pressure relief vent 430 between torque sleeve 444 and upper connector 422.

The internal diameter near the lower end of torque sleeve 444 may be enlarged which provides a shoulder 448 and a seat for another seal 450 between torque sleeve 444 and upper connector 422 below pressure relief vent 430. A detent or shoulder 449 may also be cut into the outer diameter of the torque sleeve 444 for seating the release ring 442. The lower, inner edge of ring 442 may be chamfered slightly to allow it to be pushed over the shoulder 449 for a purpose to be described.

A cylindrical inflation vent sleeve 452 may also surround a portion of the length of upper connector 422 and is preferably externally and internally threaded near the upper and lower ends, respectively. The upper end of inflation vent sleeve 452 bears against the lower end of seal 450 and retains the upper end of seal 450 against shoulder 448 when the upper end of inflation vent sleeve 452 is threaded into the lower end of torque sleeve 444. Pump inflation vents, as at 454, may also be drilled through the wall of inflation vent sleeve 452 toward the upper end thereof and communicate with a space 456 between the inner diameter of inflation vent sleeve 452 and the outer diameter of upper connector 422.

Figure 4B:
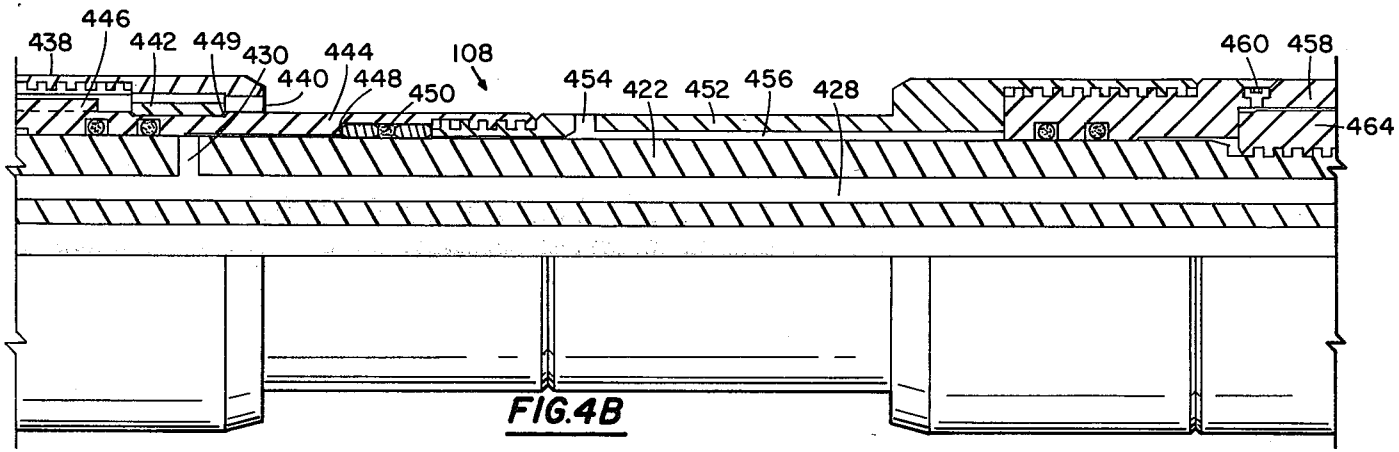
Figure 4C:
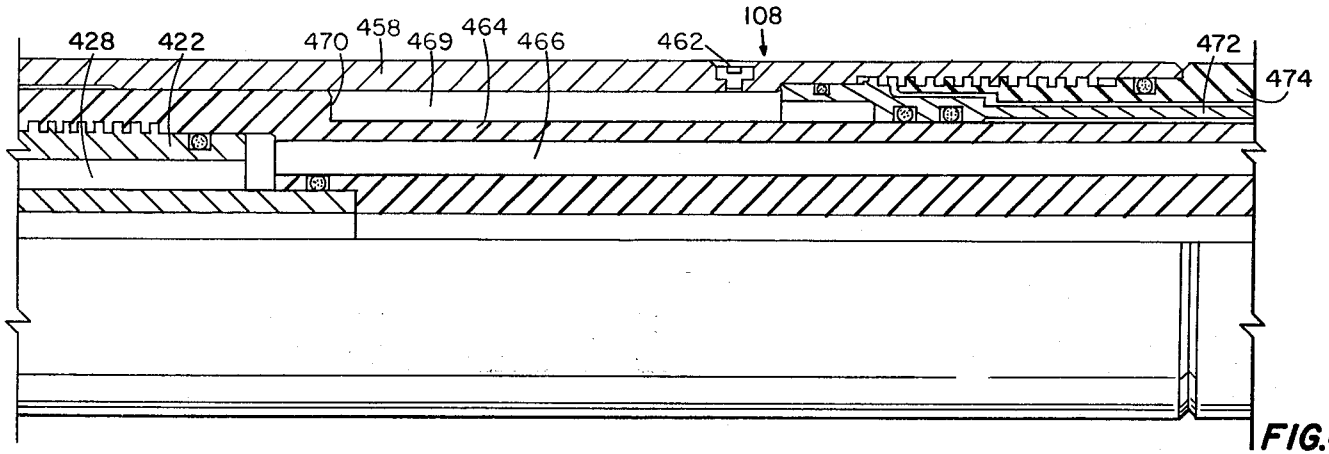

A cylindrical time-delay cylinder 458, externally threaded near its upper end and internally threaded near its lower end as shown in FIGS. 4B and 4C, may be threaded into the bottom end of inflation vent sleeve 452. The upper end of the time delay cylinder 458 may directly overlay a lower portion of upper connector 422. Holes may be drilled through the wall of the time-delay cylinder, near its top and bottom ends, and tapped to receive plugs 460 and 462, respectively. Conventional O-ring seals carried by the plugs may be used to provide for sealing between the plugs and the holes. Conventional O-rings carried by the upper end of time-delay cylinder 458 may also provide a seal between it and the upper connector 422.

Figure 4D:
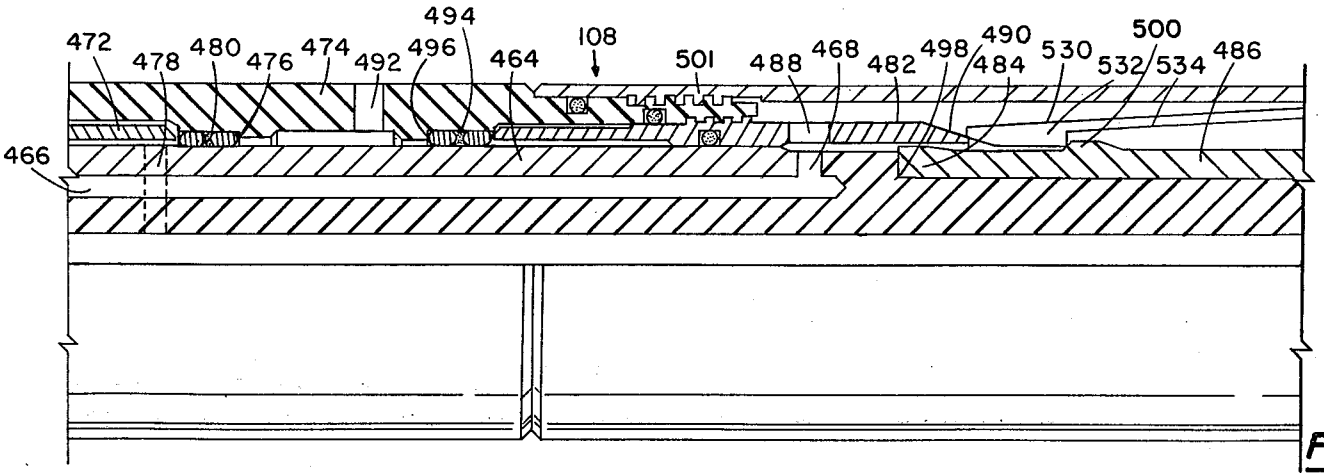

A cylindrical time-delay piston 464, internally threaded near its upper end and internally threaded near its lower end, as shown in FIGS. 4B and 4D, respectively, attaches to the bottom end of upper connector 422. A conventional O-ring carried below the threads on the lower end of upper connector 422 may be used to provide a seal between it and time-delay piston 464. Longitudinally extending coaxial passageways in the wall, as at 466, may be drilled from the top of time-delay piston 464 toward the bottom end thereof and terminate in apertures, as at 468, drilled radially through the wall of the time-delay piston the fluid communication with the external diameter thereof.

The upper ends of the passageways 466 may be in fluid communication with the lower ends of passageways 428 in upper connector 422 (FIG. 4C). Conventional O-rings, one carried by bottom connector 422 and one carried by time-delay piston 464, preferably maintain a fluid-tight connection between the bottom end of upper connector 422 and the upper end of time-delay piston 464.

A space 469 (FIG. 4C) is provided between the inner diameter of time-delay cylinder 458 and the outer diameter of time-delay piston 464 by reducing the external diameter of the piston along a portion of its length. The reduction in the outer diameter of piston 464 also provides a downwardly facing piston face 470. In this preferred embodiment, the clearance between the time-delay cylinder 458 and time-delay piston 464, above piston face 470, is approximately three to five thousandths of an inch in diameter.

Space 469 may preferably be filled with Dow Corning fluid 200, 350 centistoke. Filling may be accomplished by removing the plugs 460 and 462 and pouring housing 501 and a conventional O-ring carried by the shifting sleeve 526 may provide a seal therebetween. The uppermost portion of shifting sleeve 526 may have a reduced outer diameter and be externally threaded. Threadedly attached thereto may be the lower, internally threaded end of a collet 530.

The collet may comprise a ramp 532 (FIG. 4D) and spring 534 which may be integral. The ramp 532 tapers upwardly from the inner diameter to nearly the outer diameter thereof. The collet 530 is also split longitudinally from the top end of the ramp 532 to the juncture of the spring 534 with the threaded portion thereof as seen in FIG. 4E.

A bottom sub connector 536 (FIGS. 4E and 4F), externally threaded near the upper end and internally threaded near the bottom end, preferably threadedly engages the lower end of sleeve housing 501. The inner diameter of the upper end of the bottom sub connector 536 may bear against the outer diameter of lower connector 506 and a conventional O-ring carried by bottom sub connector 536 may provide a seal between it and the lower connector 506. Three screws spaced at 120°, one of which is shown at 538, may also be threaded into the upper face of bottom sub connector 536.

Two fluid ports 540 may be drilled through the wall of the bottom sub connector and sealed with pipe plugs 542, as shown. The internal diameter of the bottom sub connector 536, below fluid port 540, may be enlarged to provides a downwardly facing shoulder 544. Passageways, as at 545, may be drilled through the shoulder 544 for communicating with fluid ports 540.

A bottom sub 546 (FIG. 4F), externally threaded near the upper end thereof, may threadedly engage the lower end of bottom connector 536. The lowermost length of bottom sub connector 536 may overlie bottom sub 546 and a conventional O-ring carried by the bottom sub 546 used to provide a seal therebetween. The uppermost length of bottom sub 546 may extend into the enlarged internal diameter of bottom sub connector 536.

The inner diameter of the upper end of the bottom sub 546 may be enlarged to generate an upwardly facing shoulder 548, against which the lower end of a seal 550, carried in the resulting enlargement, bears. The upper end of seal 550 may also abut downwardly facing shoulder 544 on bottom sub connector 536. The inner diameter of the bottom sub 546, near the upper end thereof, may bear against the outer diameter of the lower connector 506 and a conventional O-ring carried by the bottom sub 546 used to provide a seal therebetween.

Axially extending fluid passageways, as at 552, may be formed in the wall of bottom sub 546 from the top end toward the bottom end thereof. The passageways may terminate at fluid ports, as at 554, which are formed to extend radially through the wall of bottom sub 546 near the bottom end thereof. The ports 554 may be closed by pipe plugs 556.

The lower end of the bottom sub 546 may be tapered from the outer diameter toward the inner diameter and externally threaded. A conventional O-ring may be carried by the bottom sub 546 just above the threaded portion at the lower end thereof. The bottom sub 546 may also be internally threaded near the lower end thereof and enlarged in diameter to produce a downwardly facing shoulder 558.

A cylindrical adapter 560 may fit within the lower end of bottom sub 546 so that the external diameter at the upper end thereof bears against the internal diameter of bottom sub 546. A conventional O-ring carried by the adapter 560 may provide a seal between the upper, outer surface of the adapter 560 and the inner diameter of the bottom sub 546.

The outer diameter of the adapter 560 may be reduced below the O-ring seal and the reduction terminated at a radially extending collar 562 on adaptor 560. The reduction in outer diameter contributes to forming a fluid passageway 561 between the inner diameter of bottom sub 546 and the outer diameter of adapter 560. In addition, passageways, as at 563, may be axially formed through the collar 562 in fluid communication with passageway 561.

A cylindrical adapter nut 564, externally threaded near the lower end thereof, may be threaded into the lower end of adapter 560. The upper end of the adapter nut 564 thus bears against the lower face of collar 562 and holds the upper face thereof against shoulder 558.

The lowermost end portion of adapter 560 below collar 562 may be reduced in diameter and adapted to fit within the next lower module in the test string.

Operation of Valve 108

When a testing tool is made up, the upper end of top sub 420 may be threaded onto the lower end of the check valve body 358 of check/relief valve 106, (FIG. 3B). The lower end of stinger 362 in the check/relief valve 106 then fits into enlarged diameter 424 of upper connector 422 in the valve 108. Passageway 372 in check/relief valve 106 is then in fluid communication with passageway 428 in upper connector 422 of valve 108.

Basically, the valve 108 can be considered a telescoping unit. The outer portions of the valve 108, i.e., torque sleeve 444 (FIG. 4B), inflation vent sleeve 452 (FIG. 4B), time-delay cylinder 458 (FIGS. 4B and 4C), equalizing housing 474 (FIGS. 4C and 4D), sleeve housing 501 (FIGS. 4D and 4E), bottom sub connector 536 (FIGS. 4E and 4F), and bottom sub 546 (FIG. 4F), are connected to the testing tool below the valve 108 and are held stationary during a test cycle by the inflation of packer 112 singly or packers 112 and 122, in the case of straddle packer test.

The inner portions of the valve 108, i.e., top sub 420 (FIG. 4A), spline sleeve 432 (FIG. 4A), upper connector 422 (FIGS. 4A–4C), time-delay piston 464 (FIGS. 4B–4E), lower mandrel 504 (FIGS. 4E and 4F), lower connector 506 (FIGS. 4E and 4F), and any components carried thereby, are connected to the testing tool above the valve 108 and move up and down with the drill string during a test cycle.

As the testing tool is run into the well, valve 108 is in the elongated or stretched position shown in FIGS. 4A–4F. It is held in the elongated or stretched positions by release ring 442 (FIG. 4B) which requires sufficient weight set-down on the drill string to push it over the shoulder 449 and downwardly along the outer circumference of sleeve 444 as will be described presently.

In the stretched configuration and before pump rotation is started, the various ports and vents are positioned as follows:

1. Pump pressure relief vents 430 in upper connector 422 (FIG. 4B) are closed between seal 540 and conventional O-rings, all carried by torque sleeve 444, below and above the pump pressure relief vents 430, respectively.

2. Relief vents 478 in time-delay piston 464 (FIG. 4D) are closed off by seal 480 and the O-rings at the upper end of retainer 472, thereby isolating the inside of the tool below valve 108 from the well annulus.

3. Ports 488 in the cone and seal spacer 482 (FIG. 4D) are always open.

4. Deflate ports 520, 522, and 528 (FIG. 4E) in the lower connector 506, seal spacer 512, and shifting sleeve 526, respectively, are open to the well annulus through deflate ports 502 in sleeve housing 501.

5. Inflation port 524 in the lower end of lower connector 506 (FIG. 4F) is open.

6. Pressure relief ports 436 in the spline sleeve 432 (FIG. 4A) are always open.

When the testing tool has been run into the proper depth, pump 104 is activated. Inflation fluid flows down passageway 428 in upper connector 422, passageway 466 and holes 468 in time delay piston 464, and ports 488 in cone and seal spacer 482 to enter the space above shifting sleeve 526.

At this point, shifting sleeve 526 is held against downward movement by virtue of ramp 532 engaging secondary bump 500 (FIG. 4D) and seals 510 and 516 (FIGS. 4E and 4G) having snapped into position into the matching radii cut into the inner 26 diameter of shifting sleeve 526.

Pressure buildup above the shifting sleeve 526 moves it downwardly, causing ramp 532 to ride over secondary bump 500 and seals 510 and 516 to disengage from their respective radii. Sleeve 526 moves downwardly until the lower face thereof abuts the heads of screws 538 in the upper face of bottom sub connector 536.

Figure 4E:
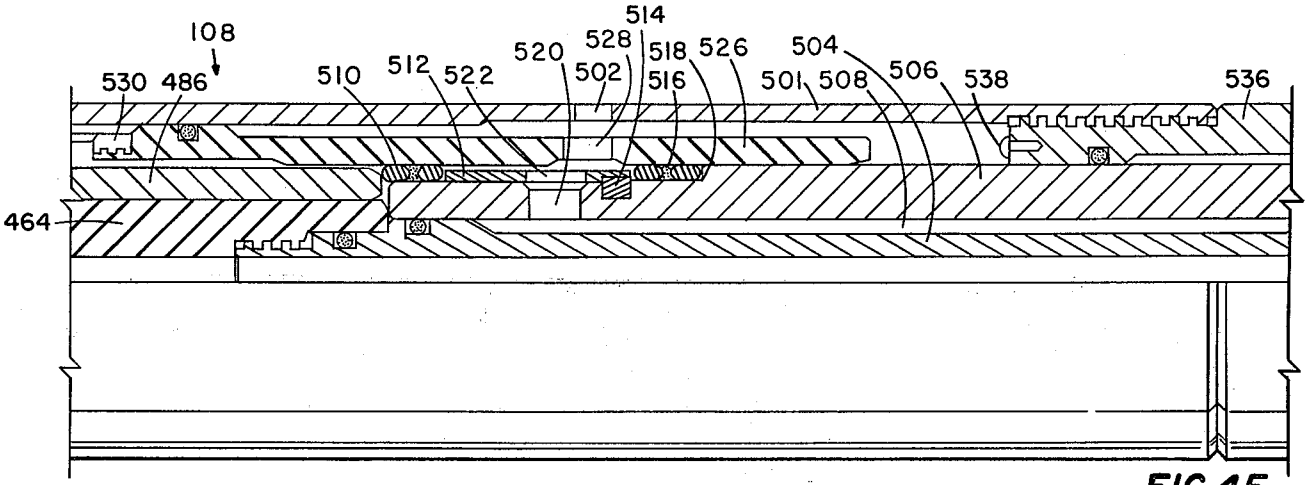
Figure 4F:
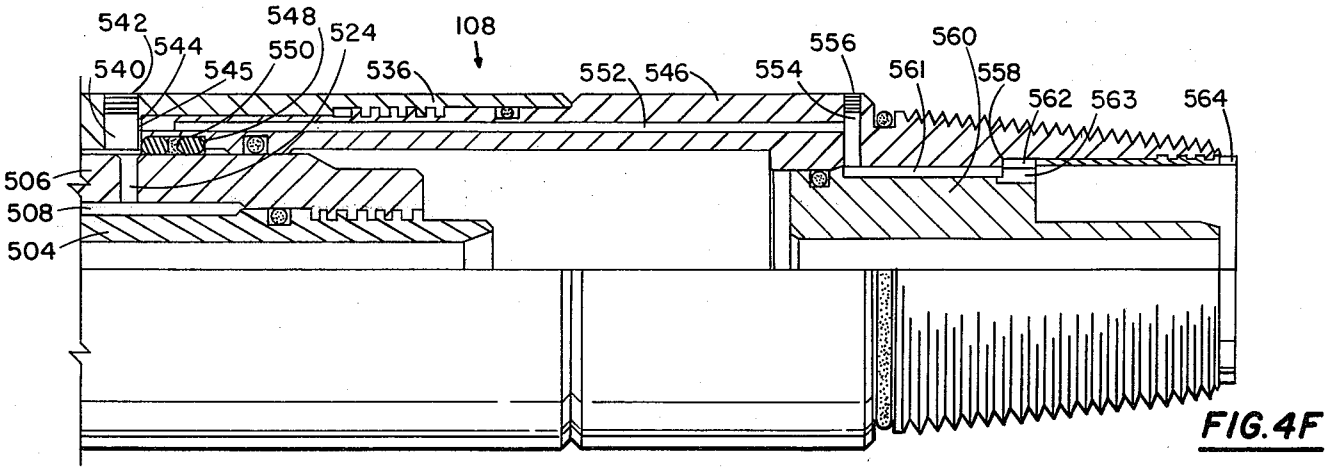

During downward movement of shifting sleeve 526, pressure balance to prevent hydraulic load on shifting sleeve 526 is accomplished through deflate port 502 in sleeve housing 501 (FIG. 4E). As shifting sleeve 526 moves downwardly, well fluid in the space below the shifting sleeve 526 is vented to the well annulus through deflate ports 502.

Figures 4G, 4H:
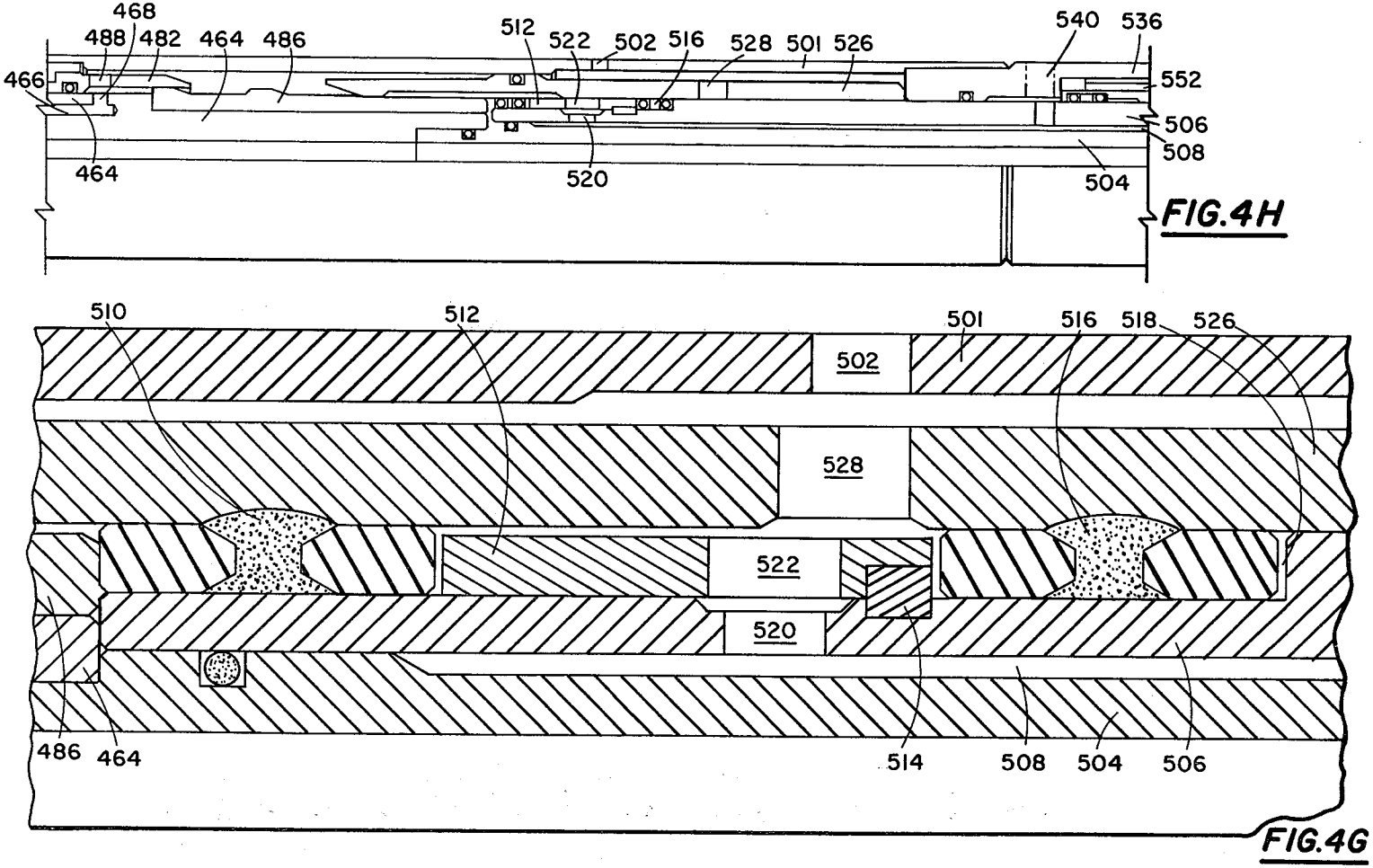
FIG. 4G is an enlarged view of a portion of FIG. 4E.
FIG. 4H illustrates sleeve 526 in the pumped down position.

At this point, the shifting sleeve 526 is in the position shown in FIG. 4H and the ports associated therewith are positioned as follows:

1. Deflate port 528 in shifting sleeve 526 has been sealed off due to having moved below seal 516 carried by lower connector 506.

2. Ports 520 and 522 in the lower connector 506 and seal spacer 512, respectively, are in fluid communication with ports 488 in cone and seal spacer 482 and passageway 508 between lower mandrel 504 and lower connector 506.

Inflation fluid is then free to flow from ports 488 in cone and seal space 482 into the space between the outer diameter of seal spacer 512 and inner diameter of shifting sleeve 526. Ports 522 and 520 in the seal spacer 512 and lower connector 506, respectively, are open and inflation fluid continues flowing into passageway 508 to ports 524 in the wall of the lower length of lower connector 506. Fluid flow continues through ports 540 and passageway 545 in the bottom sub connector 536 to passageway 552 and ports 554 in bottom sub 546. Finally, fluid exits valve 108 through passageway 561 between the inner diameter of bottom sub 546 and the outer diameter of adapter 560 and then through bores 563 formed in collar 562 on adapter 560.

Continued pump rotation maintains the flow of inflation fluid to the packers until they are fully inflated. At this time, the relief valve portion of check/relief valve 106 in FIG. 3A opens and vents inflation fluid to the well annulus.

After inflation pressure has been reached, packer setting is verified by lifting on the string and observing a weight indicator. Weight is then applied to the drill string against the counterforce supplied by the set packers.

Release ring 442 pushes over shoulder 449 on inflation vent sleeve 452 and the applied weight starts closing the stretched or elongated valve 108. The interaction between release ring 422 and shoulder 449 prevents valve 108 from telescoping during running in when high friction could be present, as in directional drilling, undersize holes, etc.

As seen in FIG. 4A, pressure buildup between the top sub 420 and torque sleeve 444 is prevented during telescoping of the valve 108 by pressure relief ports 436 in the wall of spline sleeve 432. Drilling mud escapes through ports 436 as top sub 420 moves downwardly relative to torque sleeve 444.

First, as the valve telescopes, ports 524 in lower connector 506 (FIG. 4F) pass under seal 550 carried by bottom sub 546. The inflation passage to the packers is thus sealed off to prevent packer deflation. Simultaneously therewith, the relief vents 478 in the time-delay piston 464 (FIG. 4D) pass under seal 480 carried by equalizing housing 474. The interior of the tool and, therefore, the space between the packers, i.e., the test zone, is then in fluid communication with the well annulus through relief vents 478 in the time-delay piston 464 and equalizing ports 492 in the wall of equalizing housing 474. This compensates for the "plunger" effect on the test zone as the hydraulic main valve 102 in FIG. 1A and valve 108 telescope as weight is set down on the drill string.

Valve 108 continues telescoping at a rate governed by the interaction between time-delay piston 464 and time-delay cylinder 458 as determined by the clearance between them, which is preferably between three and five thousandths inch on the diameter. This allows the viscous fluid in space 469, such as Dow Corning 200,350 centistoke, for example, to slowly be displaced through the clearance. Conventional O-rings above and below volume 469 prevent contamination of the fluid with drilling mud.

Next, pump pressure relief vents 430 in upper connector 422 (FIG. 4B) pass under seal 450 carried by torque sleeve 444. This puts inflation passageway 428 in upper connector 422 in fluid communication with the well annulus through pump inflation vents 454 in the inflation vent sleeve 452. Thus, pressurized inflation fluid above the sealed off packers is vented to the well annulus.

Valve 108 continues telescoping and relief vent 478 in time-delay piston 464 (FIG. 4D) passes under seal 494 carried by equalizing housing 474 and sleeve retrieval bump 484 on retrieving sleeve 486 passes under ramp 532 on collet 530. Relief vent 478 passing under seal 494 seals off and prevents fluid communication between the test zone and the well annulus through equalizing ports 492 in equalizing housing 474. Sleeve retrieval bump 484 passing under 4 ramp 532 prepares the shifting sleeve 526 for retrieval.

Figures 4I, 4J, 4K:
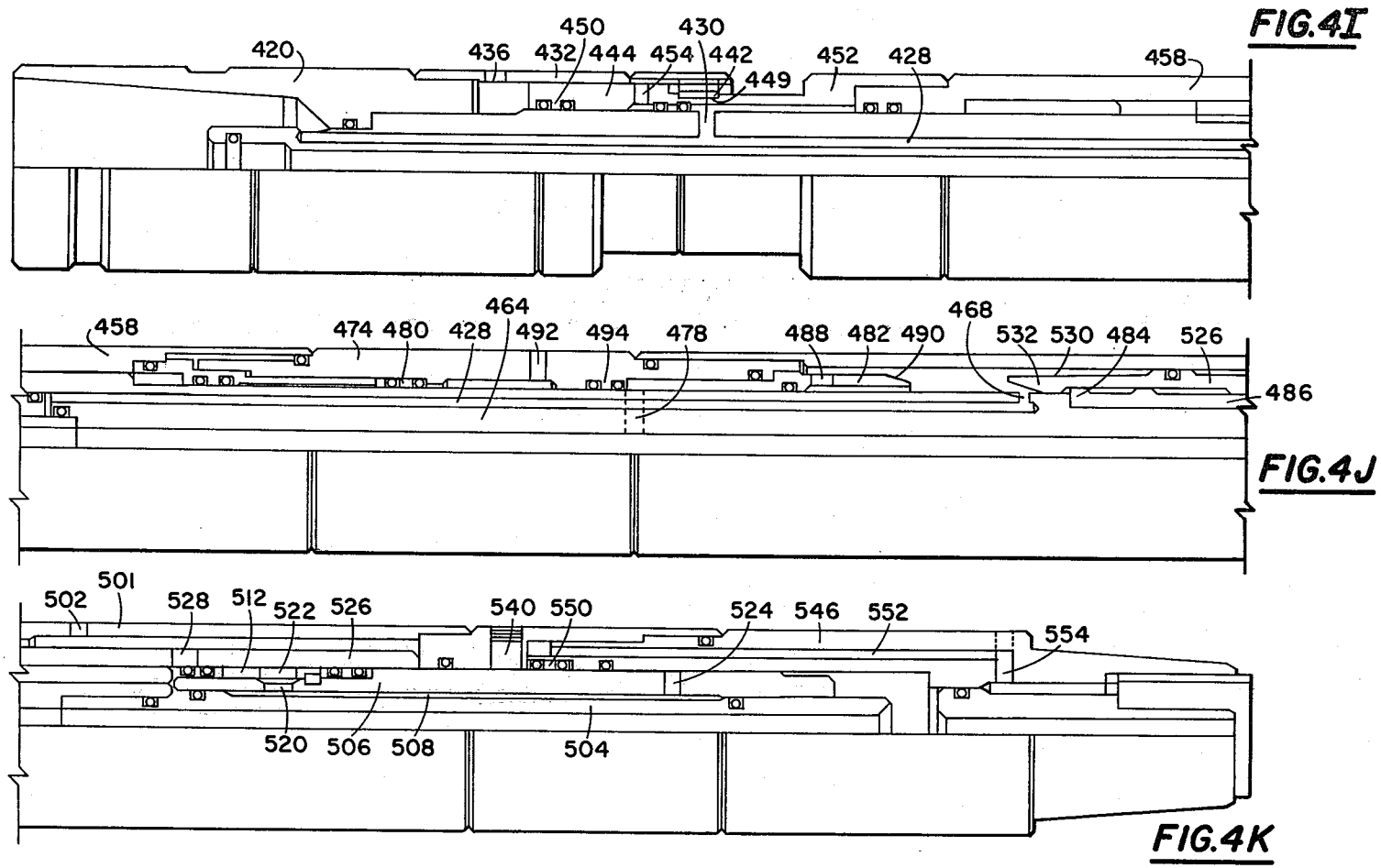
FIGS. 4J–4K illustrate the valve assembly in the collapsed position.

Valve 108 continues closing until it is completely collapsed and piston face 470 on time-delay piston 464 (FIG. 4G) has completely traversed space 469. Valve 108 is then 8 in the position shown in FIGS. 4I–4K, ready for drill stem testing, such as, for example, flow and shut-in testing.

Upon completion of the testing, a steady pull is applied to the drill string to slowly elongate valve 108. The rate of elongation is again controlled by the clearance between the time delay piston 464 and time delay cylinder 458. As before, the outside of the valve 108 and the lower portion of the testing tool is held from coming up due to the packers yet being inflated.

During the picking up stroke, relief vents 478 in the time-delay piston 464 (FIG. 4D) cross back under seal 494 carried by equalizing housing 474. This allows fluid communication and thus equalization between the test zone and the well bore through equalizing ports 492 in equalizing housing 474. Therefore, the annulus above the packer(s) will equalize with the tested formation zone and prevent packer damage during deflation.

Second, sleeve retrieval bump 484 on retrieving sleeve 486 moves up and catches ramp 532, part of collet 27 530, on shifting sleeve 526 (FIG. 4D). Shifting sleeve 526 continues moving up with retrieving sleeve 486 until ramp 532 on collet 530 is cammed outwardly by engagement with lifting ramp 490 on cone and seal spacer 482. At this point, sleeve retrieval bump 484 rides under ramp 532 and upward movement of shifting sleeve 526 stops.

Next, the pressure relief vents 430 in the wall of upper connector 422 (FIG. 4B) cross back under seal 450 carried by torque sleeve 444. This seals off inflation passage 428 in upper connector 422 to prevent communication thereof with the well annulus through pump inflation vents 454 in the wall of inflation vent sleeve 452.

As valve 108 continues elongating, fluid ports 524 in the wall of lower connector 506 (FIG. 4F) cross back under seal 550. This allows packer deflation through passageway 508 between the inner diameter of lower connector 506 and outer diameter of lower mandrel 504 and deflate ports 520, 522, 528, and 502 in lower connector 506 (FIG. 4E), seal spacer 512, shifting sleeve 526, and sleeve housing 501, respectively.

Next, relief vents 478 in the wall of time delay piston 464 (FIG. 4D) cross back under seal 480 carried by equalizing housing 474. The bore is thus again sealed off from the well annulus through equalizing ports 492 in the wall of equalizing housing 474.

Finally, release ring 44 carried by upper ring retainer 438 snaps back below shoulder 449 on torque sleeve 444. Now valve 108 is back in its original stretched or elongated position, ready to be either relocated in the well for more testing or retrieved from the well.

In addition to the preceding normal operation of valve 108, torque may be transmitted through the valve. This may be accomplished through the interaction of splines 434 on spline sleeve 432 with splines 446 on torque sleeve 444 (FIG. 4A).

Packer Deflate Subassembly 110

Figure 5A:
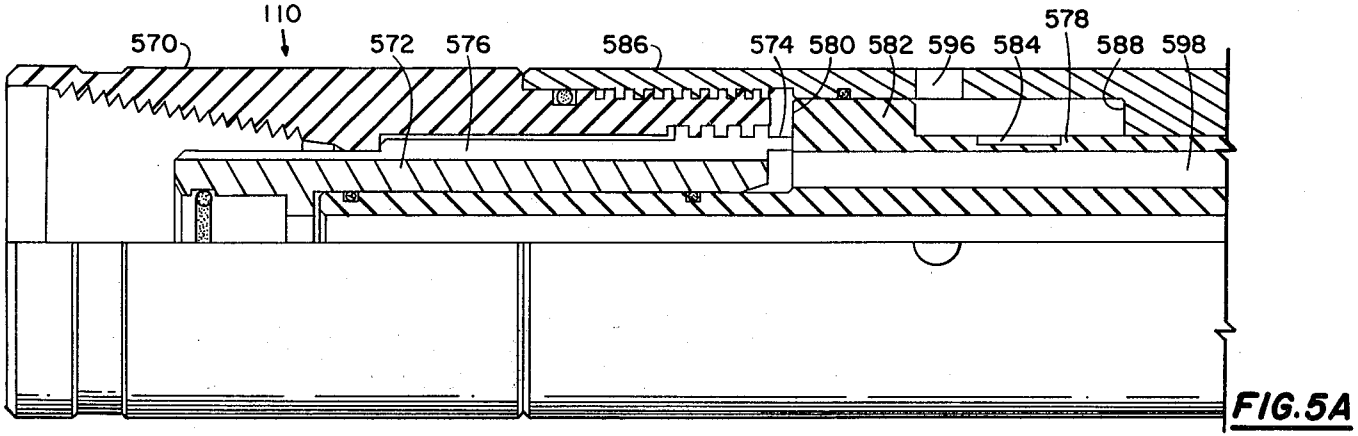
FIGS. 5A–5C illustrate the deflate subassembly in detail in partial cross-section.
Figure 5B:
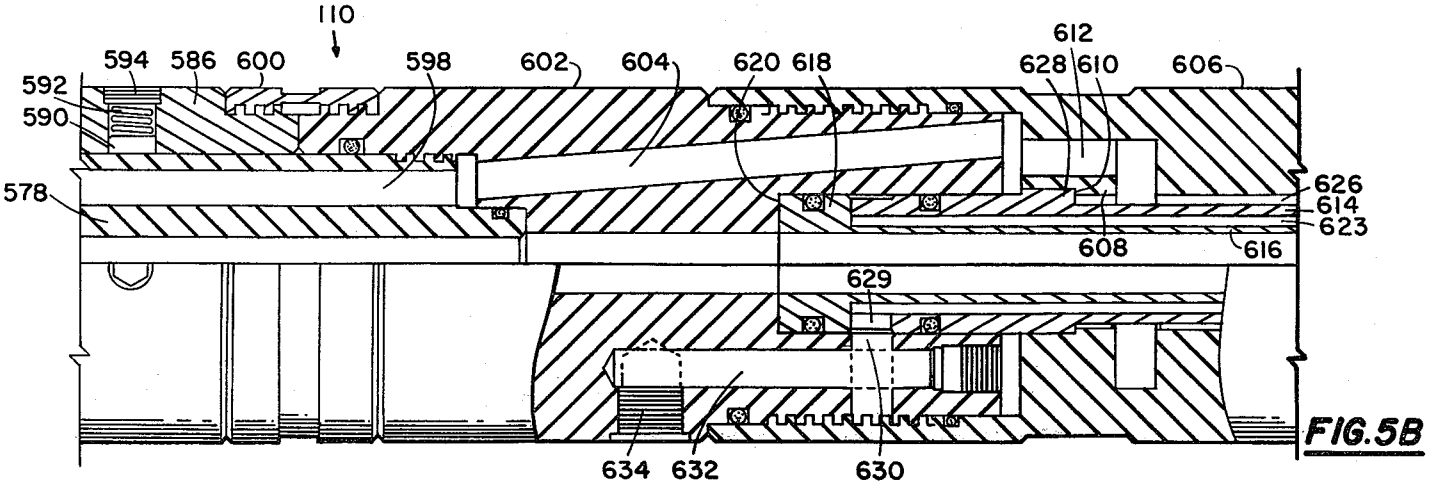
Figure 5C:
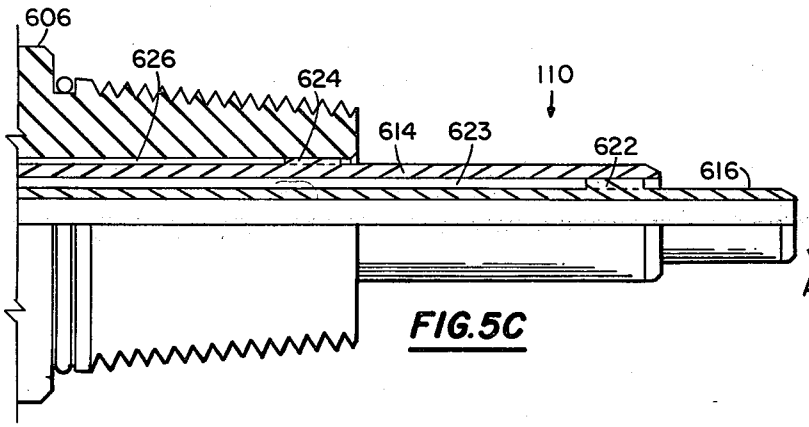

The preferred embodiment of the packer deflate subassembly 110, set forth in detail in FIGS. 5A-5C, lies between the valve assembly 108 and upper packer 112 as shown in FIG. 1B. Hollow top sub 570 of the packer deflate subassembly 110 is internally threaded near its upper end, and engages the bottom end of bottom sub 546 of the valve assembly 108, FIG. 4F. The top sub 570 is also internally and externally threaded near its lower end.

The top sub 570 may surround and threadedly engage a stinger adapter 572 which is externally threaded near the lower end thereof. The stinger adapter 572 preferably terminates near its lower end in a projection 574 which may serve as a spacer. The stinger adapter 572 also may have longitudinal inflation channels in the outer surface as at 576, running from top to bottom thereof.

When a testing tool is made up and the top sub 570 of the packer deflate sub assembly 110 is threaded onto the lower end of bottom sub 546 of the valve assembly 108, the bottom end of adapter 560 of the valve assembly 108 may fit within the upper end of stinger adapter 572. A conventional O-ring carried by the stinger adapter 572 may provides a seal therebetween.

A portion of the length of the stinger adapter 572 may surround the upper length of a top connector 578 which is externally threaded near its lower end (FIG. 5B). Conventional O-rings may be carried by the top connector 578 to provide a seal between the stinger adapter 572 and the top connector near the upper and lower ends of the length common to both.

The outer diameter of the portion of the top connector 578 surrounded by stinger adapter 572 may be of a reduced diameter and terminate at a radial shoulder 580. Shoulder 580 is the upper face on a collar 582 about midway along the length of the top connector 578. The outer diameter of the top connector 578 below collar 582 may also be reduced in diameter and a detent 584 formed in the outer circumference a short distance below the collar 582.

When the packer deflate subassembly 110 is made up, projection 574 on the lower end of stinger adapter 572 preferably abuts the shoulder 580 on top connector 578. This provides a space between the two elements for the flow of inflation fluid.

A retrieving sleeve 586, internally threaded near its upper end, may threadedly engage the lower end of top sub 570. A conventional O-ring may be carried by the retrieving sleeve 586 to provide a seal between it and top sub 570. The retrieving sleeve surrounds the top connector 578 and bears against the collar 582. A conventional O-ring may be carried by the retrieving sleeve to provide a seal between it and collar 582.

The inner diameter of a portion of the upper length of 24 retrieving sleeve 586 may be enlarged and terminate in an upwardly facing radial shoulder 588. The inner diameter of the remaining length of the retrieving sleeve, below shoulder 588 may bear against the outer surface of top connector 578.

Four apertures may be formed to extend through the wall of the retrieving sleeve 586 below collar 582, as shown in FIG. 5B, and threaded near the radially outer ends thereof. The apertures are preferably spaced equidistant about the retrieving sleeve 586 and are each adapted to receive a dog 590, spring 592, and threaded plug 594. Dog 590 is preferably shaped so that the upper portion thereof forms a stem which is surrounded by spring 592. The spring 592 is compressed between the plug 594 and the lower portion of dog 590 and acts to force the dog 590 inwardly against the outer surface of top connector 578.

Four deflate ports 596, preferably spaced equidistant about the retrieving sleeve 586, may also be formed through the wall of the retrieving sleeve. They are preferably located just below collar 582 on top connector 578. In addition, fluid passageways 598 extending downwardly from shoulder 580 may be formed in the wall of top connector 578 to extend to a location near the bottom end thereof.

The top connector 578 may be externally threaded near its lower end and a circumferentially grooved tension sleeve 600, internally threaded near its upper and lower ends, may be attached thereto. The lower end of tension sleeve 600 may be threaded onto the externally threaded upper end of a middle connector 602. The middle connector 602 is preferably internally threaded near its upper end to threadedly engage the bottom end of top connector 578. An unthreaded extension of middle connector 602 may surround a portion of the outer surface of the top connector 578. A conventional O-ring may be used to provide a seal therebetween. The middle connector 602 may also surround the lower end of top connector 578 and an O-ring may provide a seal therebetween.

Longitudinally extending fluid passageways 604 may be formed in the wall of middle connector 602. The fluid passageways 604 preferably are located so as to be in communication with passageways 598 in top connector 578 and extend to the bottom end of connector 602.

Middle connector 602 may be externally threaded near its bottom end as shown. A bottom connector 606, internally threaded near its upper end may threadedly engage the lower end of middle connector 602. Conventional O-rings carried by the connectors 602 and 606, above and below the common threaded portion, may be used to provide a seal between the middle connector 602 and bottom connector 606.

Bottom connector 606 may be externally tapered and threaded near its bottom end and an O-ring carried near the upper termination of the threads (FIG. 5C). An inwardly depending, radial collar 608 (FIG. 5B) may also be formed on the internal diameter of the bottom connector 606, about midway along the length thereof. A portion of the length of the collar 608 may be radially altered to provide an upwardly facing shoulder 610. Axially extending fluid passageways 612 may also be formed through the collar 608.

The internal diameter of the lower length of middle connector 602 is preferably enlarged to receive the upper end of an outer stinger 614 and an inner stinger 616. The upper end of inner stinger 616 may terminate in an external collar 618, so that the upper face of the collar may abut a downwardly facing shoulder 620 formed by the upper termination of the enlarged inner diameter at the lower end of middle connector 602. A conventional O-ring may be carried by collar 618 to provide a seal between it and the inner diameter of middle connector 602.

Outer stinger 614 surrounds inner stinger 616 and the upper end thereof may abut the lower face of collar 618. The inner stinger 616 is preferably spaced from outer stinger 614 by means such as a spider 622 located near the bottom end of the inner stinger. The spacing provides a by-pass fluid passageway 623 between the inner diameter of outer stinger 614 and the outer diameter of inner stinger 616. The upper end portion of inner stinger 616 is surrounded by the lower end of middle connector 602 and a conventional O-ring may provide a seal therebetween.

The lower portion of bottom connector 606 preferably surrounds outer stinger 614 and is spaced therefrom by means such as a spider 624 which may be integral with stinger 614. The spacing provides for an inflation fluid passageway 626 between the inner diameter of bottom connector 606 and the outer diameter of outer stinger 614.

A collar 628 may be formed on the outer diameter of outer stinger 614 near the upper end thereof. When the bottom connector 606 is connected to middle connector 602, the upper face of shoulder 610 on collar 608 of bottom connector 606 will bear against the lower face of collar 628 on the outer stinger 614. This forces outer stinger 614 and, in turn, inner stinger 616 upwardly until the upper face of collar 618 of inner stinger 616 abuts shoulder 620 on middle connector 602.

The upper end of by-pass fluid passageway 623 preferably terminates in slots 629 formed in the wall of inner stinger 616 (FIG. 5B). The by-pass slots 629 are in fluid communication with by-pass ports 630 formed in the wall at the lower end of middle connector 602. Axially extending, short, by-pass passageways 632 may be formed in the wall of the middle connector 602 from the lower end thereof to intersect by-pass ports 630. By-pass passageways 632 may terminate at their upper ends in by-pass orifices 634 formed in the wall of middle connector 602.

The lower ends of the by-pass passageways 632 may be tapped and plugged with conventional pipe plugs. The by-pass orifices 634 may also be tapped and threaded so that they may be plugged with conventional pipe plugs when only one packer is used.

Packer Deflate Subassembly 110 Operation

The packer deflate subassembly 110 fits between valve subassembly 108 and packer 112 as shown in FIG. 1B. Ordinarily, the deflation function is carried out by valve subassembly 108. However, if the valve subassembly 108 fails to function on the deflate cycle, the packer deflate subassembly 110 provides a fail-safe back-up method for deflating the packer(s).

During packer inflation, pressurized drilling mud flows through the deflate sub via inflation channels 576 in stinger adaptor 572, fluid passageways 598 in top connector 578, fluid passageways 604 in middle connector 602, fluid passageways 612 in collar 608, and fluid passageway 626 from the pump subassembly 104 to the packer(s).

The packer deflate subassembly 110 is preferably designed so that pulling on the drill string, in the case of a deflate malfunction in the valve subassembly 108, will cause tension sleeve 600 to break at a predetermined tension value. This tension value can be controlled by the depth of the groove illustrated at its central portion in FIG. 5B and will be greater than that normally required to elongate or stretch the valve subassembly 108.

When tension sleeve 600 breaks, top sub 570 and retrieving sleeve 586 will be pulled upwardly until shoulder 588 on the retrieving sleeve 586 abuts the lower face of collar 582 on top connector 578 and dogs 590 snap into detents 584.

At this point, the O-ring carried by retrieving sleeve 586 no longer forms a seal against collar 582 on the 19 connector 578. Deflate ports 596 in the retrieving sleeve 586 will have passed above the collar 582 and be in fluid communication with packer inflation fluid in the passageways 576, etc. Packer inflation fluid is thus vented to the well annulus, thereby allowing the packer(s) to deflate.

If dual packers are used in the testing tool, by-pass orifice 634 in middle connector 602 can be employed for equalizing well pressure below the lower packer and above the upper packer. In the case of a single packer test, plugs are preferably threaded into by-pass orifices 634.

Packers 112 and 122

Figure 6C:
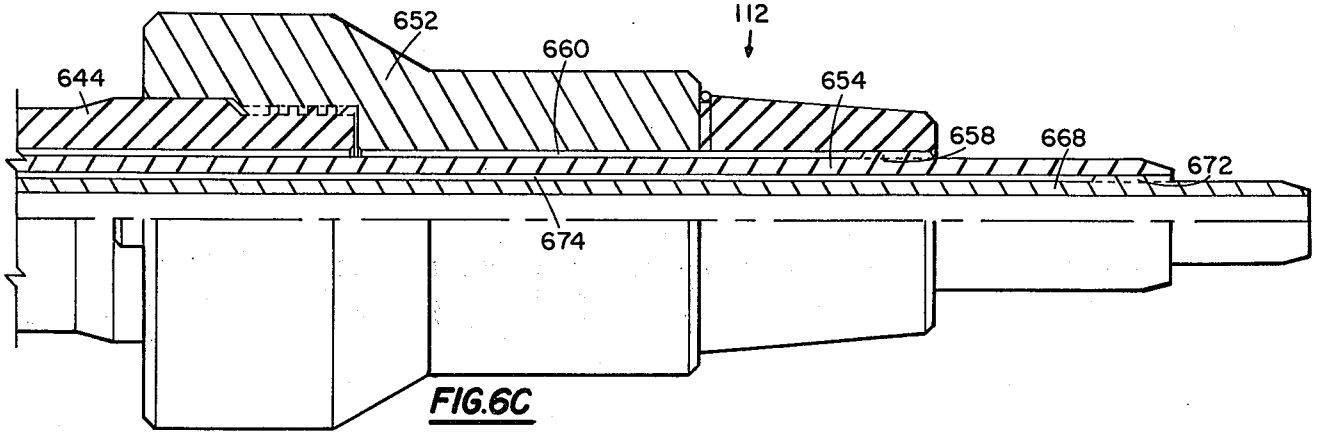
FIGS. 6A–6C illustrate a packer in detail in partial cross-section.
Figure 6A:
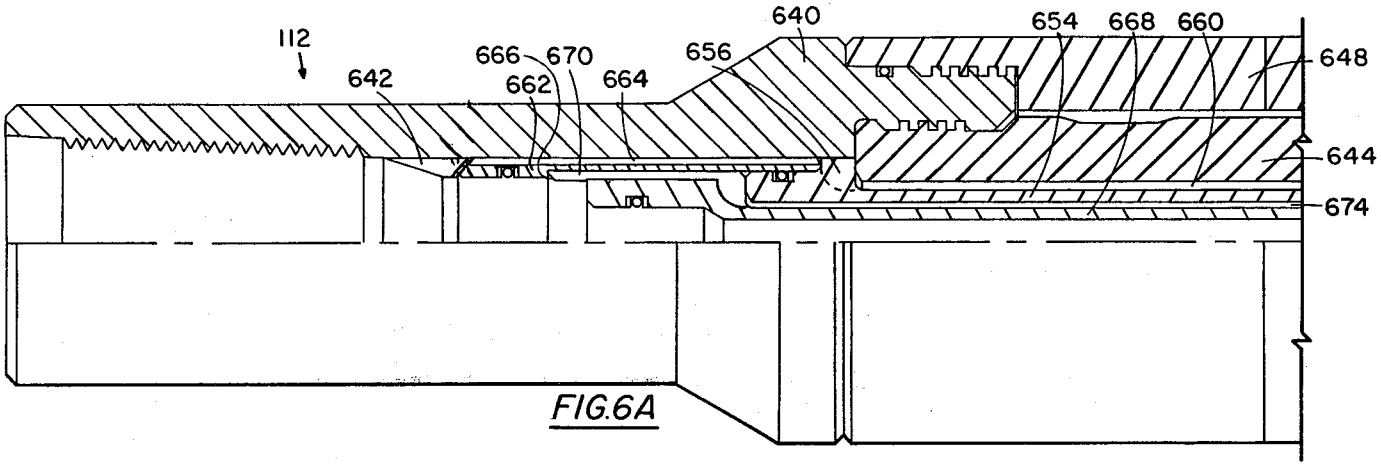
Figure 6B:
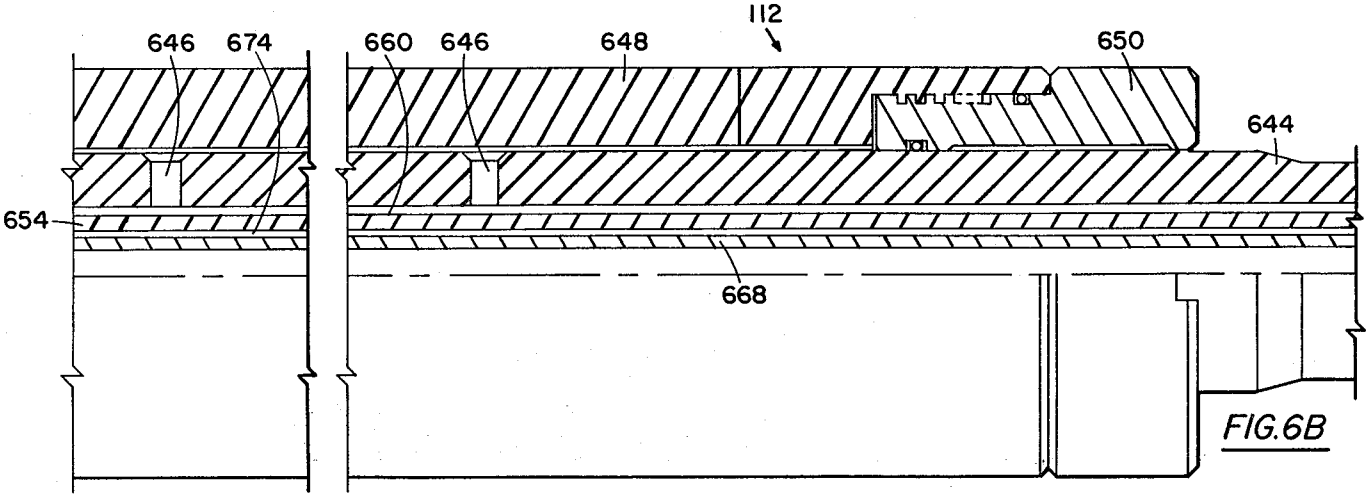

Packers 112 and 122, shown in detail in FIGS. 6A-6C, are identical in makeup and function and therefore only one packer will be described in detail.

This embodiment of the packer preferably comprises a hollow top sub 640 which is internally threaded neat its upper end and externally and internally threaded near its lower end. An internally depending spider 642 with flow passageways therethrough, may be located about midway along the length of the top sub 640.

A hollow cylindrical mandrel 644, externally threaded near its top and bottom ends may threadedly engage the lower end of top sub 640. The mandrel 644 may be ported through the wall at various places, e.g., 646 (FIG. 6B).

A rubber packer element 648, internally threaded near its top and bottom ends may be threaded onto the bottom end of top sub 640. A conventional O-ring 640 may provide a seal between sub 640 and packer element 648. The lower end of the packer element may be threaded onto the externally threaded upper end of a guide collar 650 and similarly sealed against it.

The packer element 648 per se does not incorporate novel structure and might be one of many conventional types; it is therefore not set forth in detail.

The inner surface of guide collar 650, at the top and bottom ends, preferably bears against the external diameter of the mandrel 644 and is adapted to move up and down with respect thereto as the packer element 648 inflates and deflates. A conventional O-ring may be used to provide a seal between guide collar 650 and mandrel 644. Another conventional O-ring may provide a seal between guide collar 650 and the bottom end of packer element 148.

A hollow bottom sub 652, internally threaded near its top end may threadedly engage the bottom end of mandrel 644. A conventional O-ring may seal the bottom sub 652 against mandrel 644. The bottom sub 652 is preferably tapered and externally threaded near its bottom end (not shown) and a conventional O-ring may be carried in a groove at the upper termination of the threads.

A hollow outer stinger 654 may be positioned internally within the bottom portion of top sub 640, so as to extend the complete length of mandrel 644, through bottom sub 652, and beyond the bottom end thereof. The outer surface of the outer stinger 654 is preferably spaced from the inner diameter of the top sub 640, mandrel 644, and bottom sub 652 by means such as an upper spider 656 and a lower spider 658 to provide an inflation fluid channel 660. Upper spider 656 may bear against the inner diameter of top sub 640, while lower spider 658 may bear against the inner diameter of bottom sub 652.

As shown in FIG. 6A, positioned within top sub 640 is a hollow sleeve 662, the upper end of which abuts the lower face of spider 642 on top sub 640 and the lower end of which abuts the upper face of spider 656 on the upper end of outer stinger 654. A length of the sleeve 662 surrounds the upper end of outer stinger 654 above the spider 656 and a conventional O-ring may provide a seal therebetween. The outer surface of the sleeve 662 may be grooved as at 664 to provide inflation fluid passageways therein. A conventional O-ring may be carried in an internal groove near the upper end of the sleeve 662.

The internal diameter of the sleeve 662 may be reduced in the upper end thereof near the O-ring, producing a shoulder 666 which bears against the upper end of an inner stinger 668. Inner stinger 668 extends from shoulder 666 on sleeve 662 through and beyond the the bottom end of outer stinger 654.

The upper-end, outer surface of inner stinger 668 16 is surrounded by sleeve 662 and may be grooved as at 670 to provide bypass passageways. The outer surface of the inner stinger 668 is preferably spaced from the inner surface of outer stinger 654 by means such as a spider 672 located near the bottom end of inner stinger 668 to provide a further bypass passageway 674. A conventional O-ring may also be carried in a groove cut into the internal surface of the inner stinger 668 near the upper end thereof.

Packer Operation

Packers 112 or 122 are capable of being pumped full of well fluid by means of pump assembly 104, FIG. 1A, and expanding outwardly until the outer diameter has contacted the hole or well bore surface or the casing inner diameter with, sufficient force to form a seal.

The operation of this preferred embodiment of the packer is very straight forward. By-pass passageway 670 in the upper end of inner stinger 668 and by-pass passageway 674 between inner stinger 668 and outer stinger 654 allow flow of well fluid from below the bottom packer 122 to above the top packer 112 in a two-packer straddle test (see FIGS. 1B and 1C). This substantially equalizes the pressure below the bottom packer 122 and above the top packer 112 at all times to prevent damage to the packers.

An inflation channel, comprising passageways 664 in the outer surface of hollow sleeve 662 and channel 660 between the outer surface of outer stinger 654 and the inner diameter of mandrel 644 allows flow of well fluid 14 from the pump 104 to the interior of the packer element 648 through ports 646 in the mandrel 644. In the case of a two-packer straddle test, inflation fluid continues flowing to the bottom packer 122 through an extension of channel 660 comprising the spacing between the outer surface of outer stinger 654 and the internal diameter of bottom sub 652.

The inflation network is also the deflation channel for deflating the packer(s).

A flow sub 114 is adapted to fit into the testing tool shown in FIG. 1B next in line below packer 112. Again, more than one flow sub may be used if needed; however, only one is shown and described in detail for the purposes of explaining the invention. In any event, any additional flow subs may be identical to the one set forth in FIGS. 7A-7G.

The flow sub 114 shown in FIGS. 7A-7G may include a top connector 680, internally tapered and threaded near the upper end and internally threaded near the bottom end.

A hollow flow sub body 682, externally threaded near the top and bottom ends may be threaded onto the lower end of top connector 680. Conventional O-rings carried by the top connector 680 and flow sub body 682 may form seals therebetween. A conventional O-ring may also be carried in a groove on the internal diameter of the flow sub body 682 near the upper end thereof. This provides a seal between outer stinger 654 of the packer 112 and the inner diameter of top connector 680 of the flow sub 114 when a testing tool is made up.

The inner diameter of the flow sub body 682 may be reduced below the upper end thereof as at 684 and a conventional O-ring carried in a groove on the internal diameter near the upper end of the reduction. The O-ring provides a seal between inner stinger 668 of packer 112 and the inner diameter of the top connector 680 when a testing tool is made up.

Axially extending inflation fluid passageways 686 may be formed in the wall of the flow sub body 682 to allow flow of inflation fluid to lower packer 122 in the case of a two packer straddle test. In addition, axially extending by-pass passageways 688 may also be formed in the wall of the flow sub body 682 from the lower end to nearly the top end thereof. The lower ends of the by-pass passageways 688 are preferably tapped and threaded and sealed with conventional pipe plugs. Radially extending by-pass ports 690 (FIG. 7B) may be formed through the wall of the flow body sub 682 near its lower end so as to intersect the by-pass passageways 688. The upper ends of the by-pass passageways may terminate in radially extending by-pass ports 692 formed in the wall of the flow sub body 682 above reduced internal diameter 684.

Flow ports 694 may also be provided to extend radially through the wall of the flow sub body so that fluid from a test formation may flow into the hollow interior of the flow sub.

Figure 7A:
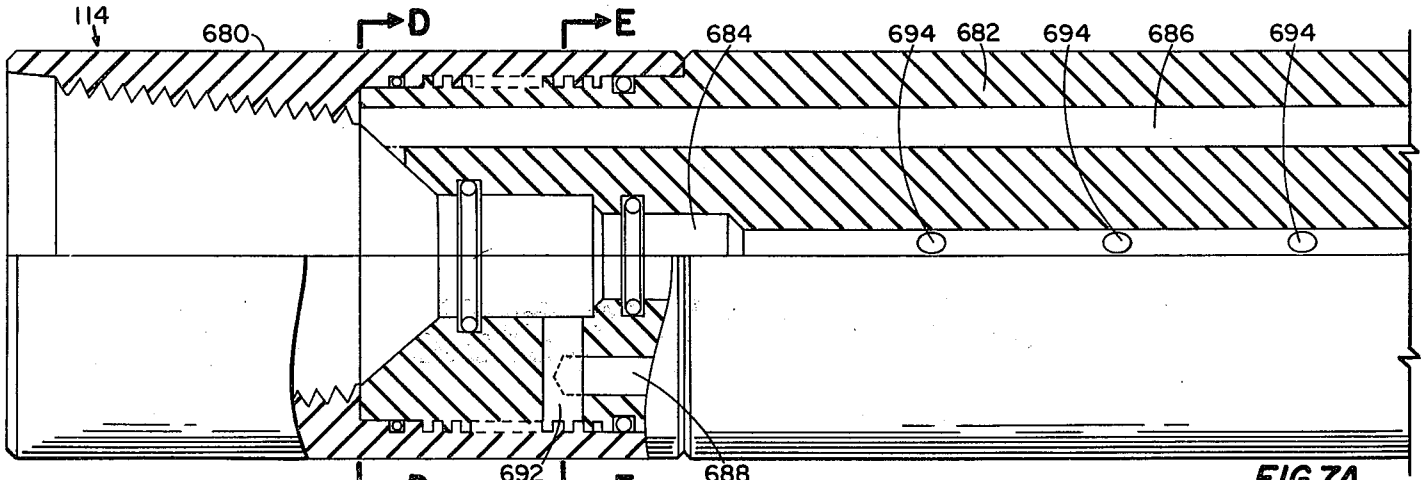
FIGS. 7A–7C illustrate the flow sub in detail in partial cross-section.
Figure 7B:
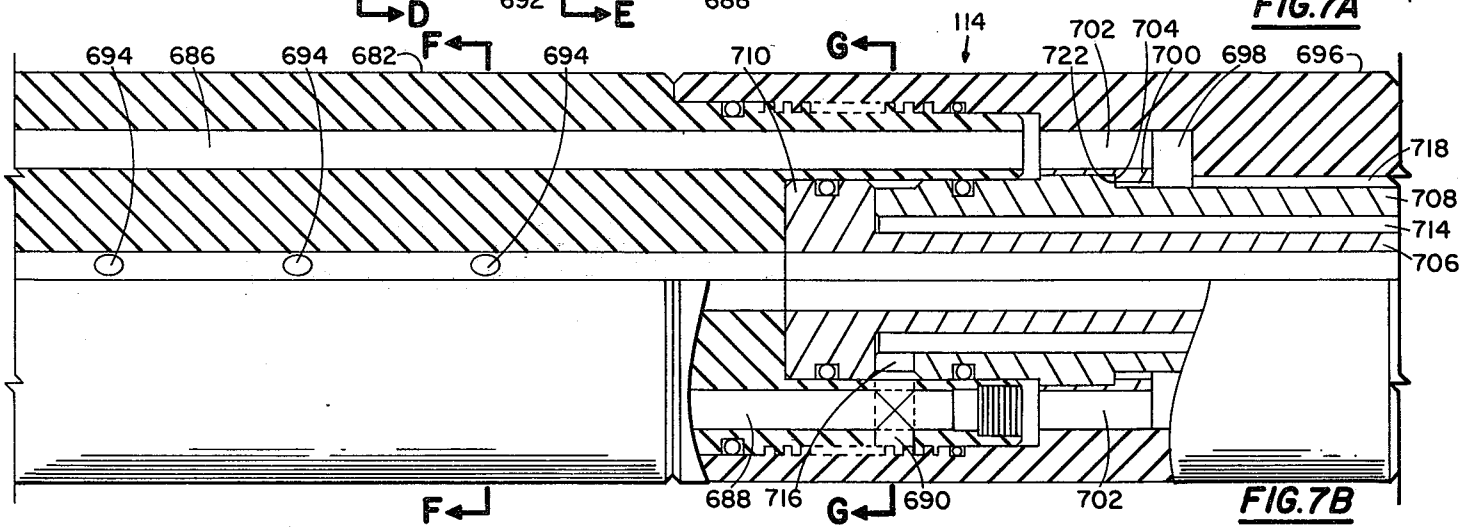
Figure 7D:
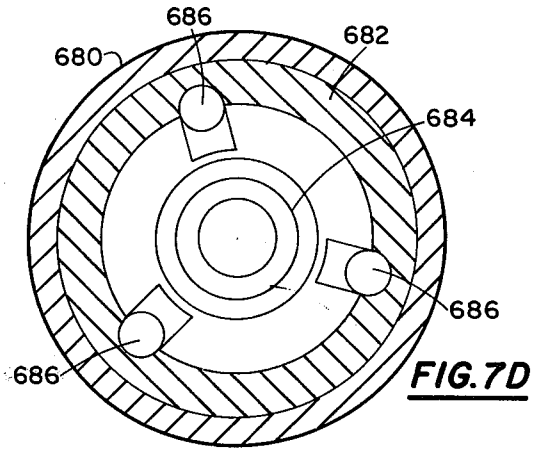
FIG. 7D is a cross-section taken at D—D in FIG. 7A.
Figure 7C:
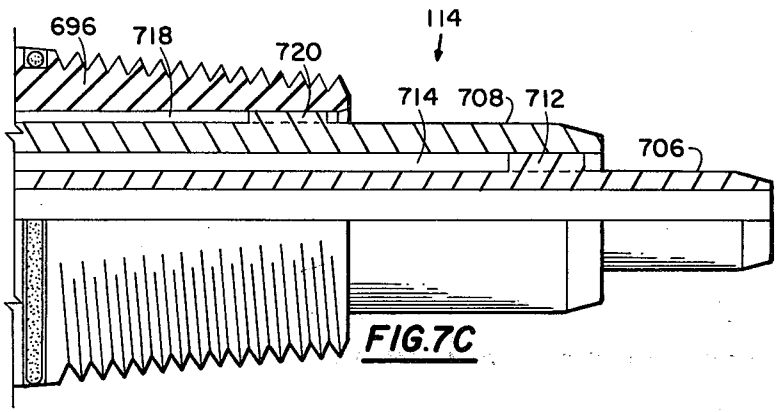
Figure 7G:
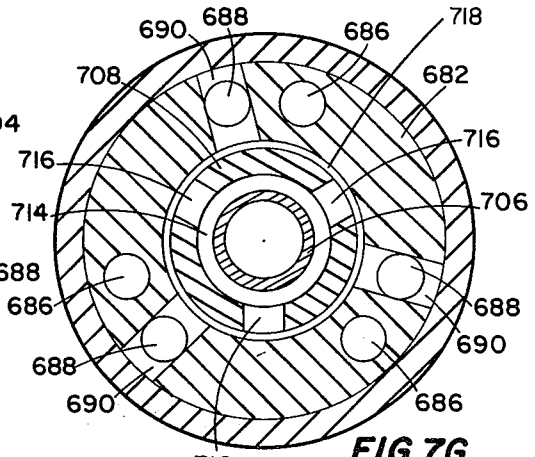
FIG. 7G is a cross-section taken at G—G in FIG. 7B.
Figure 7F:
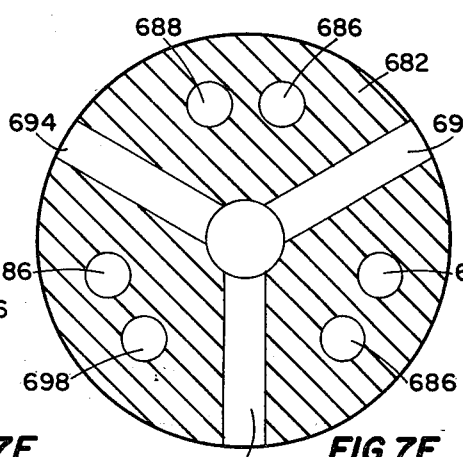
FIG. 7F is a cross-section taken at F—F in FIG. 7B.
Figure 7E:
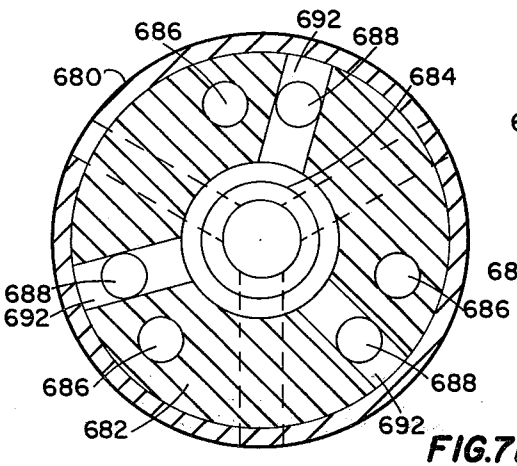
FIG. 7E is a cross-section taken at E—E in FIG. 7A.

A bottom connector 696, internally threaded near its top end may threadedly engage the lower end of flow sub body 682. Conventional O-rings carried by the flow sub body 682 and bottom connector 696 may be used to provide seals therebetween. The bottom end of bottom connector 696 is preferably externally tapered and threaded and a conventional O-ring carried in a groove near the upper termination of the threads (FIG. 7G).

A groove 698 (FIG. 7B) may be formed in the internal diameter of the bottom connector 696 thus providing a collar 700 about midway along the length of the connector. Axially extending fluid passageways 702 may extend through the collar 700 so as to be in fluid communication with inflation fluid passageways 686 in flow sub body 682 and groove 698 in bottom connector 696. The inner diameter of collar 700 is preferably reduced for about half of its axial length, thus forming an upwardly facing shoulder 704.

The internal bore near the bottom end of flow sub body 682 may be enlarged so as to surround an inner stinger 706 and outer stinger 708. The upper end of inner stinger 706 may terminate in a collar 710 and a conventional O-ring carried by the collar 710 used to provide a seal between it and the internal diameter of flow sub body 682. Outer stinger 708 preferably surrounds inner stinger 706 and is spaced therefrom by means such as a spider 712 on inner stinger 706 located near the bottom end thereof.

The spacing between the outer diameter of inner stinger 706 and the inner diameter of outer stinger 708 may be used as a by-pass passageway 714. By-pass passageway 714 may be in fluid communication with by-pass ports 690 in the wall of the lower end of flow sub body 682 by any suitable means such as slots 716 cut into the upper end of inner stinger 706. To ensure that a slot 716 will be in fluid communication with the ports 690, the outer diameter near the upper end of inner stinger 706 may be reduced near the slot in order to provide a space between the inner stinger 706 and sub body 682 in the vicinity of ports 690.

Flow sub body 682 preferably surrounds the upper length of outer stinger 708 and a conventional O-ring may be carried by the outer stinger 708 to provide a seal therebetween. A major portion of the length of the outer stinger 708 may be reduced in diameter so that the outer surface thereof is spaced from the inner diameter of bottom connector 696 to form an inflation fluid passageway 718. Spacing therebetween may be maintained by any suitable means such as a spider 720 located on the outer diameter of outer stinger 708.

The preferred reduction in the outer diameter of outer stinger 708 allows the formation of a downwardly facing shoulder 722 on outer stinger 708. When the flow sub is made up, upwardly facing shoulder 704, on collar 700 of the bottom connector 696, bears against downwardly facing shoulder 722 on outer stinger 708. This forces outer stinger 708 upwardly and causes the upper end thereof to bear against the lower face of collar 710 on the upper end of inner stinger 706. This, in turn, forces the upper face of the collar 710 against the lower end of the reduced diameter portion of flow sub body 682.

Cross sections taken at D—D, E—E, F—F, and G—G shown in FIGS. 7D, 7E, 7F, and 7G, respectively, show the relationship of the by-pass passageways, inflation fluid channels, and flow ports in the flow sub 114.

Flow Sub 114 Operation

The function of the flow sub is to allow well fluid from a test formation annulus to flow into the testing tool bore. Well fluid flows through the flow ports 694 from the annulus into the bore, i.e., hollow interior of the flow sub.

The flow sub also contains the inflation channel which is used in the case of a two packer straddle test and the by-pass channel. The inflation fluid channel comprises passageways 686 in flow sub body 682, passageways 702 in collar 700 on bottom connector 696, and passageway 718 between the outer diameter of outer stinger 708 and the inner diameter of bottom connector 696.

The by-pass channel comprises by-pass ports 692, passageways 688, and by-pass ports 690, all in flow sub body 682, slots 716 in the upper end of inner stinger 706, and passageway 714 between the outer surface of inner stinger 706 and the inner diameter of outer stinger 708.

Recorder Subs 116 and 118

The recorder subs 116 and 118 are preferably connected in line below the flow sub 114. Two recorder subs are commonly used so that if one of the recorders malfunctions, it is unnecessary to pull the entire testing tool out of a hole to replace it. However, one recorder sub could be used if desirable or necessary. In any event, recorder subs 116 and 118 may be identical and only recorder sub 116 will be explained in detail for the purposes of describing the present invention. It should be borne in mind by the viewer that the end portions of sub 116 are shown on a section taken along a line A—A in FIG. 8C, while the central portion of the sub (in FIGS. 8A and 8B) is shown on a section taken along a line B—B in FIG. 8C.

Figure 8C:
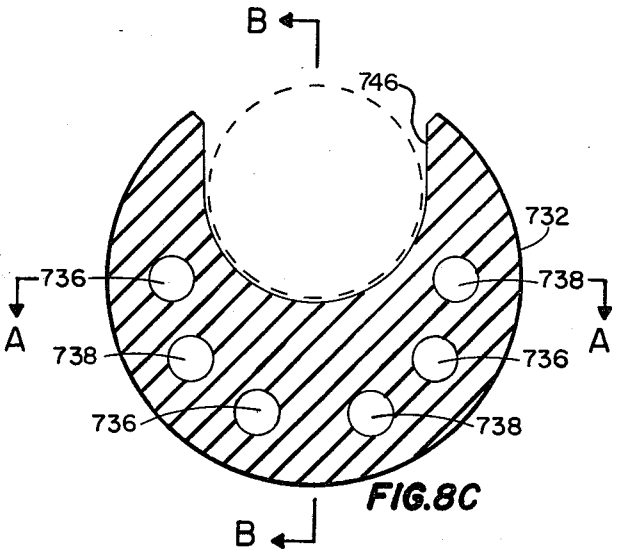
FIGS. 8A–8C illustrate a recorder sub in partial cross-section with the ends of the sub taken at A—A in FIG. 8C and the center at B—B in FIG. 8C, FIG. 8C being a cross-section taken at C—C in FIG. 8B.
Figure 8A:
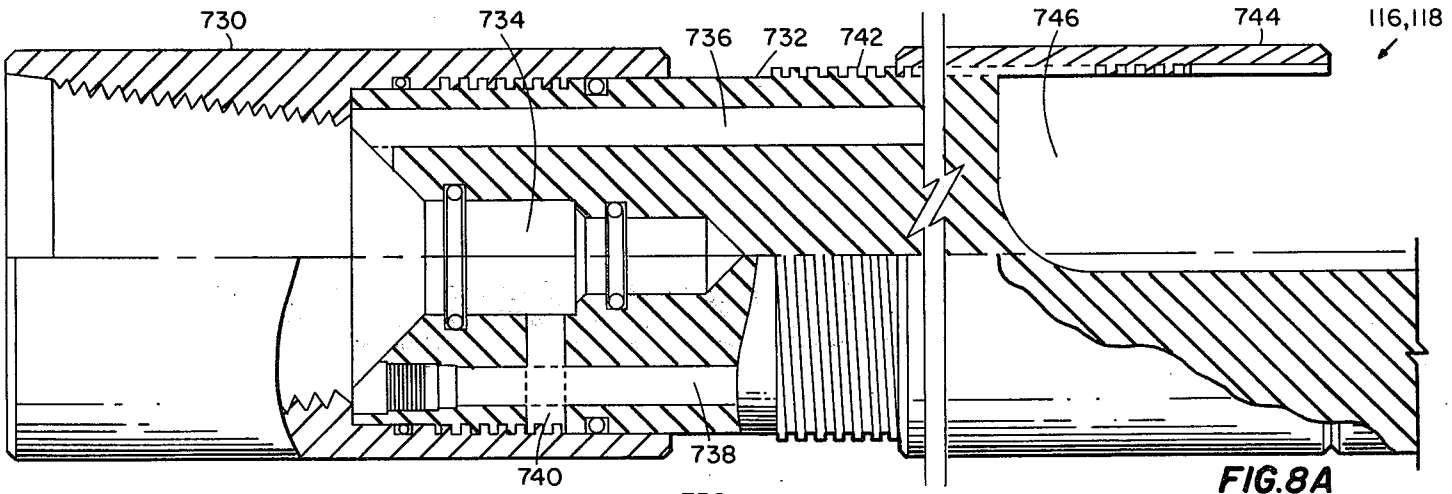
Figure 8B:
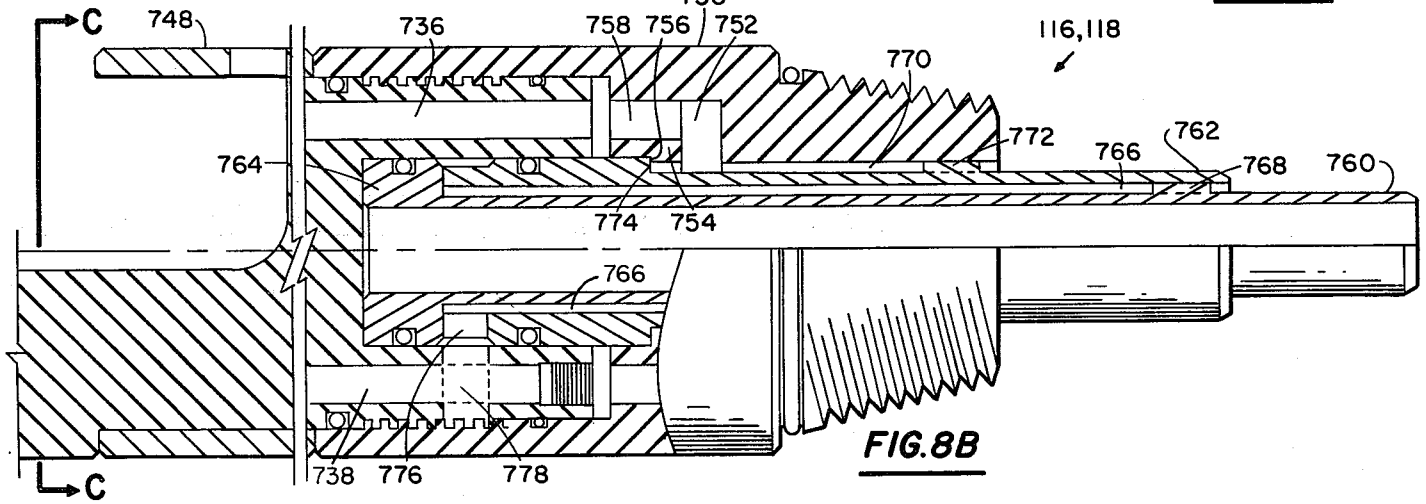

The preferred embodiment of recorder sub, shown at 116 in cross-section FIGS. 8A–8C, comprises a top connector 730, internally tapered and threaded near the top end and externally threaded near the bottom end. The cross-section has been rotated along the axial length of the recorder sub to show the recorder cavity as well as the fluid passageways.

A recorder body 732, with a hollow upper end externally threaded near the top and bottom ends may be threadedly engaged to the bottom end of top connector 730. Conventional O-rings may be used to seal the top connector 730 and the recorder body 732.

A conventional O-ring, may be carried on the internal diameter of the recorder body 732 near its upper end to seal it to the outer stinger 708 of the flow sub 116 (FIG. 7C) when a testing tool is made up.

The internal diameter of the recorder body 732 may be reduced and terminated in an inner stinger receiver 734. A conventional O-ring may seal the inner diameter of the inner stinger receiver 734 and the inner stinger 706 of the flow sub 116 (FIG. 7C) when a tool is made up.

Inflation fluid passageways 736 and by-pass passageways 738 may be formed to extend axially in the wall of the recorder body 732 from top to bottom thereof. The upper and lower ends of by-pass passageways 738 may be plugged as shown. The upper ends of by-pass passageways 738 also terminate in by-pass ports 740 formed radially through the wall of recorder body 732.

The recorder body may be additionally threaded as at 742. A sleeve 744, internally threaded near its upper end, may be turned onto the threads 742 when a recorder sub is made up.

The major length of the recorder body 732 is preferably hollowed out to form a recorder cavity 746. The lower length of sleeve 744 may overlie the upper portion of cavity 746 and the lower portion of the cavity 746 may also be surrounded by a sleeve 748 which may be welded or otherwise suitably fixed to the recorder body 732. The preferred relationship of the inflation fluid passageways 736, by-pass passageways 738, and recorder cavity 746 is shown in FIG. 8C, a cross-section taken at C—C in FIG. 8B.

A hollow bottom connector 750, internally threaded near its upper end may threadedly engage the lower end of thw recorder body 732. Conventional O-rings may seal the recorder body 732 and bottom connector 750 against one another. The lower end of the bottom connector 750 may be externally tapered and threaded and include a conventional O-ring at the upper termination of the threads.

A circumferential slot 752 may be formed in the internal diameter of the bottom connector 750 approximately midway along its length, thus forming a collar 754. The internal diameter of approximately half the length of the collar 754 may be reduced, forming an upwardly facing shoulder 756 on collar 754. Axially extending inflation fluid passageways 758 may extend through the collar 754 so as to be in fluid communication with slot 752 and passageways 736 in body 732.

The lower end of the recorder body 732 may extend surround the upper ends of an inner stinger 760 and outer stinger 762. Inner stinger 760 may terminate, at its upper end, in a collar 764 bearing against the internal diameter of body 732. A conventional O-ring can be used to provide a seal between the collar and the recorder body 732.

Outer stinger 762 may surround the major length of inner stinger 760 and be spaced therefrom to provide a by-pass passageway 766 therebetween. Spacing between the lower end of outer stinger 762 and inner stinger 760 may be maintained by a spider 768 formed on the external diameter of inner stinger 760.

Sealing may be accomplished between the upper end of the outer stinger 762 and the internal diameter of recorder body 732 by means of a conventional O-ring as shown. The lower length of outer stinger 762 may be reduced in diameter to provide an inflation fluid passageway 770 between it and the inner diameter of the bottom connector 750. A spider 772 on the outer diameter of the outer stinger 762 may be provided to maintain the spacing between the stinger and bottom connector 750. The reduction in diameter of the outer stinger 762 also generates a downwardly facing shoulder 774.

When the recorder sub is made up, upwardly facing shoulder 756 on collar 754 will bear against downwardly facing shoulder 774 on outer stinger 762. This in turn causes the upper end of outer stinger 762 to bear against the lower face of collar 764 on inner stinger 760, thereby retaining the upper face of the collar 764 against the end of the enlarged bore in recorder body 732.

The upper end of inner stinger 760 is preferably chamfered and slotted as at 776. Fluid communication between the slots 766 and by-pass passageways 738 in the recorder body may be provided by by-pass ports 778 formed radially through the wall of recorder body at the lower end thereof.

Recorder Sub 116 Operation

One of the objectives of a drill stem test is to obtain a permanent record of various data on the test zone, using down-hole recording instruments. In the present invention, a Kuster AK-1 Recorder, or any similar or otherwise suitable device, may be housed in the recorder cavity 746 and retained therein by means of upper sleeve 744 and lower sleeve 748. The recorder shown is referred to as an "outside recorder" in that it records data from outside the testing tool in the well annulus.

The recorder sub may also contain an inflation channel and a by-pass channel, both running through its length. The inflation channel shown comprises passageways 736 in body 732, passageways 758 in collar 754, slot 752 on bottom connector 750, and passageway 770 between outer stinger 762 and the inner diameter of bottom connector 750.

The by-pass channel may comprise top-end by-pass ports 740, passageways 738, bottom-end by-pass ports 778 (all in recorder body 732), slots 776 in the upper end of inner stinger 760, and passageway 766 between inner stinger 760 and outer stinger 762.

Straddle By-Pass Extension 120

Astraddle by-pass extension is an optional module to be used when additional spacing between packers 112 and 122 is required over that normally supplied by flow sub 114 and recorder subs 116 and 118. If used, a straddle by-pass extension such as is shown at 120 connected to the bottom end of recorder sub 118 in the testing tool.

Figure 9A:
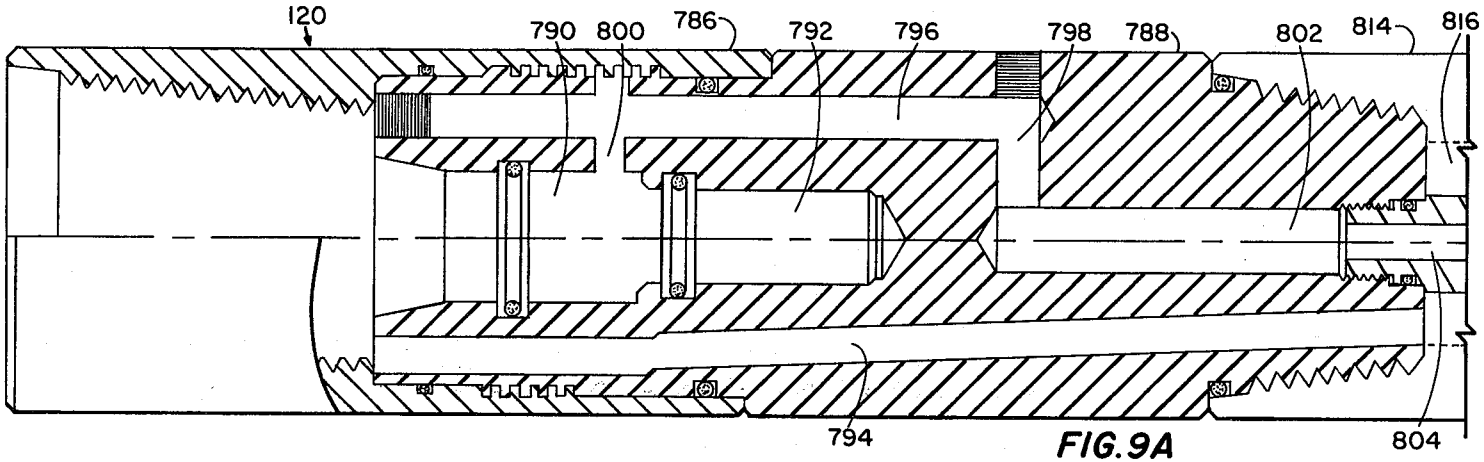
FIGS. 9A–9C illustrate the straddle by-pass extension in detail in partial cross-section.
Figure 9B:
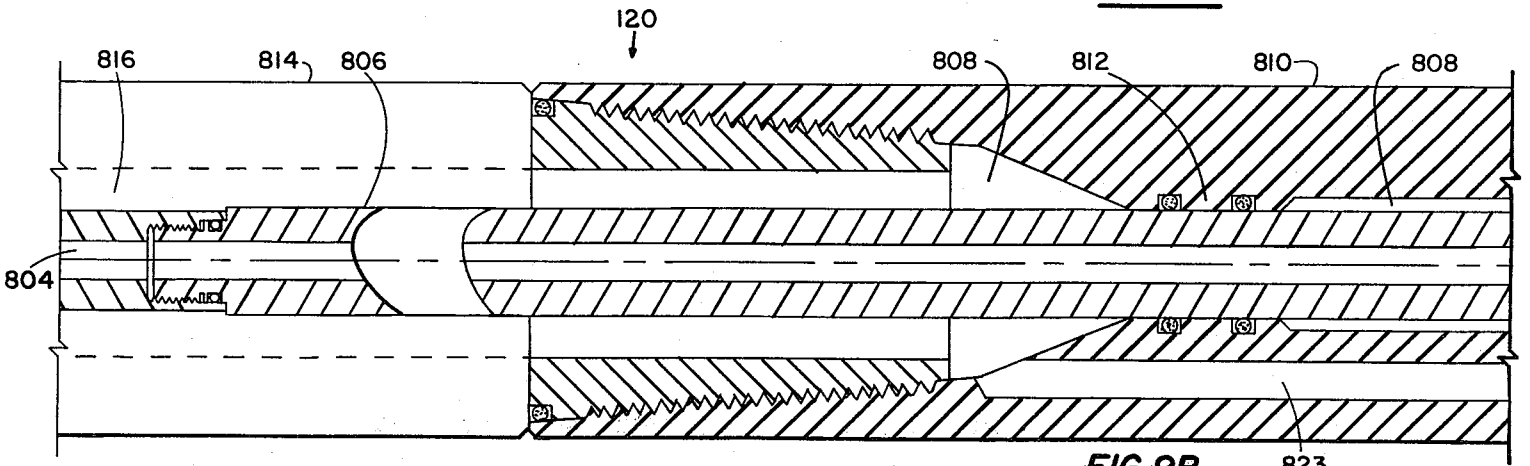
Figure 9C:
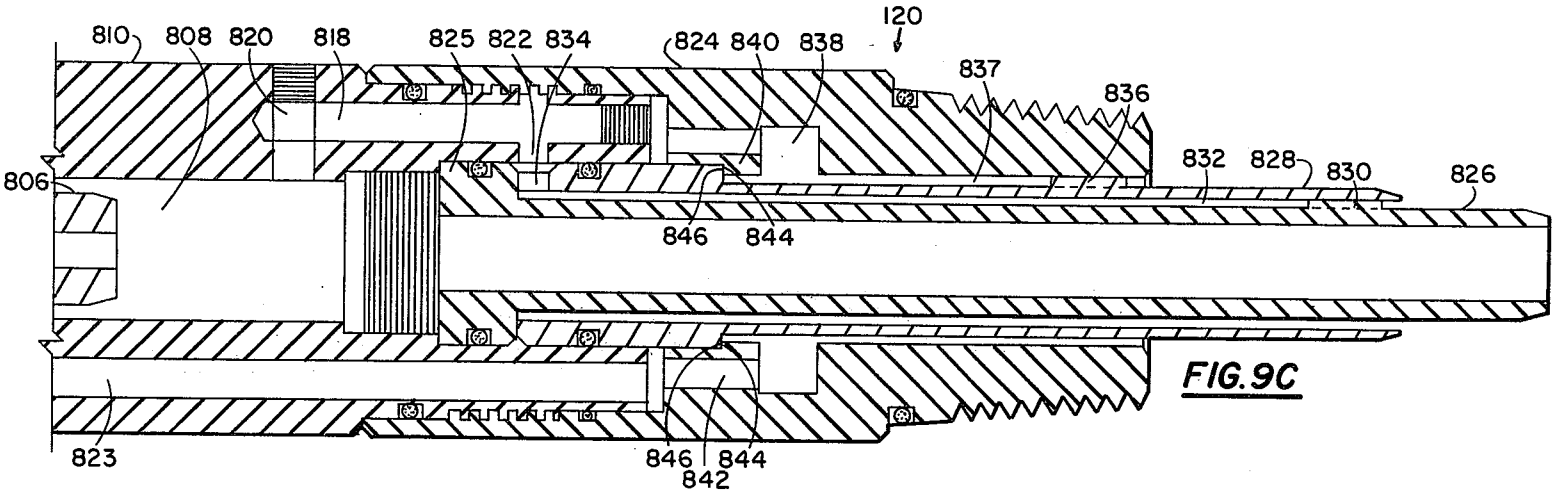

The illustrated straddle by-pass extension is shown in cross-section in FIGS. 9A–9C and comprises a hollow top connector 786, internally tapered and threaded near its top end and internally threaded near its bottom end.

A hanger sub 788, externally threaded near its upper end and externally tapered and threaded near its lower end, may threadedly engage the lower end of top connector 786. Conventional O-rings may sear the top connector 786 to the hanger sub 788 as shown. A conventional O-ring may be located near the bottom end of the hanger sub in a groove near the upper termination of the threads.

The upper end of the hanger sub 788 may be internally recessed, as at 790 and 792, to receive outer and inner stingers 762 and 760 respectively (FIG. 8B), of recorder sub 118. As shown, conventional O-ring in recess 790 may seal the outer stinger 762 of recorder sub 118 against hanger sub 788 and another O-ring in recess 792 may also seal inner stinger 760 of the recorder sub 118 against the hanger sub.

The wall of the hanger sub 788 may be provided with generally axially oriented inflation fluid passageways 794 which extend from top to bottom. By-pass passageways 796 may also be provided in the wall of the hanger sub 788 to extend from near the top end to about half the length thereof. The upper ends of the by-pass passageways 796 may be suitably plugged as shown.

The lower ends of the by-pass passageways 796 preferably terminate in by-pass ports 798 formed radially between the outer surface of the hanger sub 788 and the center line thereof. The outer ends of ports 798 may be conventionally plugged as shown. Additional openings 800 may be formed through the wall of the hanger sub 788 near the upper end thereof and to intersect the by-pass passageways 796 so that fluid communication is thus established with recess 790.

A central by-pass passageway 802 may be formed on the central axis of the hanger sub 788 from the bottom end thereof, terminating at by-pass ports 798 and below recess 792. The central by-pass passageway 802 may be threaded near its bottom end as shown.

By-pass pipe 804, externally threaded near its top end and internally threaded near its bottom end may be fastened into the bottom end of the central by-pass passageway 802 in the hanger sub 788 as shown. Any number of by-pass pipes 804 may be used, depending upon the desired spacing between packers 112 and 122. A conventional O-ring may be used to seal pipe 804 and the hanger sub 788 as shown.

A hollow hanger sub stinger 806 externally threaded near its upper end and externally chamfered near its lower end, may be threaded into the bottom end of the bottom end of the lowest section of by-pass pipe 804 used; a conventional O-ring may serve as a seal between it and the by-pass pipe 804.

The lower length of hanger sub stinger 806 may extend into a hollow interior 808 of a receiver body 810 which is internally tapered and threaded near its upper end. As shown in FIG. 9B, the hollow interior 808 may be reduced in diameter near the center of the receiver body to form a collar 812 which bears against the exterior surface of hanger sub stinger 806. Two conventional O-rings shown may be used to provide a seal between the collar and stinger 806.

The receiver body 810 may be spaced from hanger sub 788 and joined thereto by means of hollow drill collars 814, internally tapered and threaded near their upper ends and externally tapered and threaded near their lower ends. Conventional O-rings may be carried in grooves at the upper termination of the threads on the bottom ends of the collars. The number of drill collars 814 used is determined by the necessary extension in length required between the upper packer 112 and lower packer 122. The internal diameter of the drill collars 814 is preferably much greater than the external diameter of the by-pass pipes 804 and hanger sub stinger 806, thus providing an inflation fluid passageway 816 therebetween.

The hollow interior 808 of receiver body 810 may be internally threaded near its lower end and plugged with a conventional pipe plug as shown. in this embodiment, the interior 808 is in fluid communication with axial by-pass passageways 818 near the bottom end of receiver body 810 via radially extending by-pass ports 820.

The internal diameter of the lower end of receiver body 810 may be enlarged in diameter to receive a stinger 826, as shown. Radial openings 822 may be formed near the lower ends of by-pass passageways 818. In addition, axially extending inflation fluid passageways 823 may be provided in the wall of receiver body 810 to extend the length thereof.

The lower end of receiver body 810 may be externally threaded near its lower end thereof. A hollow bottom connector 824, internally threaded near its upper end and externally tapered and threaded near its lower end may be threadedly engaged with the lower end of the receiver body 810.

Conventional O-rings may seal the receiver body 810 to the bottom connector 824 as shown. Another conventional O-ring may be carried in a groove near the upper termination of the external threads on the lower end of bottom connector 824.

The enlarged internal diameter near the lower end of receiver body 810 surrounds a collar 825 on the upper end of the hollow inner stinger 826 and the upper end of a hollow outer stinger 828. An O-ring may seal the collar 825 to the internal diameter of the lower end of receiver body 810 as shown. Another O-ring may seal the outer stinger to the internal diameter of the receiver body 810.

Outer stinger 828 surrounds inner stinger 826 and may be spaced therefrom by any suitable means such as a spider 830 on the inner stinger 826. The space between the inner stinger 826 and the outer stinger 828 comprises a by-pass passageway 832. In addition, the upper end of the outer stinger 828 may be externally chamfered and slotted, as at 834, to provide fluid communication between by-pass passageway 832 and apertures 822 in the wall of the receiver body 810.

The lower portion of bottom connector 824 preferably surrounds a portion of outer stinger 828 which is reduced in diameter and is spaced therefrom by means such as a spider 836 on the outer stinger 828. The spacing therebetween comprises an inflation fluid passageway 837. An internal groove 838 may also be formed in the bottom connector 824, about midway of its length, thus forming a collar 840. Inflation fluid passageways 842 may be provided from the upper face of collar 840 to the bottom face thereof in fluid communication with groove 838 in bottom connector 824 and inflation fluid passageways 823 in the wall of receiver body 810.

The internal diameter of approximately the upper half of collar 840 may be increased in diameter to generate an upwardly facing shoulder 844 which contacts a downwardly facing shoulder 846 on outer stinger 828 formed by the junction of the reduced diameter length of outer stinger 828 and the upper length thereof.

When the straddle by-pass extension 120 is made up, upwardly facing shoulder 844 on collar 840 engages downwardly facing shoulder 846 on the outer stinger 828. This forces the upper end of the outer stinger 828 against the lower face of collar 825 on inner stinger 826, which in turn, forces the upper face of the collar 825 against the top end of the enlarged bore at the bottom end of receiver body 810.

Straddle By-Pass Extension 120 Operation

Basically, the straddle by-pass extension 120 is a device used to increase the spacing between packers 112 and 122 in a straddle packer test. The straddle by-pass extension 120 may be needed in that the length of the formation test zones vary from zone to zone and from well to well, requiring that the packers be spaced accordingly. For a short formation test zone, the straddle by-pass extension 120 would not be required.

In addition to the spacing function, the straddle by-pass extension 120 contains a by-pass flow channel and an inflation flow channel for packer 122. The by-pass flow channel comprises apertures 800, by-pass passageways 796, by-pass ports 798, central by-pass 802 (all in hanger sub 788); the hollow interior of by-pass pipe(s) 804; the hollow interior of hanger sub stinger 806; hollow interior 808, by-pass ports 820, by-pass passageways 818, apertures 822, (all in receiver body 810); slots 834 in the upper end of outer stinger 828; and by-pass passageway 832 between inner stinger 826 and outer stinger 828.

The inflation flow channel comprises inflation fluid passageways 794 in hanger sub 788, inflation fluid passageway 816 between the by-pass pipe(s) 804 and collar(s) 814, the opening between the hanger sub stinger 806 and collar(s) 814, inflation fluid passageways 823 in receiver body 810, inflation fluid passageways 842 in collar 840 on bottom connector 824, groove 838 in bottom connector 824, and inflation fluid passageway 837 between outer stinger 828 and bottom connector 824.

Drag Spring Unit 124

Figure 10C:
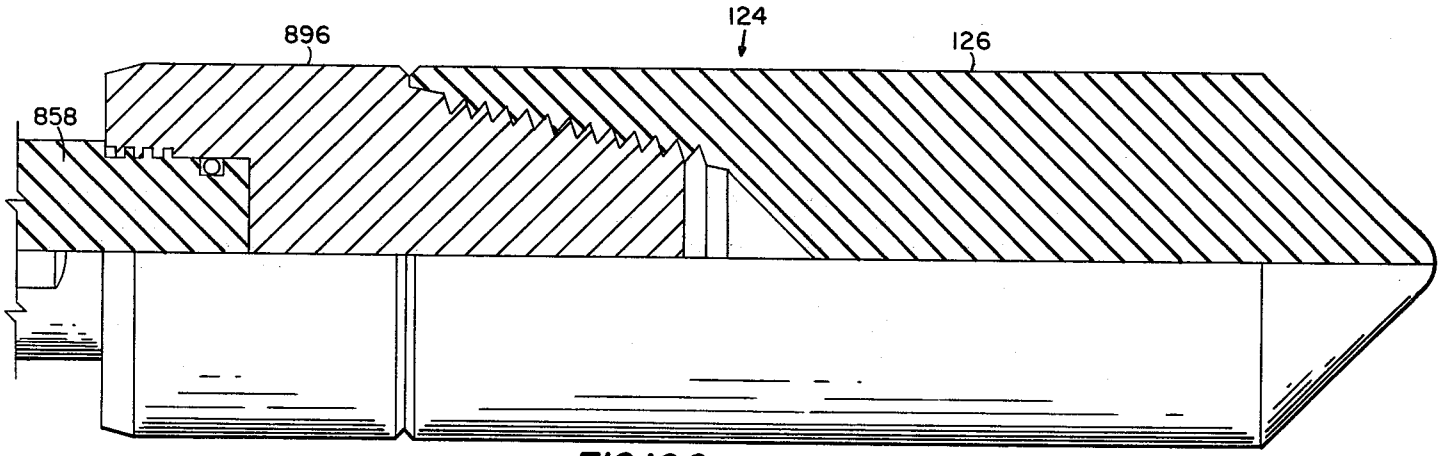
FIGS. 10A–10C illustrate the drag spring in detail in partial cross-section.

The drag spring unit 124 preferably threads onto the bottom end of lower packer 122 in FIG. 1C and terminates in bull nose 126 as shown in FIG. 10C. The drag spring unit provides the resistance to turning necessary for pump subassembly 104 to operate through rotation of the drill string above it. If there were no resistance, the entire testing tool would spin freely and there would be no pumping action.

Figure 10A:
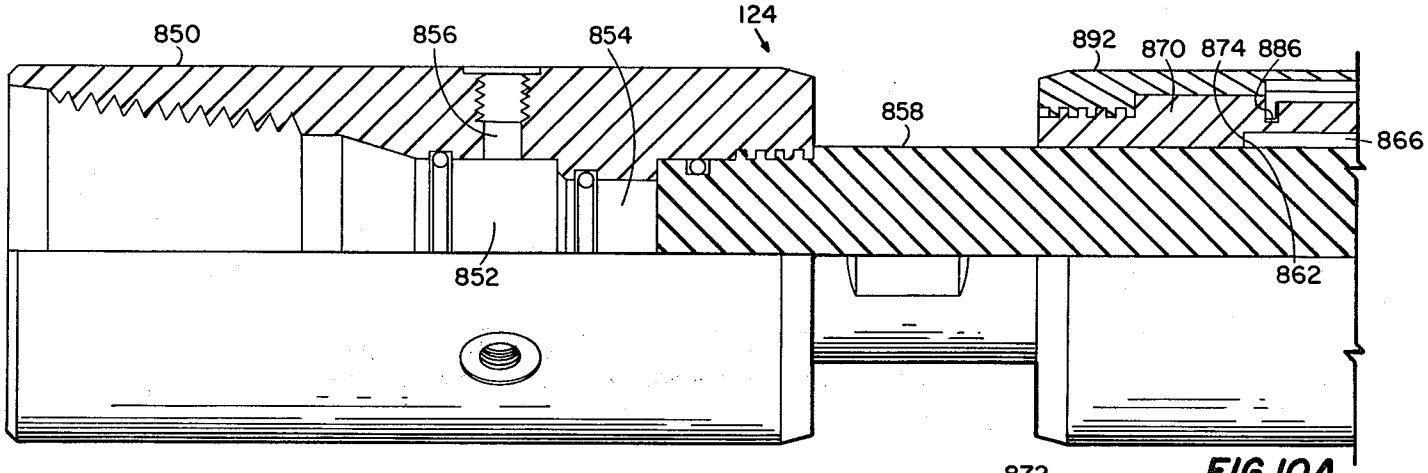
Figure 10B:
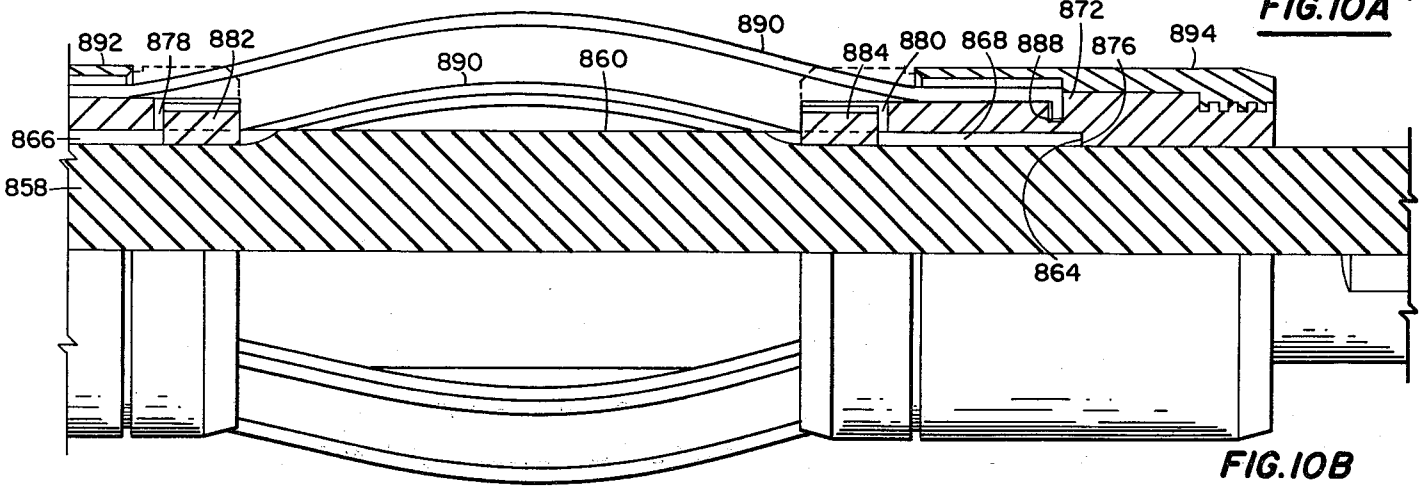

The drag spring unit 124 and bull nose 126 are shown in detail in partial cross-section of FIGS. 10A–10C and include a hollow top sub 850 internally tapered and threaded near its top end and internally threaded near its bottom end. Two internal cavities as at 852 and 854 may be included within the top sub 850 to accommodate the outer stinger and inner stinger respectively, of the single packer in a single packer test or of the lower packer in a straddle packer test. Conventional O-rings may be used to seal and the inner stinger of the packer to the top sub.

Radially extending by-pass ports 856 may be formed in the wall of the top sub 850 in fluid communication with cavity 852 and arranged so that their outer ends may be plugged in the case of a single packer test.

A mandrel 858, externally threaded near its top and bottom ends preferably engages the bottom end of top sub 850. The upper and lower lengths of the mandrel may be reduced in diameter, with a central length 860 of greater diameter. The junctures of the central length 860 with the upper and lower lengths of the mandrel 858 generate shoulders 862 and 864 respectively. The mandrel 858 may also be slotted near the upper and lower ends of the central length 860 as at 866 and 868, respectively. There are, preferably, two slots, spaced 180° apart at each end of the mandrel.

Upper and lower collars 870 and 872, externally threaded near their upper and lower ends, respectively, surround the mandrel 858 and may be adapted to slide up and down with respect thereto. The internal diameter of the collars 870 and 872 may be stepped, for example, such that a length of reduced diameter surrounds a length of reduced diameter mandrel, and a length of enlarged diameter surrounds approximately the length of the slots in the enlarged diameter central portion 860 of the mandrel 858. The steps in the internal diameters of the upper collar 870 and lower collar 872 generate shoulders 874 and 876, respectively.

The lower end of upper collar 870 may be slotted, as at 878, and the upper end of lower collar 872 may be slotted, as at 880. Upper collar keys 882 ride in slots 866 at the upper end of mandrel central length 860 and slots 878 in the lower end of the upper collar 870. Lower collar keys 884, in turn, ride in slots 868 at the lower end of mandrel central length 860 and slots 880 in the upper end of lower collar 872. The keys prevent rotation of the collars with respect to the mandrel. Of course, only one set of slots and keys have been shown for each collar, although two or more sets may be used, if desired.

The outer diameter of the upper and lower collars 870 and may also be grooved as at 886 and 888, respectively, to receive the respective upper and lower ends of drag springs 890 which span the mandrel central length 860. Although six such springs may preferably be employed, it is only required that a number be used to appropriately prohibit rotation.

An upper retainer 892, internally threaded near its upper end, may threadedly engage the upper end of upper collar 870 and surround a length of the upper collar 870, groove 886, and the upper end of the drag springs 890.

A lower retainer 894, may be internally threaded near its lower end, to engage the lower end of lower collar 872, thus surrounding a length of the lower collar 872, groove 888, and the bottom end of drag springs 890.

A bottom sub 896, internally threaded near its upper end and externally tapered and threaded near its bottom end, may engage the bottom end of the mandrel 858 as shown. An O-ring may seal the mandrel 858 the bottom sub 896.

Finally, the drag spring unit 124 preferably terminates in the bull nose 126, which is preferably internally tapered and threaded near its upper end to engage the bottom end of bottom sub 896.

Drag Spring Unit 124 Operation

The operation of this preferred embodiment of drag spring unit 124 is such that when the testing tool is in a well, drag springs 890 are compressed into the diameter of the well annulus and thus drag against the well annulus at all times.

A unique feature of the present drag spring unit is that the drag springs 890 are always pulled, whether running into or out of a well. Drag springs 890 are pulled into a well by the combination of lower collar 872 and lower retainer 894 when running in due to downwardly facing shoulder 864 on mandrel 858 bearing against upwardly facing shoulder 876 on lower collar 872. Conversely, drag springs 890 are pulled out of a well by the combination of upper collar 870 and upper retainer 892 when coming out of a well due to upwardly facing shoulder 862 on mandrel 858 bearing against downwardly facing shoulder 874 on upper collar 870.

When running in, upper retainer 892 and upper collar 870 are free to slide upwardly with respect to mandrel 858. When coming out, lower retainer 894 and lower collar 872 are free to slide downwardly with respect to mandrel 858.

Hydraulic Main Valve 102

The hydraulic main valve 102 is, essentially, an on-off valve for controlling flow and shut-in testing of the zone(s) of interest in a well. In addition, the hydraulic main valve 102 of this preferred embodiment also contains a sample chamber for trapping and holding a fluid sample from a test zone.

The hydraulic main valve 102 is preferably installed into the complete testing tool between the lower end of the drill string 100 and the upper end of the pump assembly 104, as shown in FIG. 1A.

The preferred embodiment of the hydraulic main valve 102 is shown in detail in FIGS. 11A–11F and includes a hollow top sub 900 internally tapered and threaded near its upper end and internally threaded near its bottom end. The bottom end of the top sub 900 threadedly engages the externally threaded top end of a cam mandrel 902 as shown.

Figure 11A:
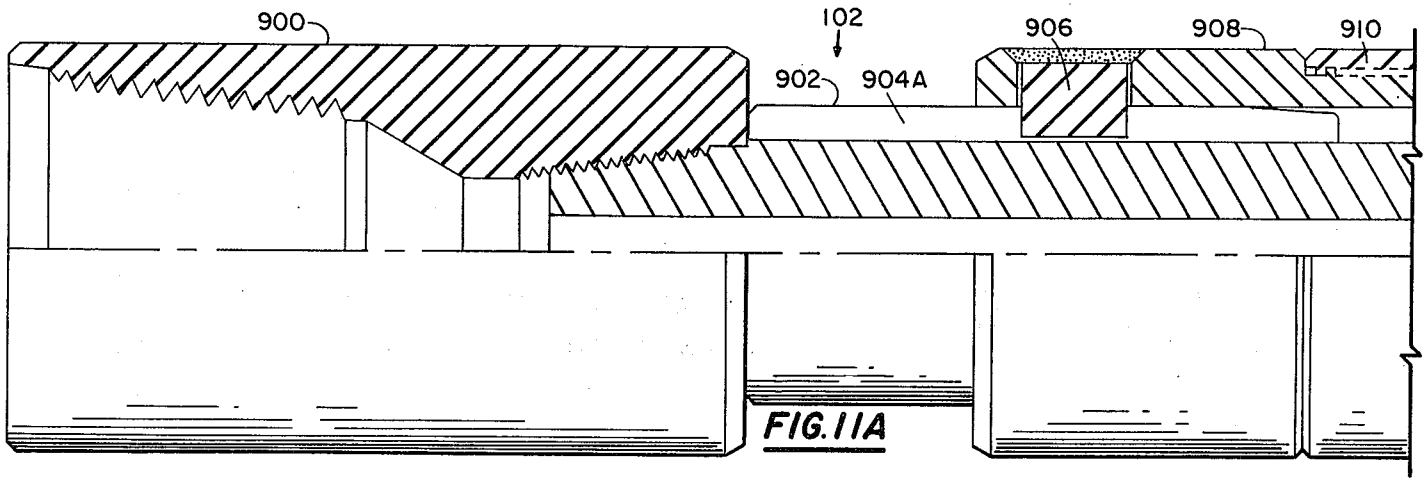
FIGS. 11A–11F illustrate the hydraulic main valve in detail in partial cross-section.
Figure 11B:
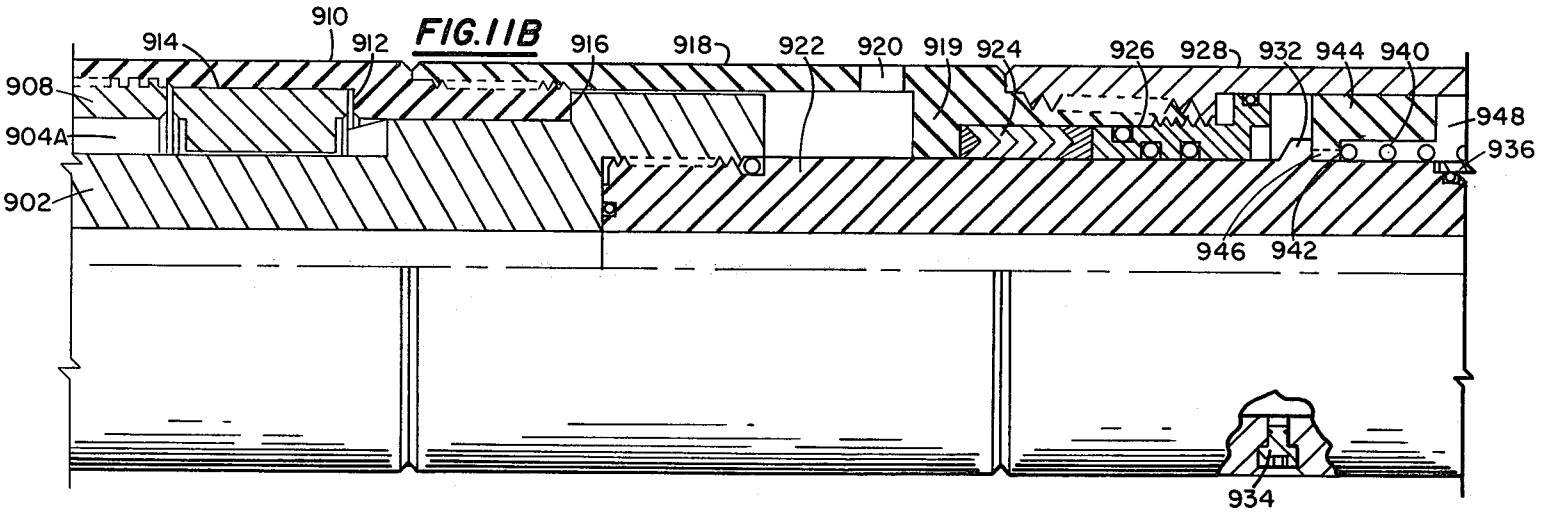
Figure 11C:
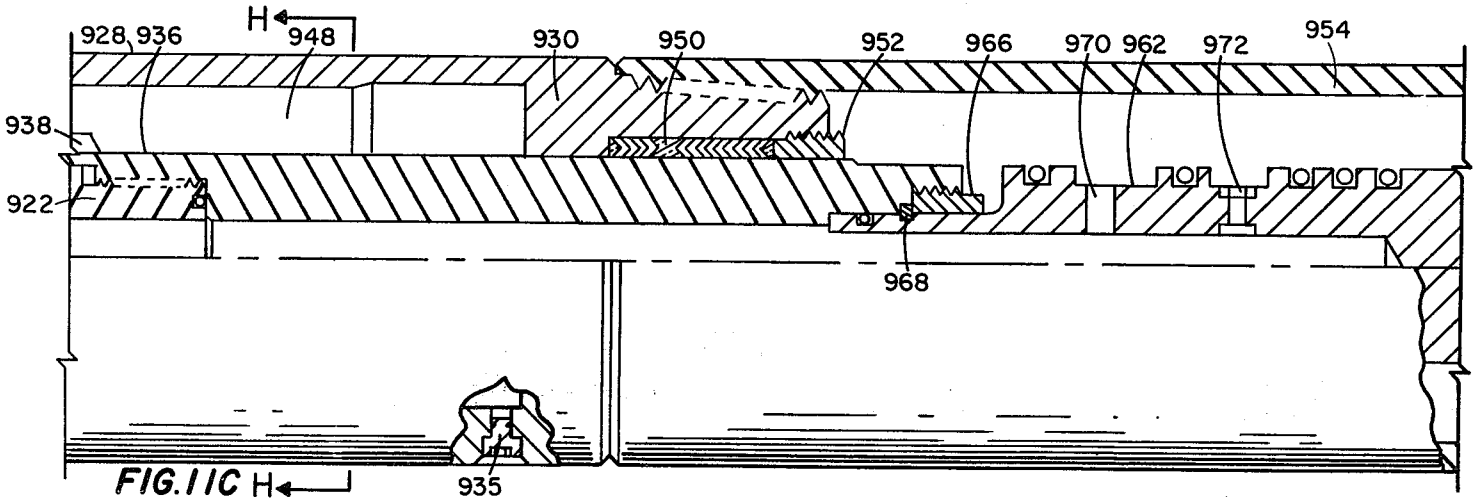
Figure 11D:
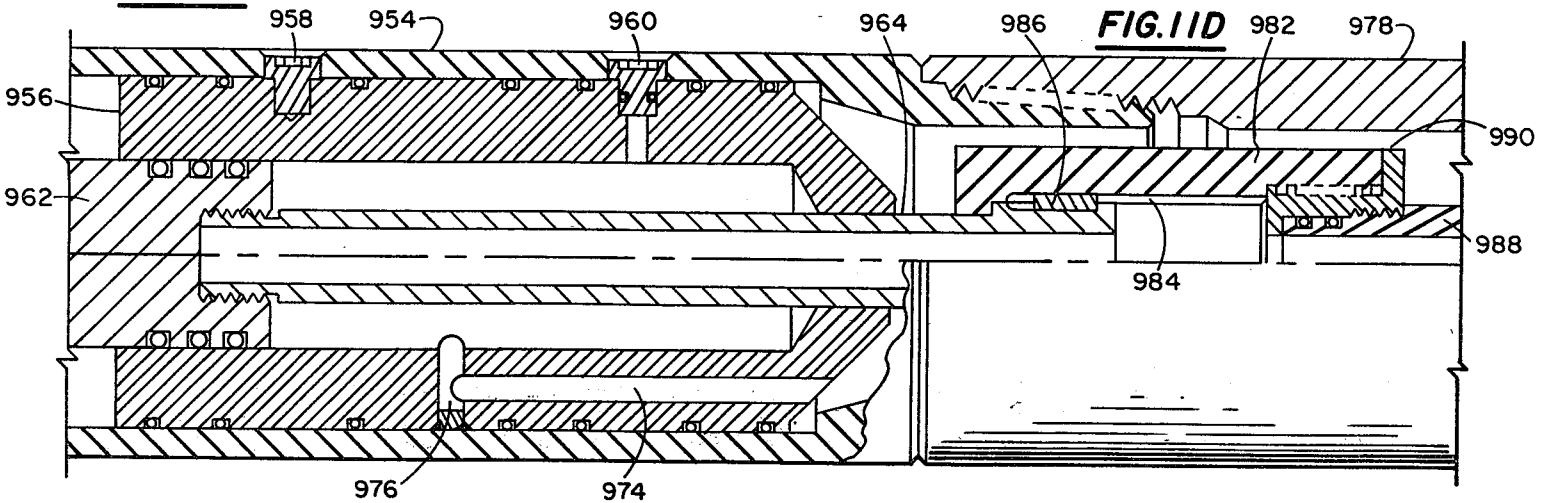
Figure 11E:
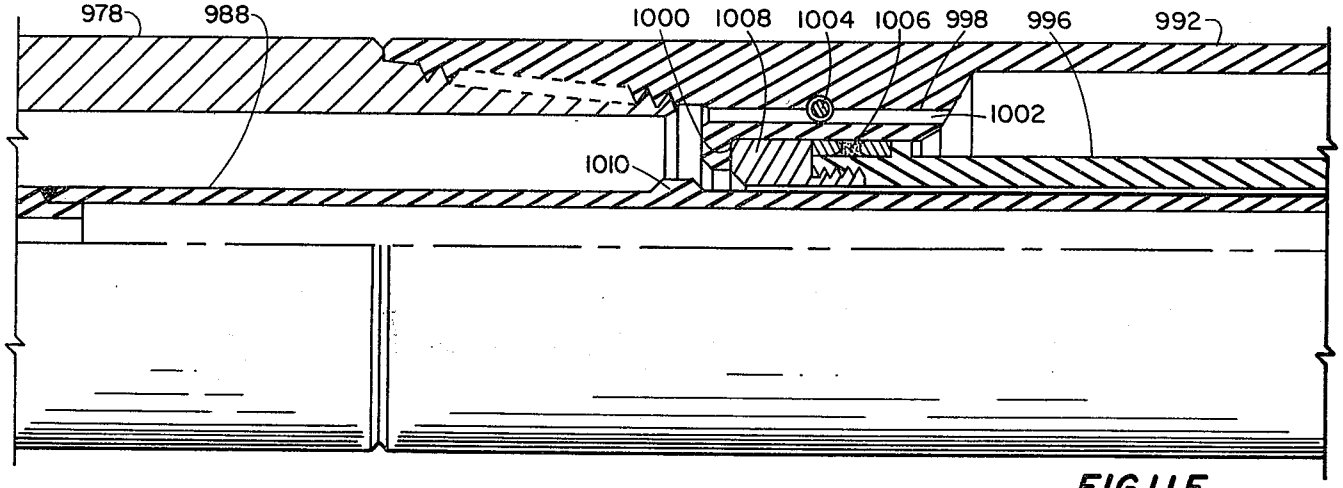
Figure 11F:
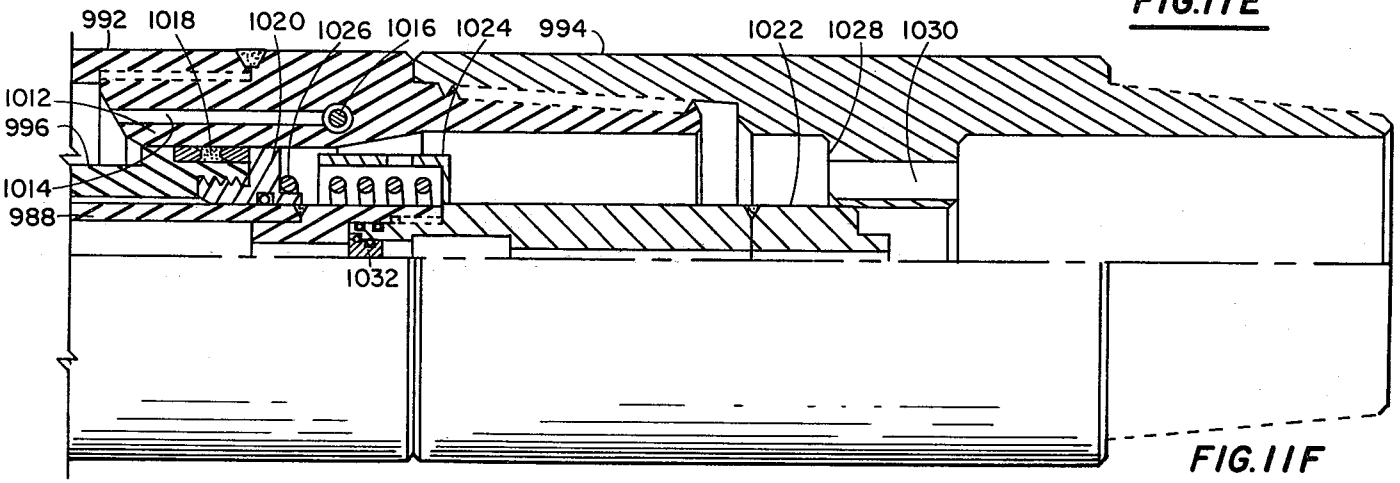
Figure 11G:
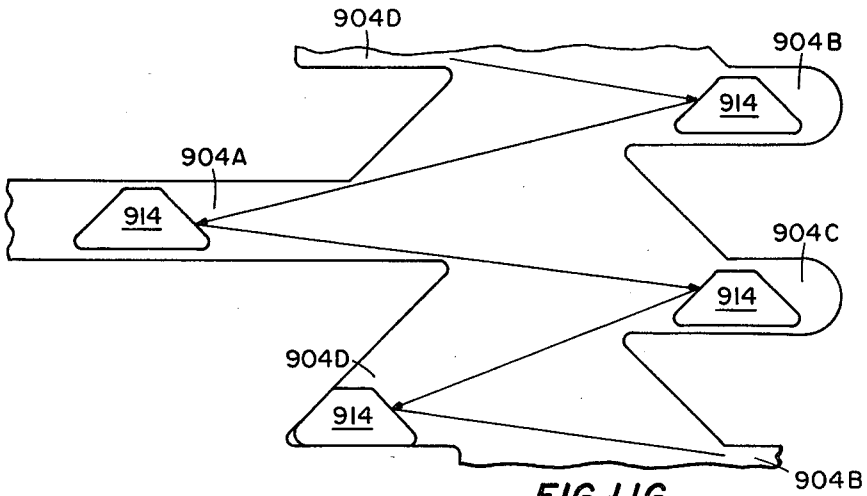
FIG. 11G is the pattern on cam mandrel 902 in the hydraulic main valve.

The cam mandrel 902 may have a J-slot cam pattern formed on the outer surface thereof as shown in FIG. 11G. Part of the cam pattern is a slot 904A in which rides, at all times, a key 906.

Key 906 may be welded or otherwise suitably attached to a hollow, keyed sleeve 908 which surrounds cam mandrel 902. The lower end of keyed sleeve 908 may be externally threaded so as to be attached to the internally threaded upper end of a lug ring housing 910.

The lug ring housing 910 may be externally threaded near its lower end and may have a stepped internal diameter, thus forming an upwardly facing shoulder 912.

Surrounding the cam mandrel 902 and riding in the J-slot cam pattern, is a lug ring 914. Lug ring 914 is preferably constrained between the lower end of keyed sleeve 908 and the upwardly facing shoulder 912 on the internal diameter of lug ring housing 910. The lug ring 914 is free to rotate with respect to the lug ring housing and the cam mandrel 902 and may travel in the path indicated in FIG. 11G, for example, as the drill string is lifted and lowered during testing.

The outer diameter of the cam mandrel 902 may be stepped near its bottom end, thus forming an upwardly facing shoulder 916 thereon. The upwardly facing shoulder 916 engages the bottom end of lug ring housing 910 when the drill string 100 is lifted, thus preventing damage to the lug ring 914 through contact with the J-slot.

An upper body 918 (FIG. 11B), internally threaded near its upper end and internally and externally threaded near its lower end, may threadedly engage the lower end of lug ring housing 910. The internal diameter of the upper body 918 may be reduced above the internal threads near the lower end thereof to form an internally depending collar 919. Relief ports, as at 920, may extend through the wall of the upper body 918 above the upper face of collar 919.

An upper piston mandrel 922, externally threaded near its upper and lower ends, may threadedly engage the lower end of cam mandrel 902. Conventional O-rings may be used to seal the upper piston mandrel 922 to the cam mandrel 902 as shown. Preferably, the outer diameter of the upper piston mandrel 922 is less than the outer diameter of the cam mandrel 902 and is also less than the inner diameter of upper body 918 which surrounds both the upper piston mandrel 922 and the lower end of cam mandrel 902.

A seal 924 may surround the upper piston mandrel 922 near the lower end thereof. The seal 924 is conventional and comprises an upper male junk ring, Chevron V-ring packing, and lower female junk ring. The upper end of the seal 924 preferably abuts the lower face of collar 919 on the internal diameter of the upper body 918. The lower end of the seal 924 abuts the upper end of a packing nut upper body 926 which may be externally threaded about midway along its length to be connected to the bottom end of upper body 918.

The external diameter of the lower portion of the packing nut upper body may be enlarged and bear against the internal diameter of an hydraulic cylinder 928. An O-ring may seal the enlarged length of the packing nut upper body 926 to the hydraulic cylinder 928. Similarly, the outer and inner diameters of the packing nut upper body 926 may be sealed to the upper body 918 and upper piston mandrel 922.

Hydraulic cylinder 928 is preferably internally threaded near its upper end and internally and externally threaded near its lower end and threaded onto the lower end of upper body 918. The internal diameter of the hydraulic cylinder, near its lower end, may be reduced, forming an inwardly depending collar 930 thereon (FIG. 11C).

An externally protruding collar 932 (FIG. 11B) may be formed on the upper piston mandrel near its lower end. A fill port 934 extending through the wall of the hydraulic cylinder 928, approximately in line with the collar 932, may be provided with a conventional pipe plug. A similar fill port 935 may be provided and plugged as shown in FIG. 11C.

A lower piston mandrel 936, internally threaded near its top end and internally threaded near its lower end, may be attached to the lower end of upper piston mandrel 922. Conventional O-rings may be used to seal the upper piston mandrel 922 to the lower piston mandrel 936.

An externally protruding collar 938, may be cut into four sections which together, encircle the upper end of lower piston mandrel 936. The upper face of collar 938 may abut the lower end of a spring 940, the upper end of which abuts a downwardly facing shoulder 942 on a piston head 944.

Figure 11H:
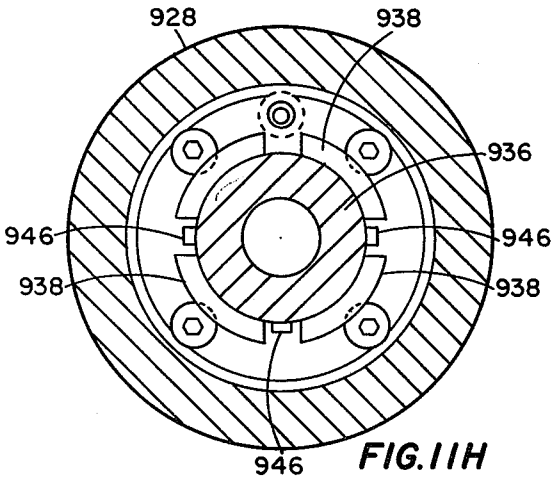
FIG. 11H is a cross section taken at H—H in FIG. 11B.

Piston head 944 preferably encircles and bears against the outer diameter of the lower end of upper piston mandrel 922 and the upper end thereof abuts the lower face of collar 932 on the upper piston mandrel 922. The outer diameter of the piston head 944 may be slightly less than the inner diameter of the hydraulic cylinder 928; that difference determines the rate at which the hydraulic main valve opens when weight is set down on the drill string 100. In addition, the inner surface of the piston head 944 may be grooved longitudinally, as at 946, as shown in FIGS. 11B and 11H, the latter being a cross-section taken at H—H in FIG. 11C.

Piston head 944 is preferably adapted to move up and down, relative to hydraulic cylinder 928, in a chamber 948 formed between hydraulic cylinder 928 and of lower piston mandrel 936. Chamber 948 may be filled with any suitable fluid, such as Dow Corning 200 Fluid (350 cst), through either fill port 934 or 935, while air is bled off through the other port.

A seal 950 may surround the lower piston mandrel 936 and comprise a male junk ring, Teflon or similar material V-ring packing, double female junk ring, chevron V-ring packing, and male junk ring, in descending order. The top end of the seal 950 may abut the lower face of collar 930 on hydraulic cylinder 928 and be held thereagainst by an externally threaded cylinder packing nut 952 which threads into the bottom end of the hydraulic main cylinder 928.

A hollow equilizer sub 954, internally threaded near its top end and externally threaded near its bottom end, may threadedly engage the bottom end of hydraulic cylinder 928. The lower portion of the equalizer sub 954, in turn, may surround a hollow equalizer sleeve 956. Relative movement between equalizer sleeve 956 and equalizer sub 954 may be prevented by any suitable means such as plugs 958 and 960 as shown in FIG. 11D. The aperture into which plug 960 is illustrated preferably extends completely through the wall of the equalizer sleeve 956. Conventional O-rings may seal the equalizer sleeve 956 against the inner diameter of the equalizer sub 954.

The equalizer sleeve, in turn, may surround the bottom end of a production mandrel 962 and a hollow, keyed rod 964. The bottom end of the production mandrel 962 may be internally threaded and the top end of the keyed rod 964 may be externally threaded so as to be releasably attached to one another as shown in FIG. 11D.

As shown in FIG. 11C, the upper end of the production mandrel 962 may fit within the bottom end of the lower piston mandrel 936 and a conventional O-ring may provide a seal therebetween. The upper portion of the production mandrel 962 may also be provided with a hollow center.

An externally threaded, friction joint, shear ring nut 966 (FIG. 11C) may be threaded into the bottom end of the lower piston mandrel 936 near the upper end of production mandrel 962.

A conventional thread protector 968 may be carried in a groove in the outer diameter of the production mandrel 962 near its upper end and may engage the upper end of the friction joint, shear ring nut 966 when the latter is threaded into the lower piston mandrel 936.

Flow ports 970 may be provided in the wall of the production mandrel 962 near the upper end thereof in communication with the hollow interior. Other ports 972 may also extend through the wall of the production mandrel 962, below the flow ports 970, and be suitably plugged.

Conventional O-rings may seal the relatively movable production mandrel 962 and equalizer sleeve 956.

Such O-rings preferably lie both above and below the flow ports 970.

Figure 11I:
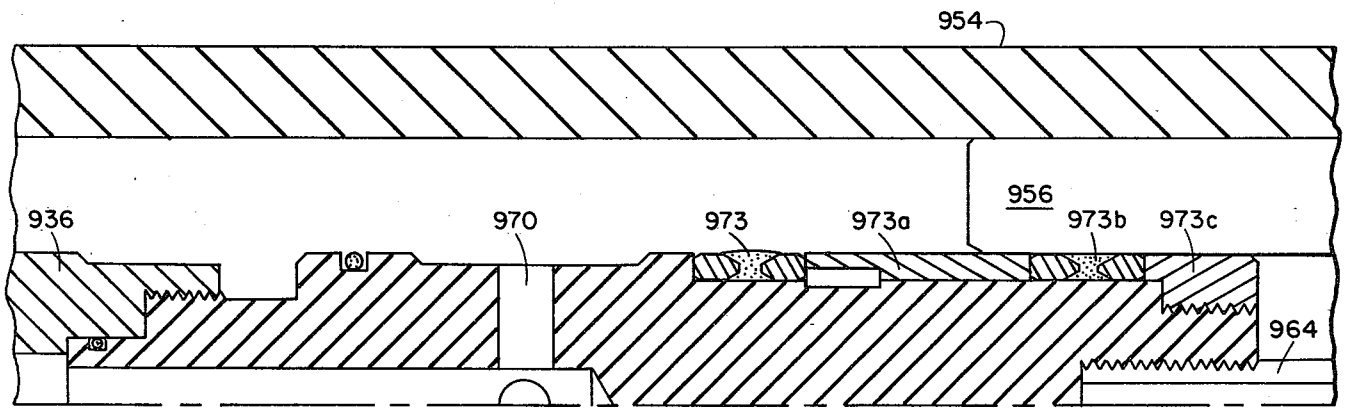
FIG. 11I is an alternate configuration of the production mandrel 962 shown in FIGS. 11C and 11D.

An alternate embodiment of a production mandrel is shown in partial section in FIG. 11I. In this illustration, the friction joint, shear ring nut 966 has been omitted and the upper end of the production mandrel is threaded directly into the bottom end of the lower piston mandrel 936. The plugged ports 972 have also been eliminated. Also, O-ring seals below ports 970 have been replaced by an upper seal 973, spacer 973*a*, lower seal 973*b*, and seal retainer 973*c* which is threaded onto the lower end of production mandrel 962.

Returning to that portion of the preferred embodiment shown in FIG. 11D, flow passageways, as at 974, are provided in the wall of equalizer sleeve 956 to extend between the bottom end thereof and radial flow ports 976 in the wall of the equalizer sleeve 956.

A hollow connector sub 978, internally threaded near its upper end and externally threaded near its bottom end, may engage the bottom end of equalizer sub 954. The upper end of the connector sub 978 surrounds a hollow sleeve 982 which may be internally threaded near its lower end. The hollow sleeve 982 is shown to be longitudinally slotted internally, as at 984, and keyed to rod 964 by means of a key 986.

A hollow middle tube 988, externally threaded near its top end and internally threaded near its bottom end, may be connected to the lower end of the sleeve 982 by means of a nut 990. Nut 990 may be suitably threaded to the lower end of sleeve 982 and upper end of middle tube 988, a shown in FIG. 11D. The middle tube 988 may be suitably sealed against the internal diameter of nut 990.

A hollow body 992 (FIGS. 11E and 11F), threaded near its upper and lower ends, may threadedly engage the lower end of connector sub 978, as shown. The lower end of body 992, in turn, may be connected to the top end of a hollow stabilizer sub 994. Body 992 may surround and be spaced from the outer diameter of a spool 996 which is threaded near its upper and lower ends. The spool 996, in turn, may surround a lower portion of middle tube 988 and be adapted to move axially relative thereto.

The interior diameter of the body 992 is preferably reduced near the upper end thereof to form a collar 998 having a downwardly facing shoulder 1000 formed on the internal diameter near its upper end. A flow passageway 1002 may extend axially through the collar 998 and a valve 1004 is located in the passageway.

The upper, outer diameter of spool 996 is shown in FIG. 11E to be grooved to receive a top seal 1006, the outer diameter of which bears against the inner diameter of collar 998. A top seal retainer 1008 may be threaded into the top end of spool 996 to retain the top seal 1006 longitudinally relative to spool 996.

An external collar 1010 may be provided on middle tube 988, approximately midway of its length. The collar may have a downwardly facing ramp adapted to engage an upwardly facing ramp on the top seal retainer 1008.

The internal diameter of body 992 may also be reduced near its bottom end to provide an internal collar 1012 (FIG. 11F) thereon. An axial passageway 1014 may enter collar 1012 from its top end and terminate at a valve 1016 located in the collar.

The external portion of the bottom end of spool 996 may also be grooved to receive a bottom seal 1018 which is retained longitudinally by a bottom seal retainer 1020 suitably connected to the bottom end of spool 996. The internal diameter of bottom seal retainer 1020 may ride on the surface of middle tube 988 and a conventional O-ring may provide a seal therebetween.

A middle tube support 1022 may be connected to the lower end of the middle tube 988 and be conventionally sealed thereagainst. The outer diameter of the middle tube support 1022 is preferably, greater than the outer diameter of the middle tube 988, thus producing an upwardly facing shoulder at their juncture.

The upwardly facing shoulder on the middle tube support 1022 may abut the bottom end of a hollow spring cover 1024 surrounding a spring 1026. The upper end of spring 1026 may contact the bottom end of bottom seal retainer 1020 to bias the spool 996 upwardly at all times relative to the middle tube 988.

As seen in FIG. 11F, middle tube support 1022 may be centered relative to stabilizer sub 994 by means such as an internal collar 1028 located near the bottom of the sub. Axial flow passageways, e.g., 1030, may extend through the collar 1028 to allow well fluid to flow into the hydraulic main valve.

The upper end of the middle tube support 1022 may be closed by means such as piston 1032, with conventional O-rings providing a seal between the piston and the internal diameter of the middle tube support 1022.

Hydraulic Main Valve 102 Operation

The hydraulic main valve 102 preferably functions as an on/off device to control flow and shut-in testing in a zone of interest. Once packer 112, in a single packer test, or packers 112 and 122, in a straddle packer test, are set, weight is set down on the drill string, causing the valve assembly 108 and hydraulic main valve 102 to collapse.

In the case of the illustrated preferred embodiment of hydraulic main valve 102, the outer portion, including key 906 (FIG. 11A), keyed sleeve 908, lug ring housing 910 (FIG. 11B), lug ring 914, upper body 918, hydraulic cylinder 928, equalizer sub 954 (FIG. 11C), connector sub 978 (FIG. 11D), body 992 (FIG. 11E), stabilizer sub 994 (FIG. 11F) and all components affixed thereto, moves down with the collapsing portion of the valve assembly 108. At the same time, the inner portion of the hydraulic main valve 102, including top sub 900 (FIG. 11A), cam mandrel 902, upper piston mandrel 922 (FIG. 11B), lower piston mandrel 936, production mandrel 962 (FIG. 11C), keyed rod 964 (FIG. 11D), and all components affixed thereto, moves down relative to the outer portion of the valve 102 at a rate determined by the radial clearance between piston head 944 and hydraulic cylinder 928.

As shown in the developed cam pattern of FIG. 11G, when the hydraulic main valve is open, lug ring 914 is in slot 904A; the lower face of piston head 944 abuts the upper face of collar 930 on the inner diameter of the hydraulic cylinder 928. In this condition, the sample collecting mechanism, including spool 996, (FIGS. 11E and 11F), top seal retainer 1008, bottom seal retainer 1020, spring cover 1024, and all components affixed thereto, have been moved downwardly through the interaction of collar 1010 on middle tube 988 with top seal retainer 1008. Thus, top seal retainer 1008, top seal 1006, bottom seal retainer 1020 and bottom seal 1018 have been moved downwardly completely away from collars 998 and 1012, respectively.

Also, ports 970 (FIG. 11C), in the production mandrel 962, have moved downwardly therewith into fluid alignment with flow ports 976 (FIG. 11D), in the wall of equalizer sleeve 956.

With the hydraulic main valve thus opened, well fluid from the test zone flows upwardly through passageway 1030 (FIG. 11F) in collar 1028 on stabilizer sub 994, between middle tube support 1022 and stabilizer sub 994, between spool 996 and body 992, between middle tube 988 and connector sub 978 (FIG. 11E), between sleeve 982 and connector sub 978 (FIG. 11D), between keyed rod 964 and equalizer sub 954, through flow passageways 974 and ports 976 in equalizer sleeve 956, through the ports 970 in the production mandrel 962 (which are aligned with ports 976) into the hollow interiors of the production mandrel 962, the lower piston mandrel 936, upper piston mandrel 922 (FIG. 11B), cam mandrel 902, and top sub 900 (FIG. 11A). The well fluid then continues flowing to the surface through the hollow drill string 100.

To close the hydraulic main valve, the drill string is lifted quickly and the weight is then reset. Quick lifting action is preferred because piston head 944 can move upwardly rapidly due to the grooves 946 shown in FIG. 11H, running axially in the inner surface of the piston head 944. As lower piston mandrel 936 (FIG. 11C) starts to move upwardly, the upper face of piston head 944 moves away from the lower face of collar 932 on the outer diameter of upper piston mandrel 922. This allows trapped fluid on the upper side of piston head 944 to move rapidly through the grooves 946.

The lift/set-down sequence causes lug ring 914 (FIGS. 11B and 11G) to move from slot 904A to slot 904C to slot 904D, where the hydraulic main valve 102 is closed and weight has been set back down on the testing tool. It is necessary that weight remain on the tool during the test so that valve assembly 108 does not elongate.

When the hydraulic main valve is closed, ports 970 in the production mandrel 962 will have been moved upwardly and will be sealed off from the flow ports 976 in the wall of equalizer sleeve 956. In the case of the alternate construction of the production mandrel shown in FIG. 11I, sealing is accomplished by means of seals 973 and **973*b***.

When the shut-in test is complete, the hydraulic main valve 102 may be cycled to open for another test in the same zone, or else the entire testing tool withdrawn from the well. If the hydraulic main valve 102 is cycled to open for another flow test in the same zone, the drill string 100 is lifted and weight again reset. This causes lug ring 914 to move from slot 904D to slot 904B to slot 904A in the cam pattern shown in FIG. 11G.

If the testing tool is rest to test another zone of interest in the well, the drill string is lifted, valve assembly 108 elongates, the packer elements deflate, and the hydraulic main valve 102 returns to its original position as shown in FIGS. 11A–11F. Another flow and shut-in cycle would then ensue.

If the testing tool is withdrawn from the well, the drill string 100 is lifted, valve assembly 108 elongates, the packer element(s) deflate and the hydraulic main valve 102 returns to the position shown in FIG. 11A–11F. In this condition, top seal 1006 (FIG. 11E) and seal 1018 (FIG. 11F) on spool 996 are moved back up under collars 998 and 1012, respectively, on the inner diameter of body 992. This seals off a sample in the space between the outer diameter of spool 996 and the inner diameter of body 992.

The sample will be retained in that space until drained off by means of valves 1004 and 1016. In the case of multiple testing in a well before withdrawal of the testing tool, only the sample from the last test will be retained.

As will now be realized by those skilled in the art, a tool which utilizes the present invention produces the ability to test a well bore in a very simple operation requiring a minimum of time and skill. A wide variety of tools employing the invention defined by the following claims can now be envisioned, many of which many not even bear strong physical and relational resemblance to the presently preferred embodiment described and depicted here.

I claim:

1. An inflatable packer system with a central unrestricted bore adapted to be lowered on a tubular member into a well annulus having a wall for isolating at least one zone in the well during test comprising;

at least one inflatable element in said system adapted to be located adjacent said at least one zone;

pump means in said system operable upon rotation of said tubular member to provide inflation fluid;

inflation fluid passage means separate from said central unrestricted bore between said pump means and said at least one inflatable element;

valve means in said system for controlling flow of inflation fluid to said at least one inflatable element;

said valve means including an outer sleeve housing means;

shifting sleeve means in said valve means adapted to be shifted downward longitudinally with respect to said sleeve housing means upon initial flow of inflation fluid from said pump means to provide an inflation fluid passageway between said pump means and said at least one inflatable element;

said pump means operable to pump inflation fluid into said at least one inflatable element to sealingly engage said at least one inflatable element against the well annulus wall to isolate said at least one zone.

2. An inflatable packer system as set forth in claim 1 wherein;

there are at least two inflatable elements in said system adapted to be spaced apart to straddle said at least one zone;

said inflation fluid passage means extends between said pump means and said at least two inflatable elements;

said valve means controls the flow of inflation fluid to said at least two inflatable elements; and said pump means operates to pump inflation fluid into said at least two inflatable elements to sealingly engage said at least two inflatable elements against the well annulus wall to isolate said at least one zone.

3. An inflatable packer system as set forth in claim 1 or 2 and further including;

relief valve means in said inflation fluid passage means separate from said pump means to vent inflation fluid to the well annulus when pump pressure exceeds fluid pressure in the well annulus adjacent an inflatable element by a predetermined amount.

4. An inflatable packer system as set forth in claim 3 and further including;

check valve means in said inflation fluid passage means between said pump means and said valve means and separate from said pump means to prevent loss of pressure in an inflatable element, should inflation pressure drop below the pressure in an inflatable element.

5. An inflatable packer system as set forth in claim 4 and further including;

separate deflate means between said valve means and said inflatable element(s) to allow deflation thereof when a predetermined upward pull is applied to said tabular member in excess of that required to elongate said valve means.

6. An inflatable packer system as set forth in claim 5 and further including;

drag spring means terminating the lower end of said inflatable packer system;

said drag spring means including a plurality of spring means adapted to engage the well annulus wall;

each of said spring means having upper and lower ends;

axially extending mandrel support means in said drag spring means;

upper and lower collar means surrounding said mandrel support means and adapted for axial movement with respect thereto;

the upper and lower ends of said spring means being attached to said upper and lower collar means respectively so that there is essentially no relative axial movement between respective individual upper ends of said spring means and so that there is essentially no relative axial movement between respective individual lower ends of said spring means.

7. An inflatable packer system as set forth in claim 6 and further including:

separate, spaced apart upper and lower abutment means on said mandrel support means;

said upper and lower abutment means comprise radially extending upwardly and downwardly facing shoulders, respectively, on the outer surface of said mandrel support means.

8. An inflatable packer system as set forth in claim 7 and further including;

upper and lower keying means interconnecting said upper and lower ends of said spring means, respectively, with said mandrel support means to prevent relative rotation between said spring means and said mandrel support means.

9. An inflatable packer system as set forth in claim 6 and further including;

upper and lower keying means interconnecting said upper and lower ends of said spring means, respectively, with said mandrel support means to prevent relative rotation between said spring means and said mandrel support means.

10. An inflatable packer system as set forth in claim 4 and further including;

drag spring means terminating the lower end of said inflatable packer system;

said drag spring means including a plurality of spring means adapted to engage the well annulus wall;

each of said spring means having upper and lower ends;

axially extending mandrel support means in said drag spring means;

upper and lower collar means surrounding said mandrel support means and adapted for axial movement with respect thereto;

the upper and lower ends of said spring means being attached to said upper and lower collar means respectively so that there is essentially no relative axial movement between respective individual upper ends of said spring means and so that there is essentially no relative axial movement between respective individual lower ends of said spring means.

11. An inflatable packer system as set forth in claim 10 and further including:

separate, spaced apart upper and lower abutment means on said mandrel support means;

said upper and lower abutment means comprise radiall extending uopwardly and downwardly facing shoulders, respectively, on the outer surface of said mandrel support means.

12. An inflatable packer system as set forth in claim 11 and further including;

upper and lower keying means interconnecting said upper and lower ends of said spring means, respectively, with said mandrel support means to prevent relative rotation between said spring means and said mandrel support means.

13. An inflatable packer system as set forth in claim 10 and further including;

upper and lower keying means interconnecting said upper and lower ends of said spring means, respectively, with said mandrel support means to prevent relative rotation between said spring means and said mandrel support means.

14. An inflatable packer system as set forth in claim 3 and further including;

drag spring means terminating the lower end of said inflatable packer system;

said drag spring means including a plurality of spring means adapted to engage the well annulus wall;

each of said spring means having upper and lower ends;

axially extending mandrel support means in said drag spring means;

upper and lower collar means surrounding said mandrel support means and adapted for axial movement with respect thereto;

the upper and lower ends of said spring means being attached to said upper and lower collar means respectively so that there is essentially no relative axial movement between respective individual upper ends of said spring means and so that there is essentially no relative axial movement between respective individual lower ends of said spring means.

15. An inflatable packer system as set forth in claim 14 and further including;

separate, spaced apart upper and lower abutment means on said mandrel support means;

said upper and lower abutment means comprise radially extending upwardly and downwardly facing shoulders, respectively, on the outer surface of said mandrel support means.

16. An inflatable packer system as set forth in claim 15 and further including;

upper and lower keying means interconnecting said upper and lower ends of said spring means, respectively, with said mandrel support means to prevent relative rotation between said spring means and said mandrel support means.

17. An inflatable packer system as set forth in claim 14 and further including;

upper and lower keying means interconnecting said upper and lower ends of said spring means, respectively, with said mandrel support means to prevent relative rotation between said spring means and said mandrel support means.

18. An inflatable packer system as set forth in claim 1, or 2 and further including;

check valve means in said inflation fluid passage means between said pump means and said valve means and separate from said pump means to prevent loss of pressure in an inflatable element, should inflation pressure drop below the pressure in an inflatable element.

19. An inflatable packer system as set forth in claim 18 and further including;

separate deflate means between said valve means and said inflatable element(s) to allow deflation thereof when a predetermined upward pull is applied to said tubular member in excess of that required to elongate said valve means.

20. An inflatable packer system as set forth in claim 19 and further including;

drag spring means terminating the lower end of said inflatable packer system;

said drag spring means including a plurality of spring means adapted to engage the well annulus wall;

each of said spring means having upper and lower ends;

axially extending mandrel support means in said drag spring means;

upper and lower collar means surrounding said mandrel support means and adapted for axial movement with respect thereto;

the upper and lower ends of said spring means being attached to said upper and lower collar means respectively so that there is essentially no relative axial movement between respective individual upper ends of said spring means and so that there is essentially no relative axial movement between respective individual lower ends of said spring means.

21. An inflatable packer system as set forth in claim 20 and further including;

separate, spaced apart upper and lower abutment means on said mandrel support means;

said upper and lower abutment means comprise radially extending upwardly and downwardly facing shoulders, respectively, on the outer surface of said mandrel support means.

22. An inflatable packer system as set forth in claim 21 and further including;

upper and lower keying means interconnecting said upper and lower ends of said spring means, respectively, with said mandrel support means to prevent relative rotation between said spring means and said mandrel support means.

23. An inflatable packer system as set forth in claim 20 and further including;

upper and lower keying means interconnecting said upper and lower ends of said spring means, respectively, with said mandrel support means to prevent relative rotation between said spring means and said mandrel support means.

24. An inflatable packer system as set forth in claim 18 and further including;

drag spring means terminating the lower end of said inflatable packer system;

said drag spring means including a plurality of spring means adapted to engage the well annulus wall;

each of said spring means having upper and lower ends;

axially extending mandrel support means in said drag spring means;

upper and lower collar means surrounding said mandrel support means and adapted for axial movement with respect thereto;

the upper and lower ends of said spring means being attached to said upper and lower collar means respectively so that there is essentially no relative axial movement between respective individual upper ends of said spring means and so that there is essentially no relative axial movement between respective individual lower ends of said spring means.

25. An inflatable packer system as set forth in claim 24 and further including:

separate, spaced apart upper and lower abutment means on said mandrel support means;

said upper and lower abutment means comprise radially extending upwardly and downwardly facing shoulders, respectively, on the outer surface of said mandrel support means.

26. An inflatable packer system as set forth in claim 25 and further including;

upper and lower keying means interconnecting said upper and lower ends of said spring means, respectively, with said mandrel support means to prevent relative rotation between said spring means and said mandrel support means.

27. An inflatable packer system as set forth in claim 24 and further including;

upper and lower keying means interconnecting said upper and lower ends of said spring means, respectively, with said mandrel support means to prevent relative rotation between said spring means and said mandrel support means.

28. An inflatable packer system as set forth in claim 1, or 2 and further including;

separate deflate means between said valve means and said inflatable elements(s) to allow deflation thereof when a predetermined upward pull is applied to said tubular member in excess of that required to elongate said valve means.

29. An inflatable packer system as set forth in claim 28 and further including;

drag spring means terminating the lower end of said inflatable packer system;

said drag spring means including a plurality of spring means adapted to engage the well annulus wall;

each of said spring means having upper and lower ends;

axially extending mandrel support means in said drag spring means;

upper and lower collar means surrounding said mandrel support means and adapted for axial movement with respect thereto;

the upper and lower ends of said spring means being attached to said upper and lower collar means respectively so that there is essentially no relative axial movement between respective individual upper ends of said spring means and so that there is essentially no relative axial movement between respective individual lower ends of said spring means.

30. An inflatable packer system as set forth in claim 29 and further including;

separate, spaced apart upper and lower abutment means on said mandrel support means;

said upper and lower abutment means comprise radially extending upwardly and downwardly facing shoulders, respectively, on the outer surface of said mandrel support means.

31. An inflatable packer system as set forth in claim 30 and further including;

upper and lower keying means interconnecting said upper and lower ends of said spring means, respectively, with said mandrel support means to prevent relative rotation between said spring means and said mandrel support means.

32. An inflatable packer system as set forth in claim 29 and further including;

upper and lower keying means interconnecting said upper and lower ends of said spring means, respectively, with said mandrel support means to prevent relative rotation between said spring means and said mandrel support means.

33. An inflatable packer system as set forth in claim 1 or 2 and further including;

drag spring means terminating the lower end of said inflatable packer system;

said drag spring means including a plurality of spring means adapted to engage the well annulus wall;

each of said spring means having upper and lower ends;

axially extending mandrel support means in said bag spring means;

upper and lower collar means surrounding said mandrel support means and adapted for axial movement with respect thereto;

the upper and lower ends of said spring means being attached to said upper and lower collar means respectively so that there is essentially no relative axial movement between respective individual upper ends of said spring means and so that there is essentially no relative axial movement between respective individual lower ends of said spring means.

34. An inflatable packer system as set forth in claim 33 and further including:

separate, spaced apart upper and lower abutment means on said mandrel support means;

said upper and lower abutment means comprise radially extending upwardly and downwardly facing shoulders, respectively, on the outer surface of said mandrel support means.

35. An inflatable packer system as set forth in claim 34 and further including;

upper and lower keying means interconnecting said upper and lower ends of said spring means, respectively, with said mandrel support means to prevent relative rotation between said spring means and said mandrel support means.

36. An inflatable packer system as set forth in claim 33 and further including;

upper and lower keying means interconnecting said upper and lower ends of said spring means, respectively, with said mandrel support means to prevent relative rotation between said spring means and said mandrel support means.

37. An inflatable packer system adapted to be lowered on a tubular member into a well annulus having a wall for isolating at least one zone in the well during test comprising;

at least one inflatable element in said system adapted to be located adjacent said at least one zone;

pump means in said system operable upon rotation of said tubular member to provide inflation fluid;

inflation fluid passage means between said pump means and said at least one inflatable element;

valve means in said system for controlling flow of inflation fluid to said at least one inflatable element;

said valve means including an outer sleeve housing means;

shifting sleeve means in said valve means adapted to be shifted downward longitudinally with respect to said sleeve housing means upon operation of said pump means to provide an inflation fluid passageway between said pump means and said at least one inflatable element;

said pump means operable to pump inflation fluid into said at least one inflatable element to sealingly engage said at least one inflatable element against the well annulus wall to isolate said at least one zone; and time delay means in said valve means to provide a time delay when weight is set down on the tubular member after element inflation.

38. An inflatable packer system as set forth in claim 37 and further including;

means in said valve means for sealing off a packer element to maintain the inflation thereof after packer inflation and weight set-down.

39. An inflatable packer system as set forth in claim 38, and further including;

means in said valve means in fluid communication with said at least one zone and the well annulus in the vicinity of the valve means for venting said at least one zone to the well annulus during weight set-down.

40. An inflatable packer system as set forth in claim 39 and further including;

means in said valve means for venting pressurized inflation fluid to the well annulus after packer inflation during weight set-down.

41. An inflatable packer system as set forth in claim 39 and further including;

other sealing means in said valve;

said zone venting means in said valve means is so located as to pass under said other sealing means near the end of time delay on weight set-down to prevent fluid communication between said at least one zone and the well annulus during testing of said at least one zone.

42. An inflatable packer system as set forth in claim 41 wherein;

upon completion of testing said at least one zone and initial lifting of said tubular member, said zone venting means in said valve means passes back under said other sealing means to restore fluid communication between said at least one zone and the well annulus to equalize the pressure within said at least one zone with the well annulus pressure above said at least one zone.

43. An inflatable packer system as set forth in claim 42 and further including;

deflate vent means in said shifting sleeve means in fluid communication with said inflation passage means;

shifting sleeve pickup means adapted to move in said valve means so that, upon further lifting of said tubular member, said shifting sleeve means is moved toward its original starting position, thus venting inflation fluid from an inflatable element to the well annulus, thereby allowing an inflatable element to deflate upon pickup of said tubular member.

44. An inflatable packer system as set forth in claim 38, and further including;

means in said valve means in fluid communication with said at least one zone and the well annulus in the vicinity of the valve means for venting said at least one zone to the well annulus during weight set-down and after testing said at least one zone and upon initial lifting of said tubular member.

45. An inflatable packer system as set forth in claim 44 and further including;

means in said valve means for venting pressurized inflation fluid to the well annulus after packer inflation during weight set-down.

46. An inflatable packer system as set forth in claim 44 and further including;

other sealing means in said valve;

said zone venting means in said valve means is so located as to pass under said other sealing means near the end of time delay on weight set-down to prevent fluid communication between said at least one zone and the well annulus during testing of said at least one zone.

47. An inflatable packer system as set forth in claim 46 wherein;

upon completion of testing said at least one zone and initial lifting of said tubular member, said zone venting means in said valve means passes back under said other sealing means to restore fluid communication between said at least one zone and the well annulus to equalize the pressure within said at least one zone with the well annulus pressure above said at least one zone.

48. An inflatable packer system as set forth in claim 47 and further including;

deflate vent means in said shifting sleeve means in fluid communication with said inflation passage means;

shifting sleeve pickup means adapted to move in said valve means to that, upon further lifting of said tubular member, said shifting sleeve means is moved toward its original starting position, thus venting inflation fluid from an inflatable element to the well annulus, thereby allowing an inflatable element to deflate upon pickup of said tubular member.

49. An inflatable packer system as set forth in claim 37 and further including;

means in said valve means in fluid communication with said at least one zone and the well annulus in the vicinity of the valve means for venting said at least one zone to the well annulus during weight set-down.

50. An inflatable packer system as set forth in claim 49 and further including;

means in said valve means for venting pressurized inflation fluid to the well annulus after packer inflation during weight set-down.

51. An inflatable packer system as set forth in claim 49 and further including;

other sealing means in said valve;

said zone venting means in said valve means is so located as to pass under said other sealing means near the end of time delay on weight set-down to prevent fluid communication between said at least one zone and the well annulus during testing of said at least one zone.

52. An inflatable packer system as set forth in claim 51 wherein;

upon completion of testing said at least one zone and initial lifting of said tubular member, said zone venting means in said valve means passes back under said other sealing means to restore fluid communication between said at least one zone and the well annulus to equalize the pressure within said at least one zone with the well annulus pressure above said at least one zone.

53. An inflatable packer system as set forth in claim 52 and further including;

deflate vent means in said shifting sleeve means in fluid communication with said inflation passage means;

shifting sleeve pickup means adapted to move in said valve means so that, upon further lifting of said tubular member, said shifting sleeve means is moved toward its original starting position, thus venting inflation fluid from an inflatable element to the well annulus, thereby allowing an inflatable element to deflate upon pickup of said tubular member.

54. An inflatable packer system as set forth in claim 37 and further including;

means in said valve means in fluid communication with said at least one zone and the well annulus in the vicinity of the valve means for venting said at least one zone to the well annulus during weight set-down and after testing said at least one zone and upon initial lifting of said tubular member.

55. An inflatable packer system as set forth in claim 54 and further including;

means in said valve means for venting pressurized inflation fluid to the well annulus after packer inflation during weight set-down.

56. An inflatable packer system as set forth in claim 55 and further including;

separate deflate means between said valve means and said inflatable elements(s) to allow deflation thereof when a predetermined upward pull is applied to said tubular member in excess of that required to elongate said valve means.

57. An inflatable packer system as set forth in claim 56 and further including;

drag spring means terminating the lower end of said inflatable packer system;

said drag spring means including a plurality of spring means adapted to engage the well annulus wall;

each of said spring means having upper and lower ends;

axially extending mandrel support means in said drag spring means;

upper and lower collar means surrounding said mandrel support means and adapted for axial movement with respect thereto;

the upper and lower ends of said spring means being attached to said upper and lower collar means respectively so that there is essentially no relative axial movement between respective individual upper ends of said spring means and so that there is essentially no relative axial movement between respective individual lower ends of said spring means.

58. An inflatable packer system as set forth in claim 57 and further including:

separate, spaced apart upper and lower abutment means on said mandrel support means;

said upper and lower abutment means comprise radially extending upwardly and downwardly facing shoulders, respectively, on the outer surface of said mandrel support means.

59. An inflatable packer system as set forth in claim 58 and further including;

upper and lower keying means interconnecting said upper and lower ends of said spring means, respectively, with said mandrel support means to prevent relative rotation between said spring means and said mandrel support means.

60. An inflatable packer system as set forth in claim 57 and further including;

upper and lower keying means interconnecting said upper and lower ends of said spring means, respectively, with said mandrel support means to prevent relative rotation between said spring means and said mandrel support means.

61. An inflatable packer system as set forth in claim 54 and further including;

other sealing means in said valve;

said zone venting means in said valve means is so located as to pass under said other sealing means near the end of time delay on weight set-down to prevent fluid communication between said at least one zone and the well annulus during testing of said at least one zone.

62. An inflatable packer system as set forth in claim 61 wherein;

upon completion of testing said at least one zone and initial lifting of said tubular member, said zone venting means in said valve means passes back under said other sealing means to restore fluid communication between said at least one zone and the well annulus to equalize the pressure within said at least one zone with the well annulus pressure above said at least one zone.

63. An inflatable packer system as set forth in claim 62 and further including;

deflate vent means in said shifting sleeve means in fluid communication with said inflation passage means;

shifting sleeve pickup means adapted to move in said valve means so that, upon further lifting of said tubular member, said shifting sleeve means is moved toward its original starting position, thus venting inflation fluid from an inflatable element to the well annulus, thereby allowing an inflatable element to deflate upon pickup of said tubular member.

* * * * *